US008910493B2

(12) United States Patent
Ringwaldt

(10) Patent No.: US 8,910,493 B2
(45) Date of Patent: Dec. 16, 2014

(54) OIL FREE FALLING FILM HEAT EXCHANGER

(76) Inventor: Samuel Alexander Ringwaldt, Singapore (SG)

( * ) Notice: Subject to any disclaimer, the term of this patent is extended or adjusted under 35 U.S.C. 154(b) by 830 days.

(21) Appl. No.: 12/951,944

(22) Filed: Nov. 22, 2010

(65) Prior Publication Data

US 2011/0120672 A1 May 26, 2011

Related U.S. Application Data

(60) Provisional application No. 61/281,691, filed on Nov. 20, 2009.

(51) Int. Cl.

| | |
|---|---|
| ***F25D 5/00*** | (2006.01) |
| ***F28F 3/04*** | (2006.01) |
| ***F28D 3/00*** | (2006.01) |
| *F28F 25/06* | (2006.01) |
| *F28D 21/00* | (2006.01) |

(52) U.S. Cl.

CPC . *F28D 3/00* (2013.01); *F28F 25/06* (2013.01); *F28F 3/042* (2013.01); *F28D 2021/0071* (2013.01)

USPC ..... 62/304

(58) Field of Classification Search

CPC ..... F28D 5/00; F28D 5/02; F28D 2021/0071; F25D 3/00; F28F 25/06; F28F 3/042

USPC ..... 62/304; 165/115, 160

See application file for complete search history.

(56) References Cited

U.S. PATENT DOCUMENTS

| | | | | | |
|---|---|---|---|---|---|
| 4,552,303 | A * | 11/1985 | Fisher et al. | ..... | 236/44 C |
| 4,616,777 | A * | 10/1986 | Fisher et al. | ..... | 236/44 C |
| 4,974,422 | A * | 12/1990 | Kocher | ..... | 62/305 |
| 5,178,210 | A * | 1/1993 | Guillet et al. | ..... | 165/111 |
| 5,247,809 | A * | 9/1993 | Berryhill | ..... | 62/304 |
| 5,497,628 | A * | 3/1996 | Stueble | ..... | 62/91 |
| 6,681,844 | B1 * | 1/2004 | Inoue et al. | ..... | 165/115 |
| 2005/0056029 | A1 * | 3/2005 | Maisotsenko et al. | ..... | 62/121 |
| 2007/0101746 | A1 * | 5/2007 | Schlom et al. | ..... | 62/310 |
| 2008/0135176 | A1 * | 6/2008 | Park et al. | ..... | 156/345.32 |

FOREIGN PATENT DOCUMENTS

| | | | | | |
|---|---|---|---|---|---|
| JP | 2008215650 | A * | 9/2008 | ..... | F28F 25/06 |
| WO | WO 9803832 | A1 * | 1/1998 | ..... | F28F 13/02 |

* cited by examiner

*Primary Examiner* — Mohammad M Ali
*Assistant Examiner* — Emmanuel Duke
(74) *Attorney, Agent, or Firm* — J. Wiley Horton

(57) ABSTRACT

A falling film plate type heat exchanger. The heat exchanger includes a pressure vessel surrounding an encapsulated stack of plates. Each plate has a primary fluid side and a secondary fluid side. The primary fluid will be a refrigerant—such as R-134*a*. The secondary fluid will typically be water. A film of refrigerant is applied to the primary fluid side of each plate, where it evaporates by absorbing heat from the secondary fluid on the other side of the plate. The invention uses embossed patterns on the plates to direct the flow of the primary and secondary fluids in a desired pattern. Further, the primary fluid side of each plate has a roughened surface treatment to increase the effective surface area and thereby increase the heat transfer rate.

15 Claims, 53 Drawing Sheets

OIL FREE FALLING FILM HEAT EXCHANGER

CROSS-REFERENCES TO RELATED APPLICATIONS

This is a non-provisional application filed under 37 C.F.R. §1.53(c), which claims the benefit of an earlier-filed provisional application. The earlier provisional application was filed on Nov. 20, 2009 and was assigned application Ser. No. 61/281,691.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of heat exchangers. More specifically, the invention comprises a falling film liquid-to-liquid plate type heat exchanger featuring an enhanced surface on the primary fluid side.

2. Description of the Related Art

Heating, ventilation, and cooling ("HVAC") systems employ at least two heat exchangers in a circulating loop of refrigerant. One heat exchanger is used to reject heat. This device is typically known as a condenser. A second heat exchanger is used to absorb heat. This device is typically known as an evaporator. Some HVAC systems have reversing valves which allow the circulating loop of refrigerant to selectively operate in either direction. When the flow is reversed, the evaporator becomes the condenser and the condenser becomes the evaporator.

Most readers will be familiar with residential HVAC systems. Such systems employ liquid-to-air heat exchangers. As an example, a residential heat pump uses one heat exchanger located outside the dwelling and another typically located inside the dwelling. When the heat pump is operating in the air conditioning mode, the external heat exchanger operates as a condenser. Hot compressed refrigerant gas is piped from the compressor to the external heat exchanger, where it loses heat and condenses to a liquid. The exchanger itself is a serpentine conduit passing through a large array of connected cooling "fins." These fins greatly increase the effective surface area of the conduit, so that heat is transferred from the hot gas to the surrounding air. A fan is often used to force air over the fins.

The internal heat exchanger operates as an evaporator. Liquid refrigerant is passed through an expansion valve which lowers the pressure, thereby lowering the boiling temperature of the liquid, and the liquid is then boiled off inside the evaporator as it absorbs heat from the environment surrounding the evaporator (as it flows through the evaporator). The evaporator is typically another serpentine conduit connected to an array of fins. Air is forced over this exchanger. Heat is transferred from the air to the gaseous refrigerant, which cools the air. The cooled air is then circulated throughout the dwelling.

In a residential HVAC system, the refrigerant is said to be the "primary fluid" and the circulating air is said to be the "secondary fluid." This arrangement works reasonably well for structures of moderate size. However, when considering larger structures, the use of air as a secondary fluid becomes inefficient. An HVAC system for a skyscraper, for example, may need to circulate the secondary fluid over 1,000 feet. The frictional losses using air over such a distance are substantial. Further, the heat carrying capacity of air is limited by its relatively low density. For these reasons, commercial HVAC systems typically use water as the secondary fluid.

In a commercial HVAC system used in the air conditioning mode, the evaporator exchanges heat between the circulating refrigerant (primary fluid) and circulating water (secondary fluid). This type of heat exchanger is often referred to as a "chiller." The chilled water is then pumped throughout the building. At various locations the chilled water is passed through a water-to-air heat exchanger where it absorbs heat and cools the air. The cooled air is then circulated in a particular region to cool the building. Such a system has a large volume of circulating cooled water which can be used selectively to cool portions of the building where it is needed.

Heat exchangers typically used for the chiller (evaporator) function are the shell and tube type, the direct expansion brazed plate type, the flooded shell and tube type, the flooded brazed plate type, the falling film type, and the flooded shell and plate type. Heat exchangers typically used for the condenser function include the shell and tube type, the fin and tube type, the brazed plate type, the evaporative assisted type, and the direct evaporation cooled type.

In larger more efficient systems the flooded shell and tube evaporators have been the best choice for many years. However, in more recent times, the falling film shell and tube type has entered the market. In both the flooded and falling film types of heat exchanger, a serpentine conductive pipe runs through a surrounding shell. The refrigerant is passed through the shell while water is passed through the interior of the conductive pipe. The serpentine pipe is typically made of copper. Heat transfer is increased by creating a rough surface on the pipe's exterior (such as by knurling, peening, etc.) and rifling the pipe's interior to create rotational turbulent flow in the water.

In the flooded type the copper tubes are completely submerged in a tank of boiling liquid refrigerant and the heat transfer is enhanced over what would be achieved using plain copper pipe by increasing the outer surface area of the copper pipe using specially designed knurling. Although the flooded type produces very efficient heat transfer, it does have drawbacks. The main drawback is the excessive amount of liquid refrigerant required to completely submerge the copper tubes (an excessive "gas charge"). The HVAC industry is now under pressure to reduce the gas charge in systems owing to expense and the potential for environmental contamination.

The "falling film" approach differs significantly from the flooded tube exchanger. It still employs a shell enclosing a serpentine path of conductive piping (which contains the secondary fluid). However, instead of flooding the shell with boiling refrigerant, the refrigerant is sprayed or otherwise deposited onto the outer surface of the piping. This produces a thin film of refrigerant, which rapidly evaporates. This film cascades downward under the influence of gravity. Hence the name "falling film." The surfaces of the heat exchanger must typically be carefully designed in order to completely cover the appropriate surfaces with the falling film and to properly direct its downward flow. Those skilled in the art will appreciate the fact that the falling film approach—if properly designed—can use substantially less refrigerant.

Both the flooded and falling film types are shell and tube heat exchangers. Vaporized refrigerant is drawn out of the top of the shell, while liquid refrigerant tends to collect in the bottom (either as a pool of boiling liquid in the case of the flooded type or a cascade of film flow in the falling film type). The tendency of the liquid refrigerant to collect in the bottom of the shell means that the oil circulating in the system also tends to become trapped there. This can cause continual oil shortage problems at the compressor unless special oil recovery devices are added to the design of the heat exchanger. The entrapped oil decreases the efficiency of the heat exchanger and—of course—potentially starves the compressor of lubrication. One of the main causes of compressor failure in refrigeration systems is inadequate oil return. Significant engineering effort goes into avoiding oil starvation.

An oil free compressor has been developed. This device is described in detail in U.S. Pat. No. 5,857,348 to Conry. This development does eliminate the oil accumulation problem associated with flooded shell-and-tube heat exchangers. However, as discussed earlier, another known shortcoming of such heat exchangers is the requirement of a relatively large mass of circulating refrigerant. A large mass of refrigerant is required (a large "gas charge") to fully cover all the tubes in a shell-and-tube type exchanger. Such heat exchangers are not very space efficient. Most include a large volume of open space within the shell surrounding a small volume within the tubes. Thus, in order to completely cover the tubes with refrigerant, a relatively large mass of refrigerant is required.

Global warming and other environmental concerns disfavor the use of large gas charges. An HVAC system having a minimal gas charge is preferable. One way of minimizing the required gas charge is the use of a modified plate type heat exchanger incorporating the falling film approach. This type of exchanger can be much more space efficient. The present invention proposes just such a heat exchanger, in which the heat transfer across the plates is greatly increased by modifying the surface texture of the primary fluid side of each plate and applying a thin film of refrigerant to the modified surface.

BRIEF SUMMARY OF THE PRESENT INVENTION

The present invention comprises a plate type heat exchanger in which the refrigerant is deposited as a falling film. The heat exchanger includes a pressure vessel (a "shell") surrounding an encapsulated stack of plates. Each plate has a primary fluid side and a secondary fluid side. The primary fluid will be a refrigerant—such as R-134a. The secondary fluid will typically be water. As for most plate type heat exchangers, the stack of plates actually comprises opposing pairs. All the plates are sealed together. This construction produces alternating cavities of primary fluid and secondary fluid. Unlike conventional plate type heat exchangers, however, the cavities containing the primary fluid are open to the surrounding volume within the pressure vessel. The refrigerant is applied to the primary sides of the plates as a falling film, typically by wetting the upper portions of the plates and allowing the resulting fluid film to flow downward under gravity's influence (A more distributed spray pattern may also be used). Because the cavities containing the primary fluid are open, the evaporated gaseous refrigerant rises to the top of the shell where it is drawn off and fed to the suction side of the compressor (either directly or after passing through other components). Unevaporated refrigerant cascades downward as a thin film, ultimately collecting in the bottom of the shell (although a well-designed heat exchanger will minimize the amount of liquid refrigerant which ultimately collects).

The use of the falling film to wet the primary surface of the plates—as opposed to immersing the plates in a mass of boiling refrigerant—substantially reduces the gas charge required.

The heat exchange rate between a thin film of volume of refrigerant on one side of a simple plate and a secondary fluid on the other side of the plate is preferably enhanced using surface treatments on the primary fluid side. These treatments greatly increase the effective surface area on the primary fluid side. The secondary fluid side is left relatively smooth in order to allow for fast and turbulent flow.

REFERENCE NUMERALS IN THE DRAWINGS

Figure 1:
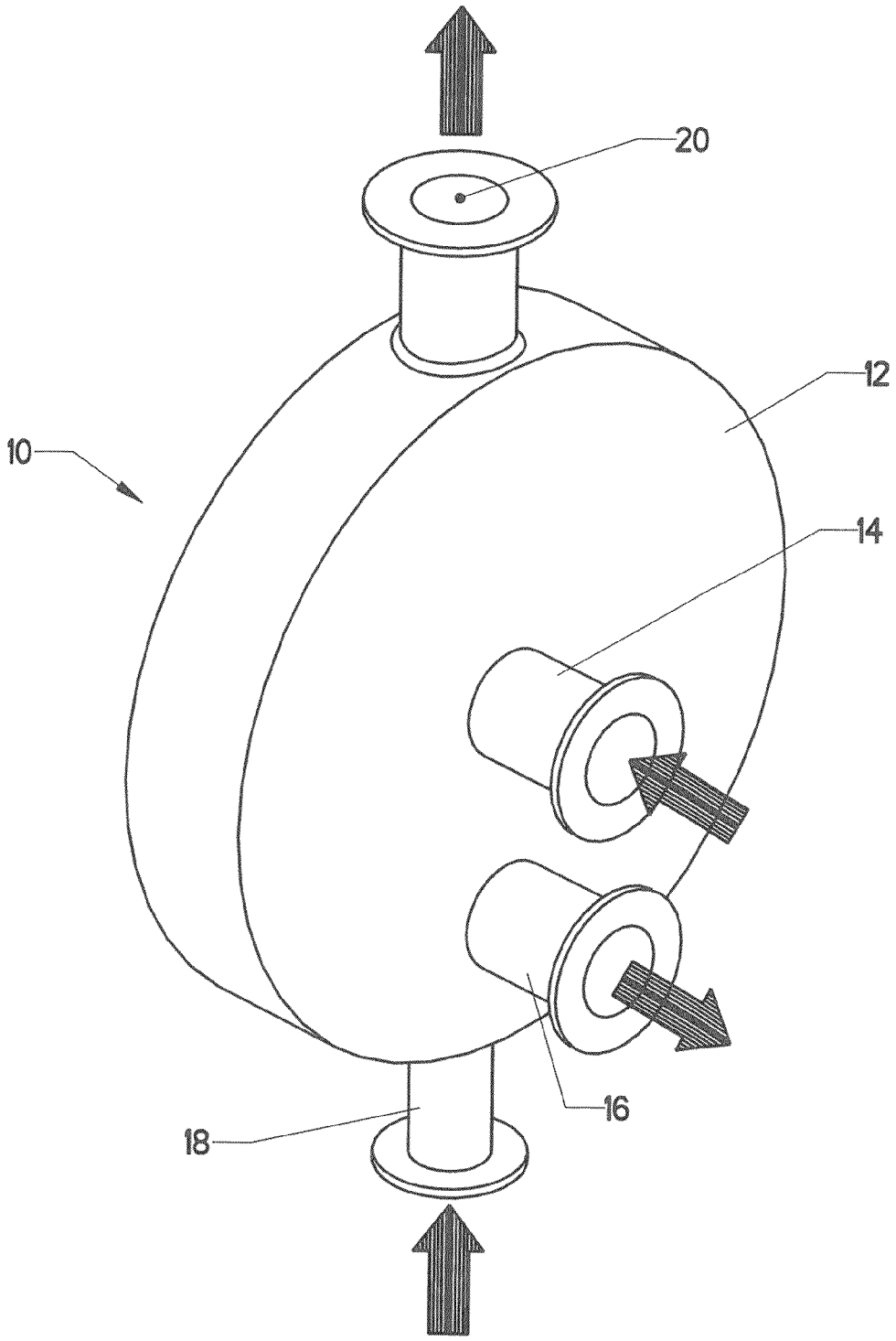
FIG. 1 is a perspective view, showing the present invention.

| | | | |
|---|---|---|---|
| 10 | heat exchanger | 12 | pressure vessel |
| 14 | secondary fluid inlet | 16 | secondary fluid outlet |
| 18 | primary fluid inlet | 20 | primary fluid outlet |
| 22 | plate | 24 | inlet hole |
| 26 | outlet hole | 30 | primary fluid side |
| 32 | baffle | 34 | side perimeter |
| 36 | upper perimeter | 38 | lower perimeter |
| 42 | secondary fluid side | 44 | secondary fluid manifold |

-continued

REFERENCE NUMERALS IN THE DRAWINGS

| | | | |
|---|---|---|---|
| 50 | sealing surface | 52 | round standoff (female side) |
| 54 | embossed channel (female side) | | |
| 56 | corner standoff | 58 | sealing surface |
| 60 | round standoff (males side) | 62 | embossed channel (male side) |
| 64 | plate pair | 66 | cassette |
| 68 | flow channel | 72 | secondary fluid path |
| 74 | liquid surface level | 76 | liquid primary fluid |
| 78 | vaporized primary fluid | 80 | liquid eliminator |
| 82 | dry vapor | 84 | dry vapor outlet |
| 86 | secondary heat exchanger | 88 | compressor |
| 90 | de-super heater | 92 | condenser |
| 94 | sub-cooler | 96 | heat exchanger surface |
| 98 | gas bubbles | 100 | deposited copper |
| 102 | lattice | 104 | open cell lattice |
| 106 | rib | 108 | dendrite |
| 110 | heated plate | 112 | water |
| 114 | untreated surface | 116 | enhanced surface |
| 118 | secondary fluid flow channel | 120 | primary fluid bath |
| 122 | primary fluid manifold | 124 | spray manifold |
| 126 | spray nozzle | 128 | spray plate |
| 130 | primary fluid inlet | 132 | inlet runner |
| 134 | primary fluid manifold | 136 | orifice |
| 138 | liquid primary fluid side | 140 | evaporating primary fluid side |
| 142 | liquid primary fluid | 144 | spray jet |
| 146 | spray plate pair | 148 | assembled falling film stack |
| 150 | end plate | 152 | combination plate |
| 154 | mating surface | 156 | spray slot |
| 158 | spray pattern | 160 | male coupler |
| 162 | female coupler | 164 | combination plate pair |
| 166 | O-ring | | |

DETAILED DESCRIPTION OF THE INVENTION

A plate-type heat exchanger transfers heat from a secondary fluid to a primary fluid across a plate which separates the two. It is preferable to completely cover the primary fluid side of the plate with refrigerant. As discussed previously, this can be done in two ways. The first way is to flood the primary side of the plate with a "bath" of boiling refrigerant. The second way is to apply a thin "falling film" of refrigerant to the primary fluid side. The two methods can be practiced using many of the same heat exchanger components. However, they will be discussed in separate sections in order to prevent confusion. The flooded type is discussed first and the falling film type is discussed second.

1. Flooded Type Heat Exchanger

FIG. 1 shows a simplified version of a plate-type heat exchanger. Heat exchanger 10 includes many components enclosed within pressure vessel 12. The heat exchanger is configured to transfer heat between a primary fluid and a secondary fluid. The primary fluid (refrigerant) comes in through primary fluid inlet 18 and leaves through primary fluid outlet 20. The secondary fluid enters through secondary fluid inlet 14 and leaves through secondary fluid outlet 16. Suitable flanges or other types of connecting hardware are preferably provided for connection to external piping. This exchanger is intended for use as a chiller in an HVAC system. Thus the primary fluid (refrigerant) enters as a liquid, boils inside the exchanger, and leaves primary fluid outlet 20 as a gas (though some liquid component may remain). The secondary fluid (Water) enters as a liquid and leaves as a (much cooler) liquid.

Figure 1B:
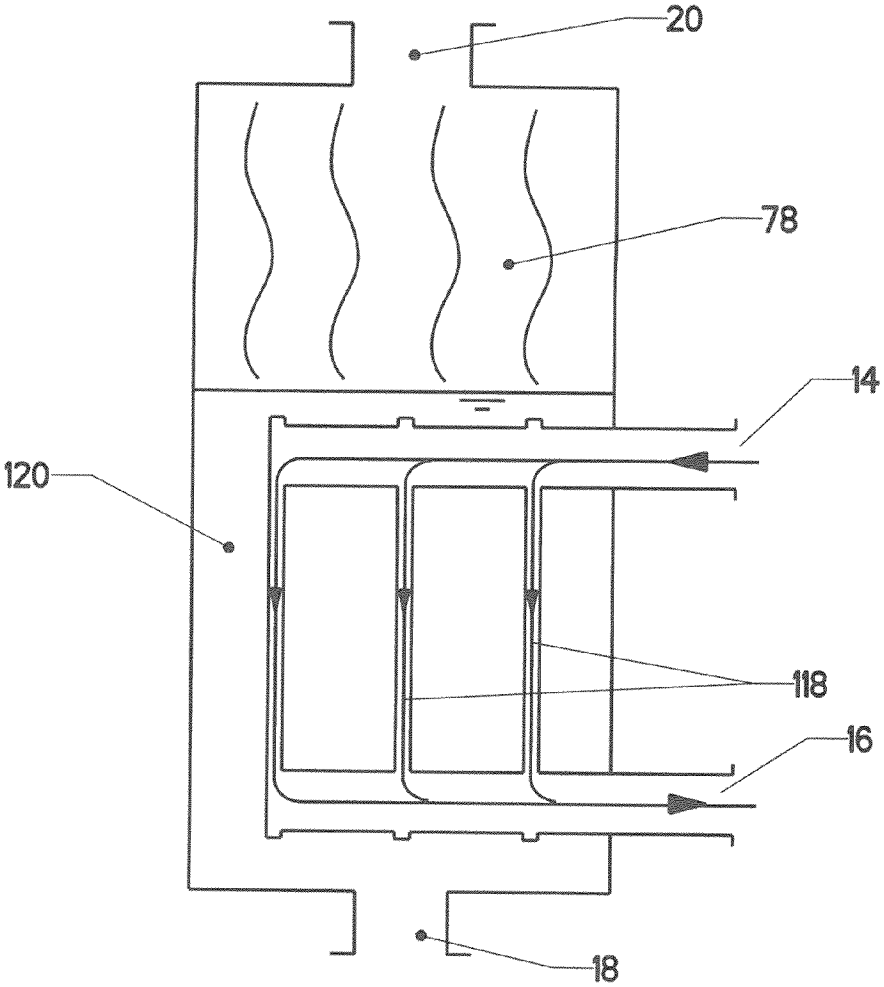
FIG. 1B is a schematic view, showing a simplified depiction of flow through a shell-type heat exchanger.

FIG. 1B schematically illustrates the flow occurring within the heat exchanger. This view is intended to give the reader a general understanding prior to presenting the specific structures used to create the flow. Thus, the reader should hear in mind that the structures shown in FIG. 1B are unrealistically simple and are useful only for illustrative purposes.

In FIG. 1B, the primary fluid (refrigerant) flows into pressure vessel 12 through primary fluid inlet 18. The heat exchanger is intended to transfer heat from the secondary fluid to the primary fluid, thereby vaporizing the primary fluid and cooling the secondary fluid. Primary fluid bath 120 is maintained in a boiling state, with the liquid surface approximately as shown. As the primary fluid boils, it transitions to vaporized primary fluid 78 and leaves the exchanger through primary fluid outlet 20.

The heat transfer required to boil the primary fluid is supplied by circulating secondary fluid. The secondary fluid (water) is pumped in through secondary fluid inlet 14. It then flows down between pairs of plates within the heat exchanger through secondary fluid flow channels 118 (The secondary fluid flow channels are bounded by mated pairs of plates). The secondary fluid then exits through secondary fluid outlet 16. The reader will note that the secondary fluid flows primarily downward while the primary fluid flows primarily upward. This counterflow increases the heat exchange rate between the two fluids.

It is preferable to place the secondary fluid flow channels in a substantially vertical orientation. The term "substantially vertical is intended to encompass embodiments in which the pair of plates bounding the secondary fluid flow channels are within about 30 degrees of the vertical.

Figure 2:
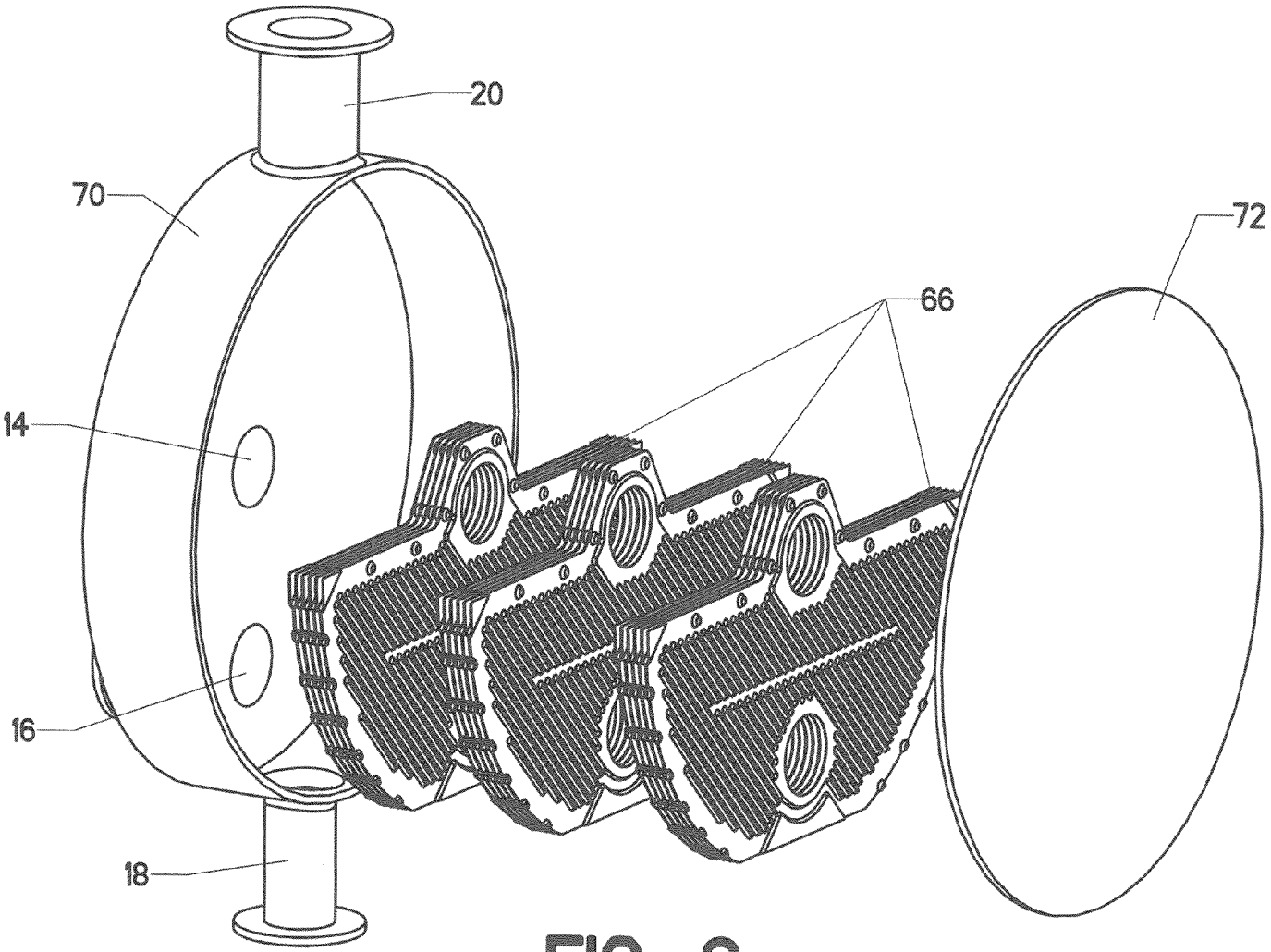
FIG. 2 is an exploded perspective view, showing some internal details of the present invention.

FIG. 2 shows a more realistic depiction of the heat exchanger's internal components. As for most plate-type heat exchangers, the device includes a stack of plates which are bonded together. The bonding may assume any suitable form. As one example, the metal plates may be made of a thin metal such as stainless steel and may be brazed together using another material such as copper. They could also be glued together or simply clamped together with sufficient force to maintain a good seal. All these techniques are known in the art of heat exchangers. The structure shown in FIG. 2 should therefore properly be viewed as exemplary, with the understanding that the invention could be carried out in other ways.

Pressure vessel 12 is a hollow structure configured to receive a stack of plates. The stack may be assembled all at once or may by assembled from a plurality of smaller "sub-stacks." Such "sub-stacks" are often known as "cassettes." Three such cassettes 66 are shown in FIG. 2. The cassettes are stacked into the heat exchanger body. All the plates have inlet and outlet holes. The inlet holes align with secondary fluid inlet 14 while the outlet holes align with secondary fluid outlet 16. The primary fluid actually passes through the cassettes from bottom to top, as will be explained subsequently. End plate 150 seals the open end of the pressure vessel and clamps the assembly together.

An actual heat exchanger would likely be much deeper and contain many more plates (many hundreds more, in some applications). However, such a structure is just a repetition of the "shallow" version shown. Thus, the simplified version shown serves ably to illustrate the invention's principles.

Figure 3:
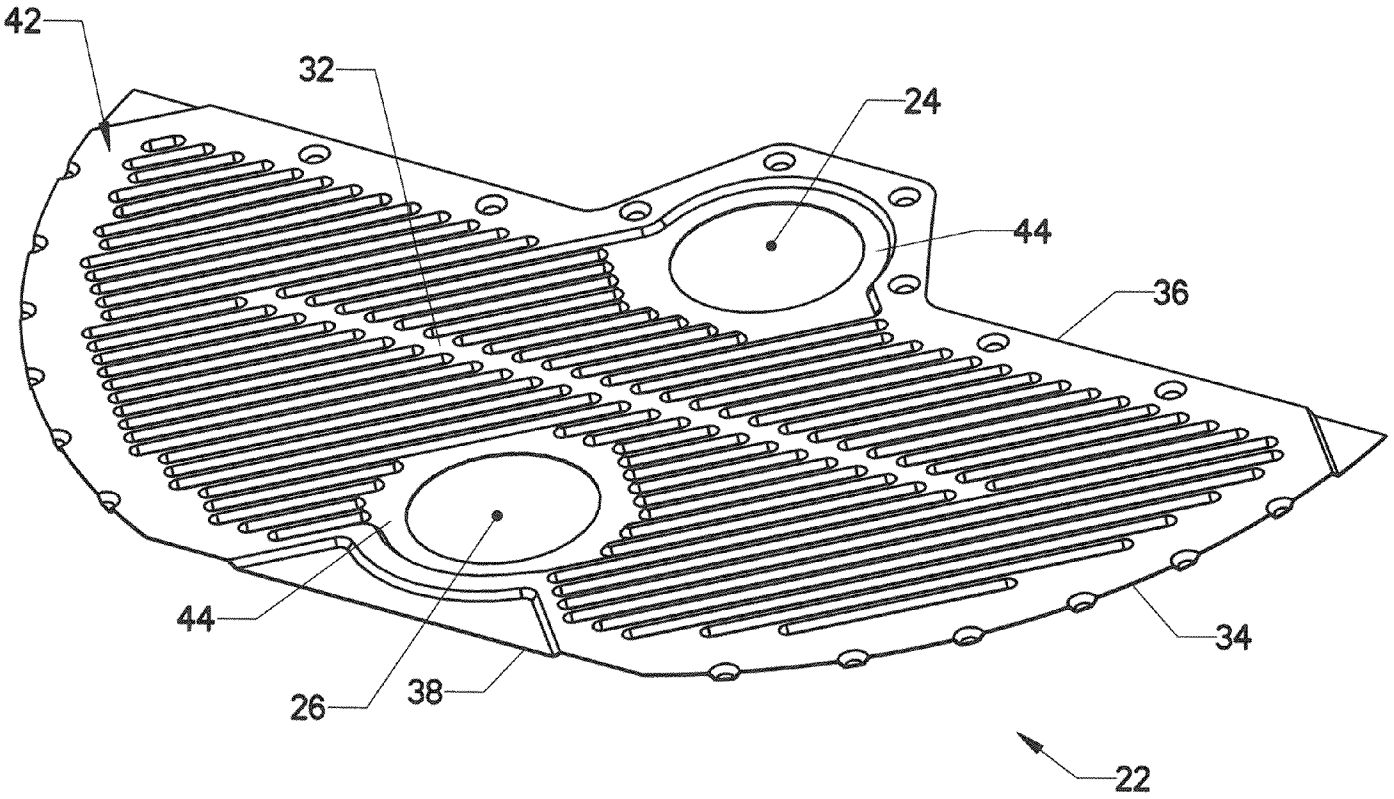
FIG. 3 is a perspective view, showing the secondary fluid side of a plate.

The nature of the plates used to create the cassettes is significant to the present invention. Preferably, only one type of plate is used. FIG. 3 shows plate 22, which of course has two sides. The side shown is secondary fluid side 42. The secondary fluid (typically water) flows over this side of the plate. Inlet hole 24 allows secondary fluid to enter secondary fluid manifold 44 and flow across the face of the plate. The channels on the plate—which will be described in more detail subsequently—force the secondary fluid to flow in a circuitous path around baffle 32 and ultimately pass out through outlet hole 26. The plate is shaped to conform to the interior of the pressure vessel. The two side perimeters 34 assume an arcuate shape in order to conform to the cylindrical wall of the pressure vessel. Lower perimeter 38 sits above the bottom of the pressure vessel in order to allow the free circulation of the primary fluid beneath the plates. Upper perimeter 36 is shaped to lie horizontally approximately across the middle of the pressure vessel.

Figure 4:
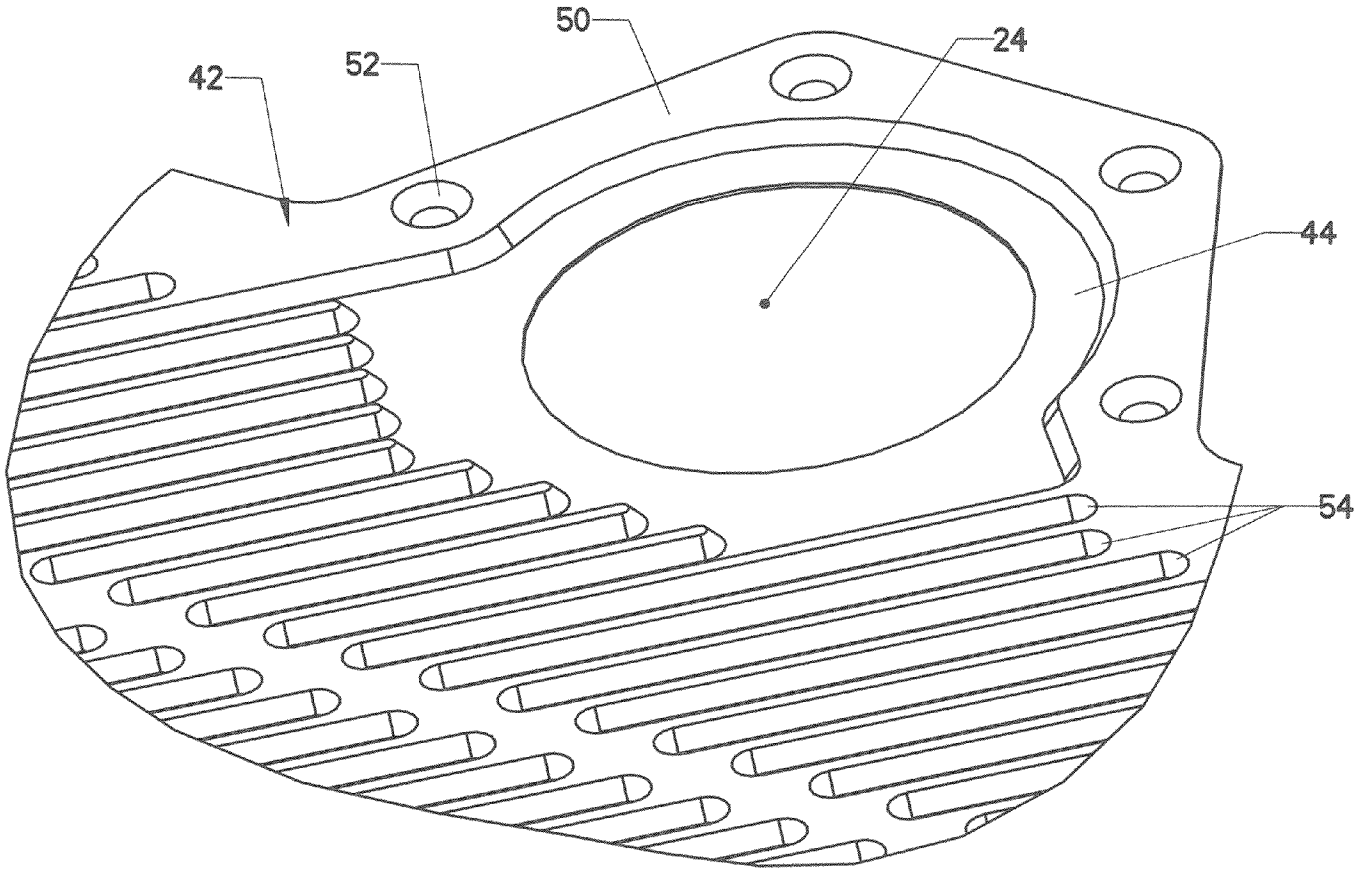
FIG. 4 is a detailed view, showing portions of the plate of FIG. 3.

The reader will note that the side of the plate facing the viewer in FIG. 3 opens into a series of linear channels. These are shown in more detail in FIG. 4, which is an enlargement of the area around inlet hole 24 in FIG. 3. The plate is preferably made of a thin metal such as stainless steel (stainless steel plates may be conveniently brazed together using a brazing material such as copper). The channels—as well as the other features—may be easily stamped or pressed into the surface of the thin metal. Water coming in through inlet hole 24 and collecting in secondary fluid manifold 44 passes out through embossed channels (female side) 54. The embossed channels appear as depressions when the plate is viewed from secondary fluid side 42. Thus, they are known as the female side of the embossed channels. There is of course a corresponding male side to each embossed channel on the opposite side of the plate.

Other features are included as well. In a plate type heat exchanger is it important to seal each plate to its neighbor and to provide the appropriate spacing between neighboring plates. Sealing surface 50 provides a broad and flat surface area which can be brazed, glued, or welded to a corresponding sealing surface on a neighboring plate. Round standoffs 52 help maintain the appropriate spacing between plates. As for the embossed channels, each round standoff has a female side and a male side. The female side is shown in the view.

Figure 5:
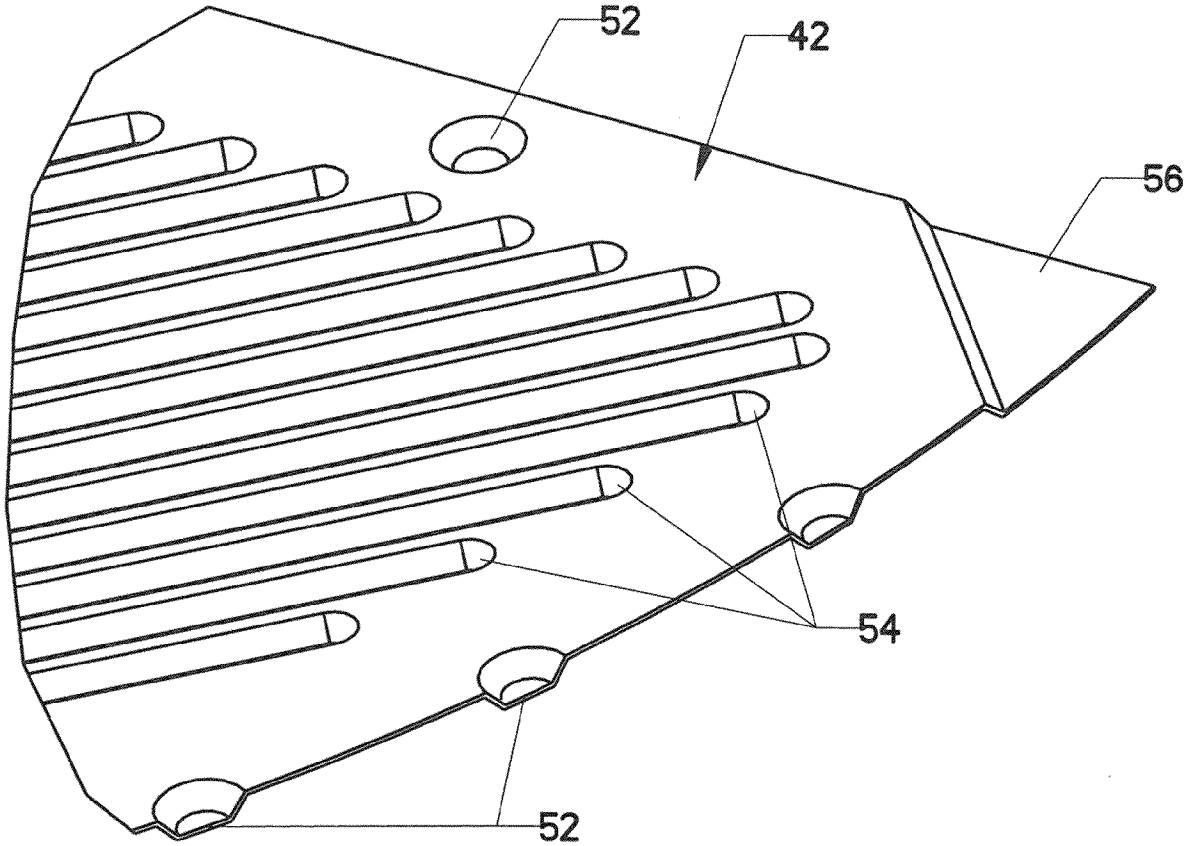
FIG. 5 is a detailed view, showing portions of the plate of FIG. 3.

FIG. 5 shows another detailed view of the plate shown in FIG. 3, this time focusing on the upper right corner. The reader will observe how each embossed channel 54 ends near the plate's perimeter. Corner standoff 56 is provided to properly space the corner of the plate shown from the corners of the adjoining plates.

Figure 6:
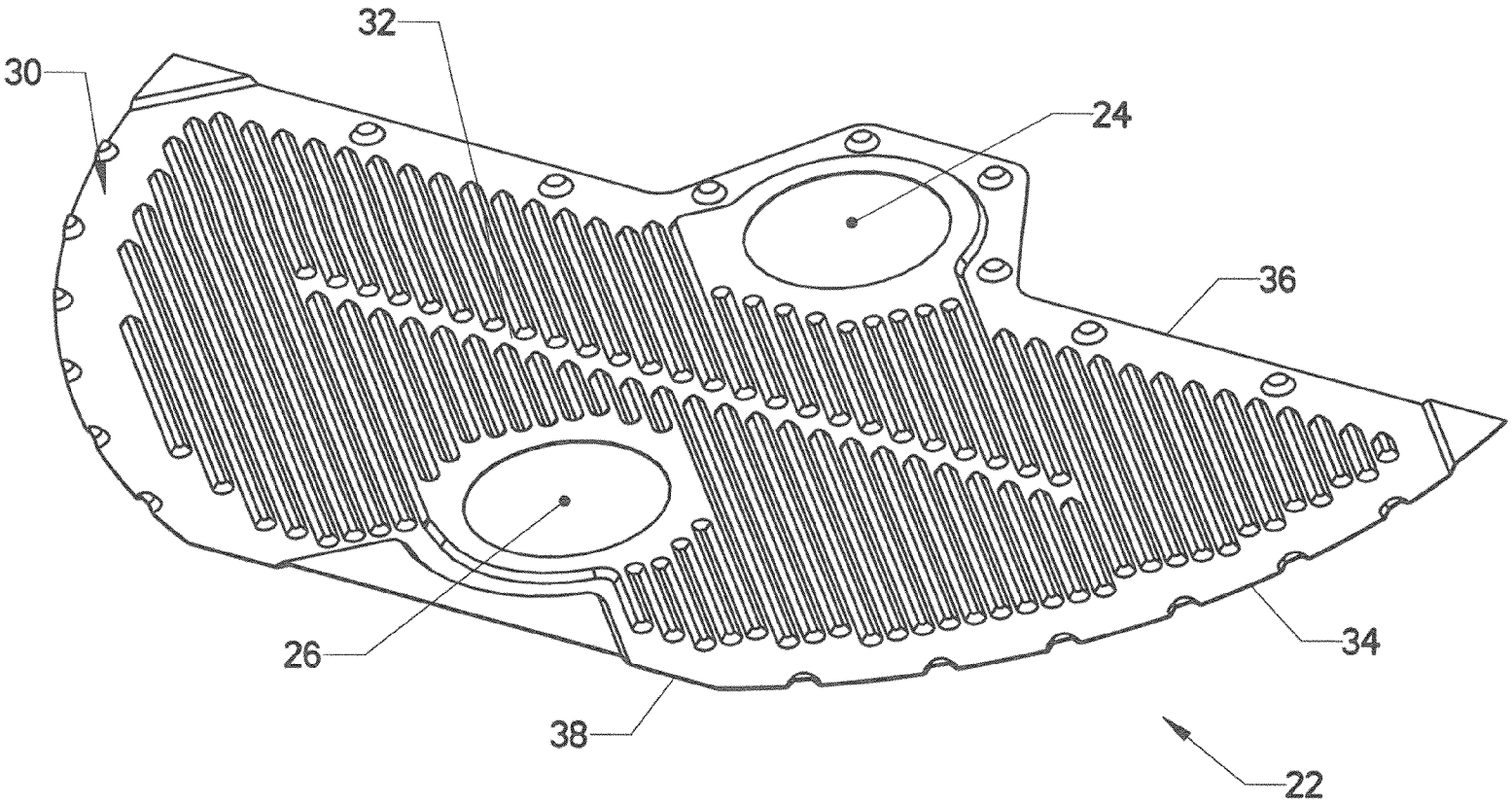
FIG. 6 is a perspective view, showing the primary fluid side of a plate.

FIG. 6 shows the same plate flipped over to reveal the opposite side, which is denoted as primary fluid side 30. The primary fluid (such as R-134a) flows over this side of the plate. The plates are designed to be assembled in alternating orientations. As an example, if the first plate has the primary fluid side facing the rear of the pressure vessel, then the next plate will have the primary fluid side facing the front of the pressure vessel, the third plate will have the primary fluid side facing the rear of the vessel, and so on. Thus, the plates preferably have sealing surfaces which allow a particular side of the plate to be joined to the opposite side of its neighbor.

The male side of each embossed channel is clearly visible in FIG. 6. The reader will note that baffle 32 is visible on the primary fluid side. However, on the primary fluid side, the baffle is actually a void and it does not obstruct flow. Thus, the primary fluid flows across the plate from the direction of lower perimeter 38 to upper perimeter 36. It flows around the sealed surfaces surrounding outlet hole 26 and inlet hole 24.

Figure 7:
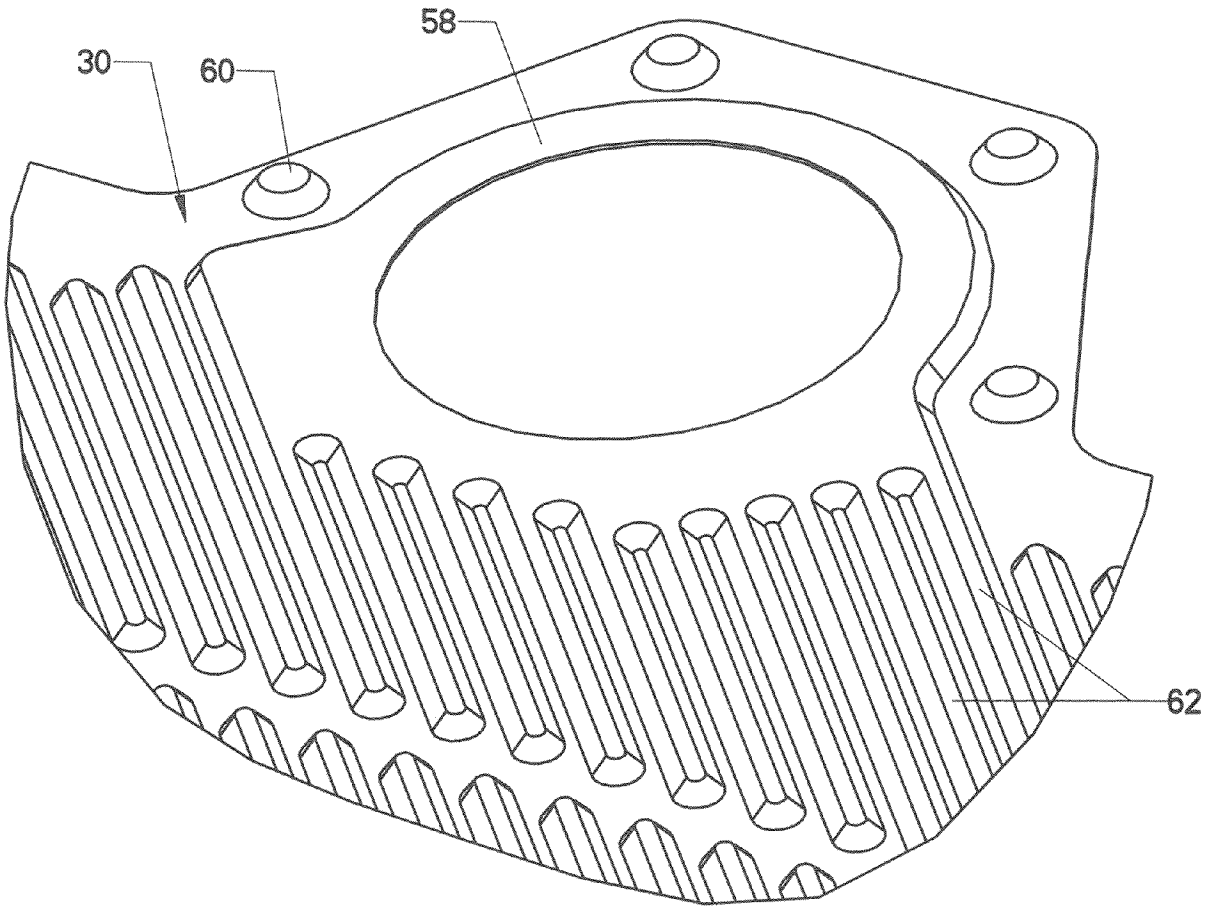
FIG. 7 is a detailed view, showing portions of the plate of FIG. 6.

FIG. 7 shows a more detailed view of the upper portion of primary fluid side 30. The reader may readily see the nature of each embossed channel (male side) 62. Sealing surface 58 surrounds inlet hole 24. This sealing surface may be readily attached to the same sealing surface of an adjoining plate (which will be facing the opposite direction). Round standoffs (male side) 60 properly space the plate shown apart from its neighbors. These standoffs 60 also act as strengtheners for the heat exchanger when a stack of plates are brazed or otherwise joined together.

Figure 8:
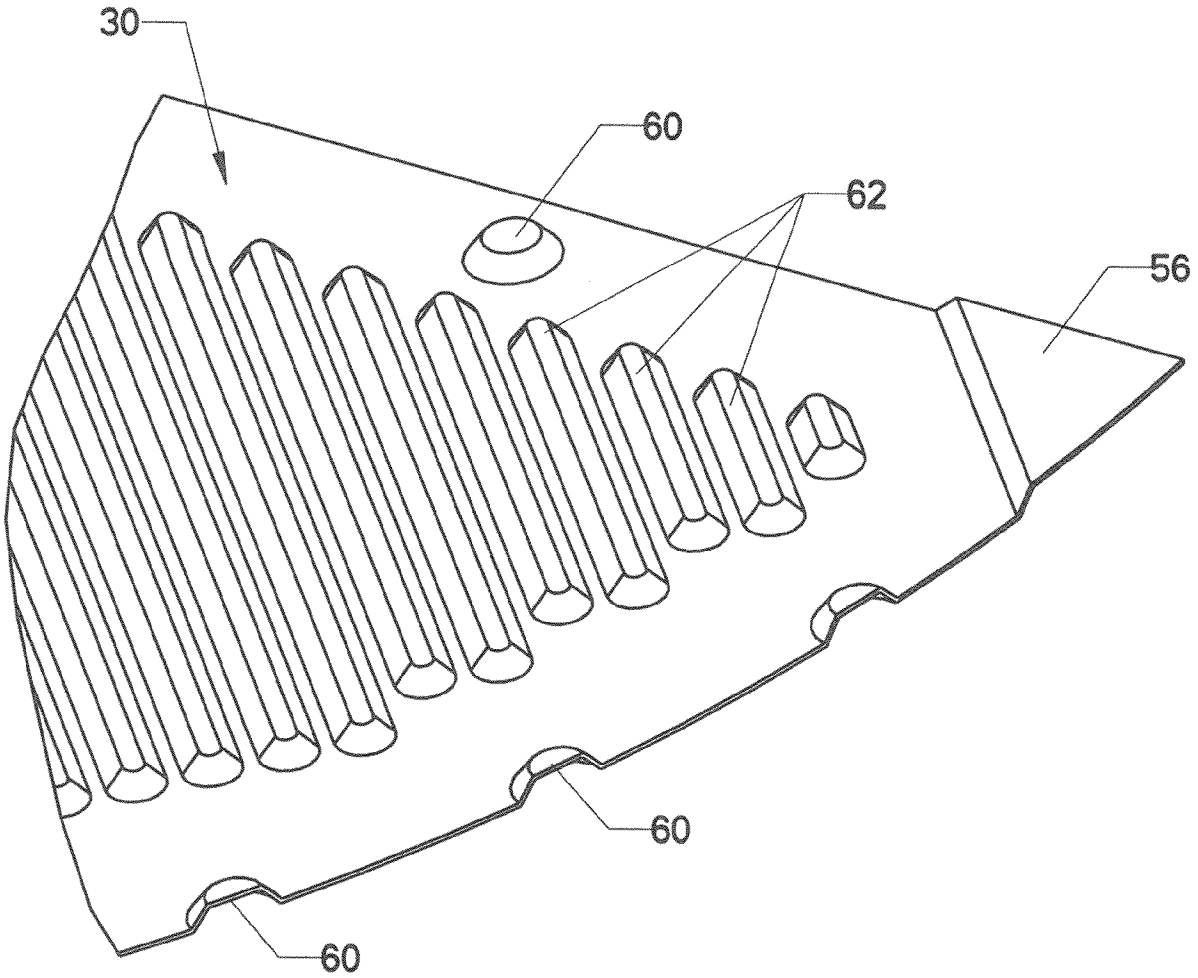
FIG. 8 is a detailed view, showing portions of the plate of FIG. 6.

FIG. 8 shows the upper right corner of primary fluid side 30. Embossed channels (male side) 60 terminate near the plate's perimeter. Some round standoffs may be cut by the arcuate edge so that they lie against the cylindrical wall of the pressure vessel. Corner standoff 56 is of course offset in the opposite direction from the orientation shown in FIG. 5.

Figure 9:
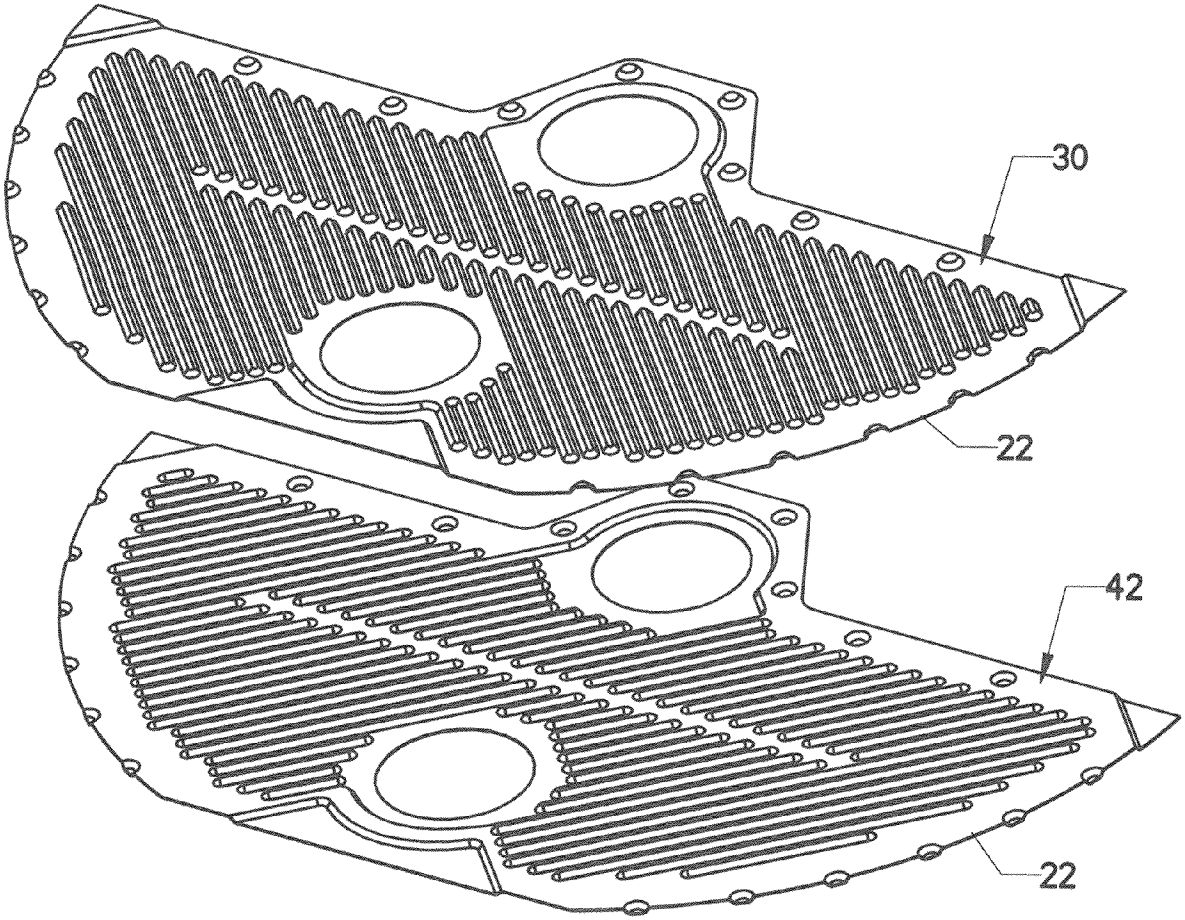
FIG. 9 is a perspective view, showing a pair of plates prior to assembly.

FIG. 9 shows two plates 22 in position for assembly. In the upper plate primary fluid side 30 faces the viewer, whereas in the lower plate secondary fluid side 42 faces the viewer. The plates are identical; they just face in opposite directions. The reader will observe how the surfaces around the perimeter and around the inlet and outlet holes for the secondary fluid can be pressed together. An adhesive, a brazing metal, or other suitable joining substance, can be used to join these two surfaces.

Figure 10:
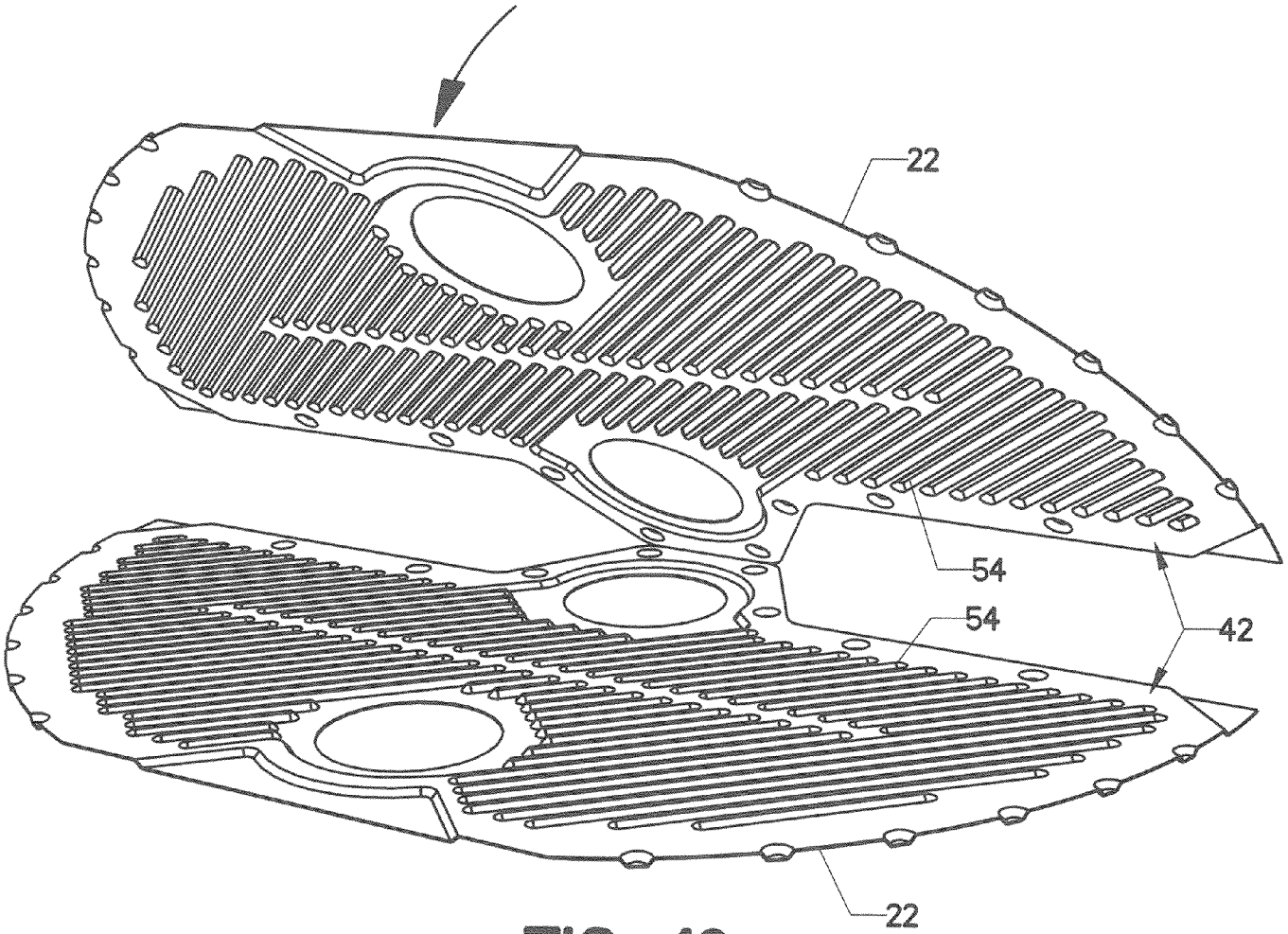
FIG. 10 is a perspective view, showing a pair of plates prior to assembly.

FIG. 10 shows the same two plate from a different perspective. The upper extreme of each of the two plates has been placed together to align the plates. The upper plate can then be attached to the lower plate by rotating the upper plate downward as indicated by the arrow. The secondary fluid side of each of the two plates is visible in the view. The reader will observe how the arrays of embossed channels (female side) 54 overlay in a criss-cross pattern. This feature ensures that water flowing through the channels will take a circuitous route. It will also tend to turn and mix violently. These features increase the amount of heat that can be transferred from the water to the primary fluid.

Figure 10B:
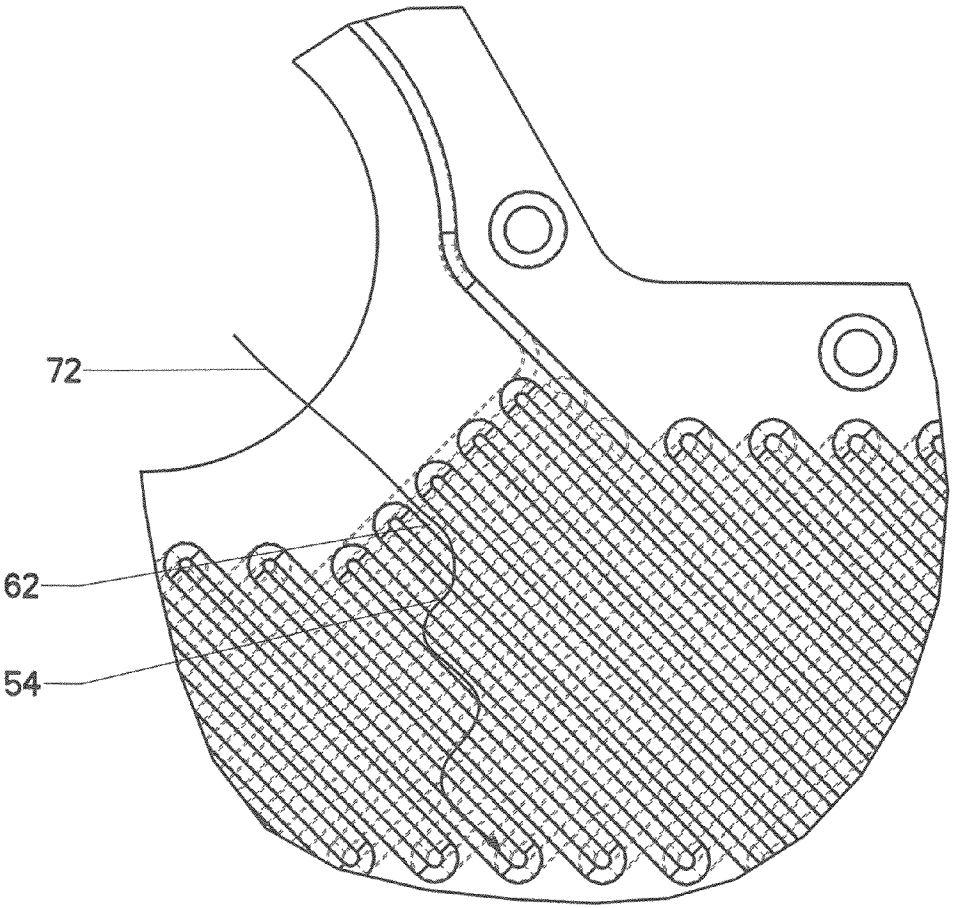
FIG. 10B is a plan view, showing a pair of assembled plates.

FIG. 10B is a detailed hidden line, plan view of the two plates of FIG. 10 mated together. The reader will observe how the embossed channels form a criss-crossed pattern. Secondary fluid path 72 works its way through the criss-cross pattern, thereby creating a turbulent, well-mixed flow. This works its way around the baffle and eventually out the outlet hole.

Figure 11:
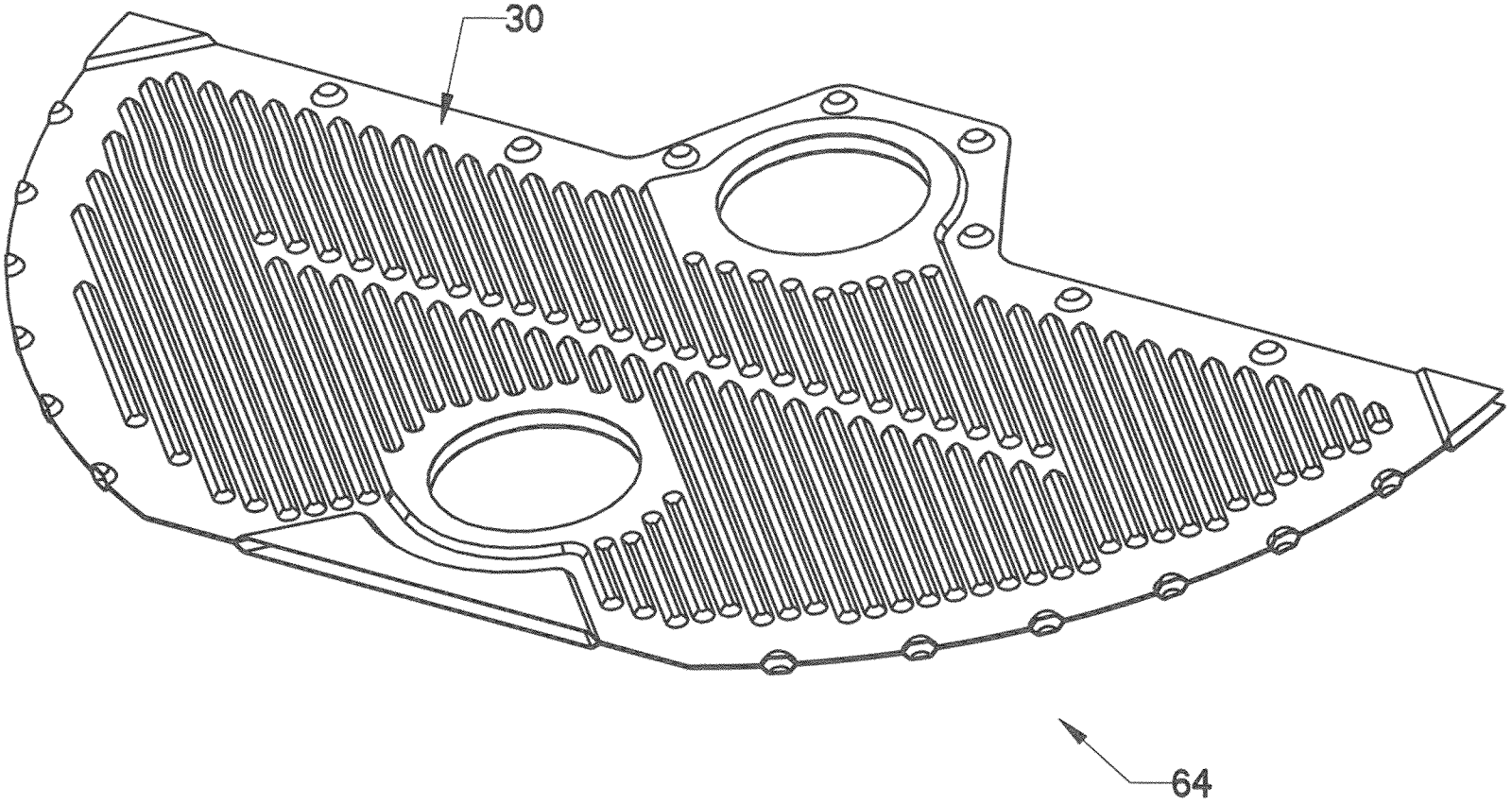
FIG. 11 is a perspective view, showing a pair of assembled plates with the primary fluid side facing outward.

FIG. 11 shows a pair of plates assembled with their secondary fluid sides facing each other and mated together. This is denoted as plate pair 64. The reader will observe how the circular standoffs and corner standoffs combine to create a series of spacers which can then space the plate pair shown an appropriate distance from the next plate pair. Primary fluid side 30 faces the viewer. The secondary fluid flows between the two plates shown (feeding in through the inlet hole, flowing down and around the baffle, and then out through the outlet hole). Under the scheme of altering the orientation of each successive plate, the next plate joined to the upper side of plate pair 64 would have its primary fluid side facing the primary fluid side of the upper plate shown in the view. This would then create a cavity through which the primary fluid would flow.

FIG. 11 provides a good opportunity to discuss how the invention would likely be assembled in practice. One significant feature of the proposed invention is a differing surface condition on the primary fluid side of a plate versus the secondary fluid side. As mentioned previously, the primary fluid side has an enhanced surface treatment. This treatment (1) increases the surface area; (2) increases turbulence and mixing of the primary fluid flowing over the surface; and (3) decreases the flow rate of the primary fluid. The secondary fluid side is preferably smooth to promote high flow speeds of the secondary fluid. These objectives should reasonably be considered when contemplating how to manufacture the device.

Two plates can be brazed together by joining the secondary fluid side of a first plate to a secondary fluid side of a second plate. One common approach would be vacuum brazing stainless steel plates together using copper. Some sort of welding process could also be used. This creates a joined pair of plates as shown in FIG. 11. The reader will observe that the secondary fluid side of each plate is facing inward and is protected. It is therefore convenient to provide a surface treatment to the exposed outward-facing primary fluid sides. A treatment such as shot basting or chemical etching could then be applied to the outward facing surfaces (though the surfaces surrounding the secondary fluid inlet and outlet holes must obviously be protected).

After the plates of the plate pair such as shown in FIG. 11 are joined and then surface treated, the plate pairs can be joined to other plate pairs using any suitable process. Those skilled in the art will realize that when two plate pairs 64 are stacked together for joining, the joining of the surfaces around the secondary inlet and outlet holes is critical to the success of the device (otherwise there will be leakage between the primary and secondary fluids). One approach is to weld the edges of these surfaces together using a continuous bead. The offsets 52 and 56 may also be welded together. One could also elect to join the mating surfaces using a second brazing substance having a lower melting point than the one used to join the secondary fluid sides together.

Figure 12:
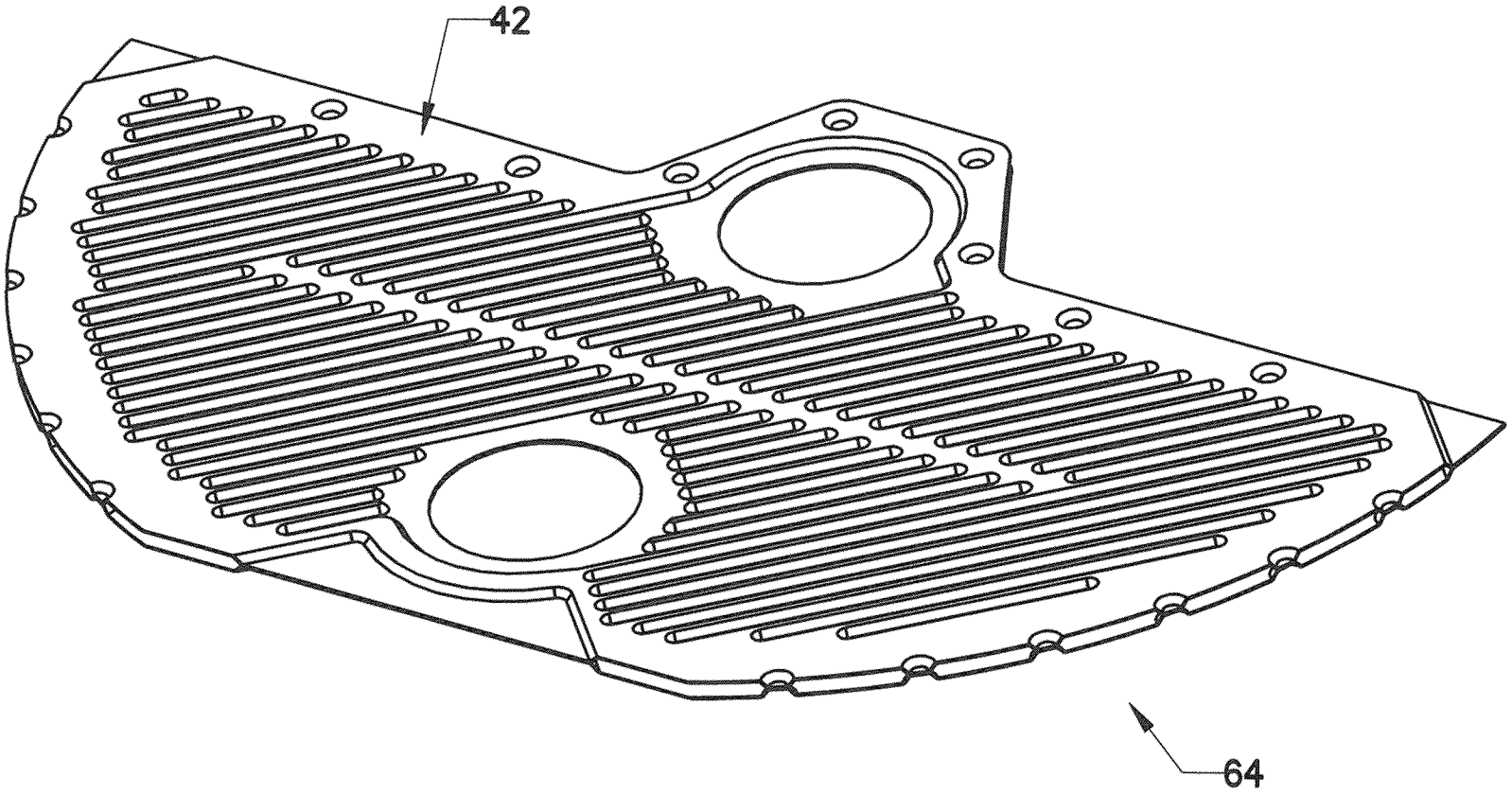
FIG. 12 is a perspective view, showing a pair of assembled plates with the secondary fluid side facing outward.

Of course, the invention should not be viewed as being limited to any of the approaches discussed in detail. One could begin with plate pairs made by joining the primary fluid sides together. FIG. 12 shows such a plate pair. In this approach the surface treatment would likely need to be applied to the primary fluid side prior to joining a plate pair together. The plate pair shown in FIG. 12 has been joined by mating the primary fluid side of each plate to the primary fluid side of its neighbor. Thus, secondary fluid side 42 is visible in the view. When the plate pair is placed into the heat exchanger, the primary fluid flows between the two plates shown. It actually enters the open portion of the lower perimeter and then flows up toward the open portion of the upper perimeter. Under the scheme of altering the orientation of each successive plate, the next plate joined to the upper side of plate pair 64 in FIG. 12 would have its secondary fluid side facing the secondary fluid side of the plate shown in the view. This would then create a cavity through which secondary fluid would flow.

The reader will thereby perceive that the addition of each successive plate to a stack creates a new cavity containing a fluid which is the opposite of the fluid contained in the immediately preceding cavity. In other words, the cavities created alternate between primary fluid, secondary fluid, primary fluid, and so on. The reader will also perceive that the invention preferably includes counterflow between the primary and secondary fluids. In other words, the primary fluid generally flows upward while the secondary fluid generally flows downward. This feature increases the heat exchange rate between the two fluids.

Figure 13:
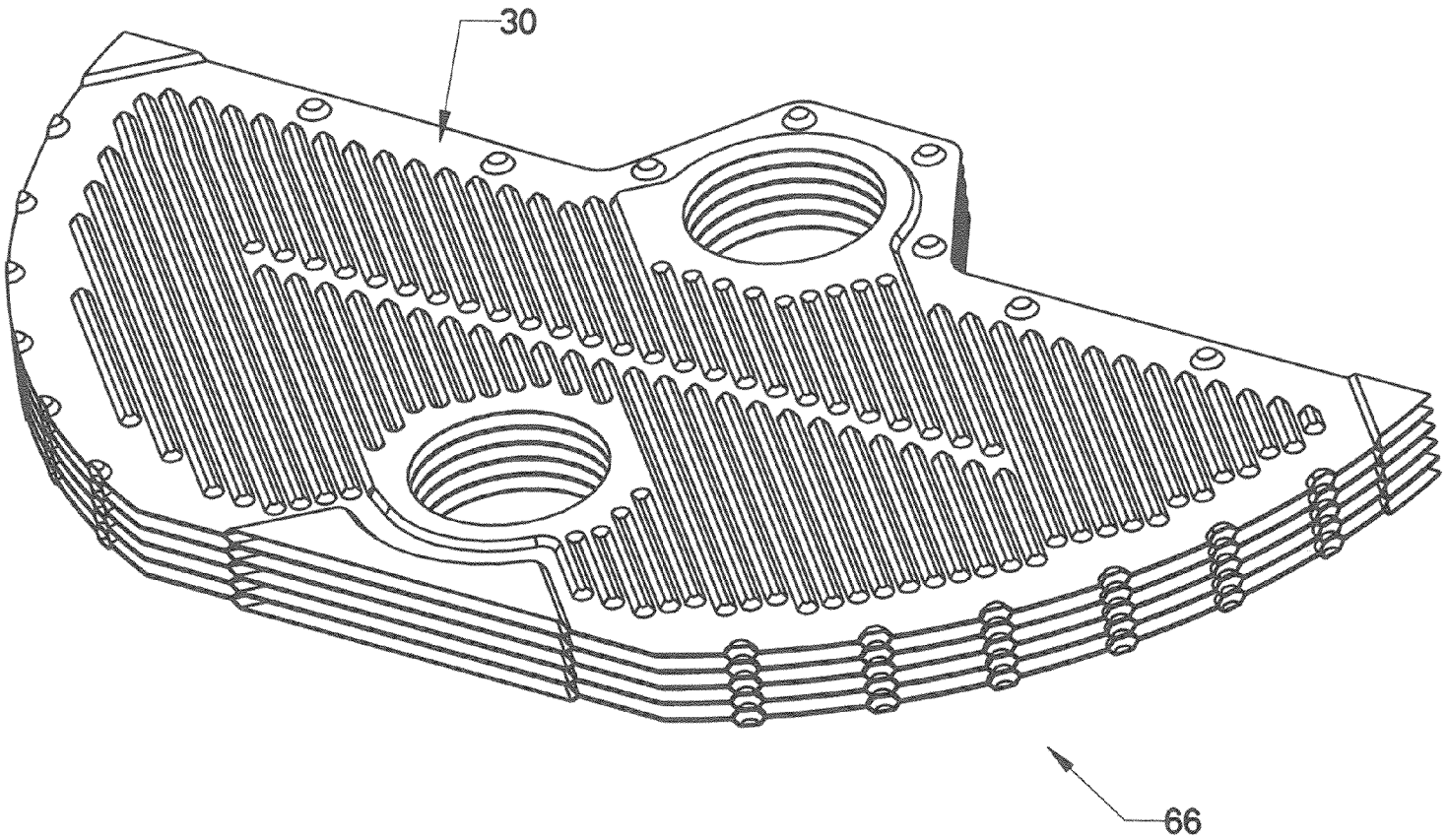
FIG. 13 is a perspective view, showing a stack of 10 assembled plates.

FIG. 13 shows cassette 66, which is made by stacking 10 plates together in alternating orientations. The number of plates included in a cassette is somewhat arbitrary. Adding more plates increases the heat exchange rate. A working heat exchanger based on these inventive principles might have 300 plates or more. A smaller number of plates has been illustrated for purposes of visual simplicity.

Figure 14:
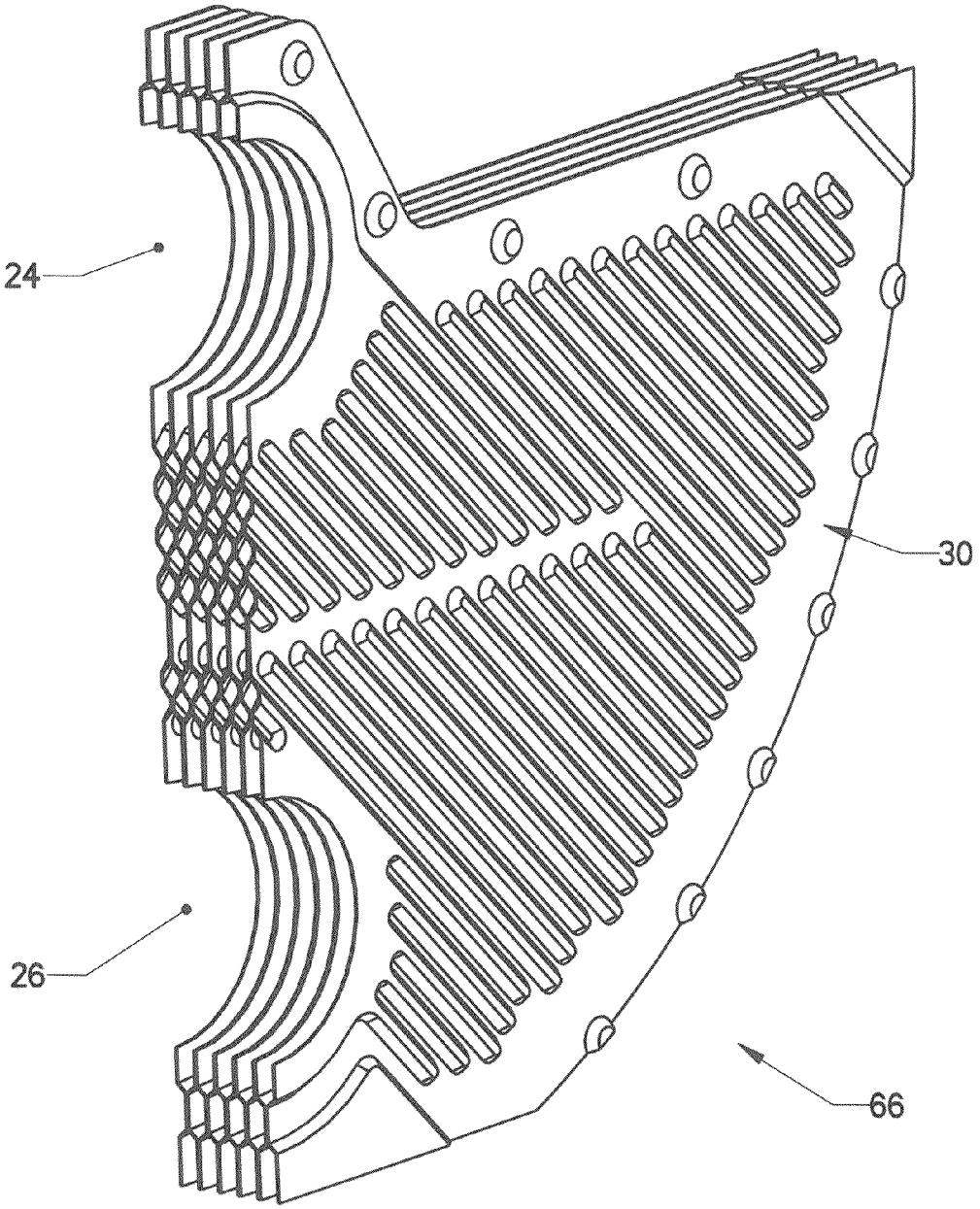
FIG. 14 is a sectioned perspective view, showing a stack of 10 assembled plates.

The cassette shown in FIG. 13 has primary fluid side 30 of the uppermost plate facing upwards. Nine enclosed cavities are created within the stack shown. This fact is not intuitively apparent from the view of FIG. 13, so some sectional views are helpful. FIG. 14 is a sectional view taken down the center of cassette 66. By studying the area around the secondary fluid inlet and outlet, the reader will observe the presence of five separated secondary fluid cavities (which may be thought of as five layers). The presence of the embossed channels makes the cavities somewhat difficult to visualize in a sectional view, since the channels create "diamond" patterns reminiscent of a honeycomb structure.

Figure 15:
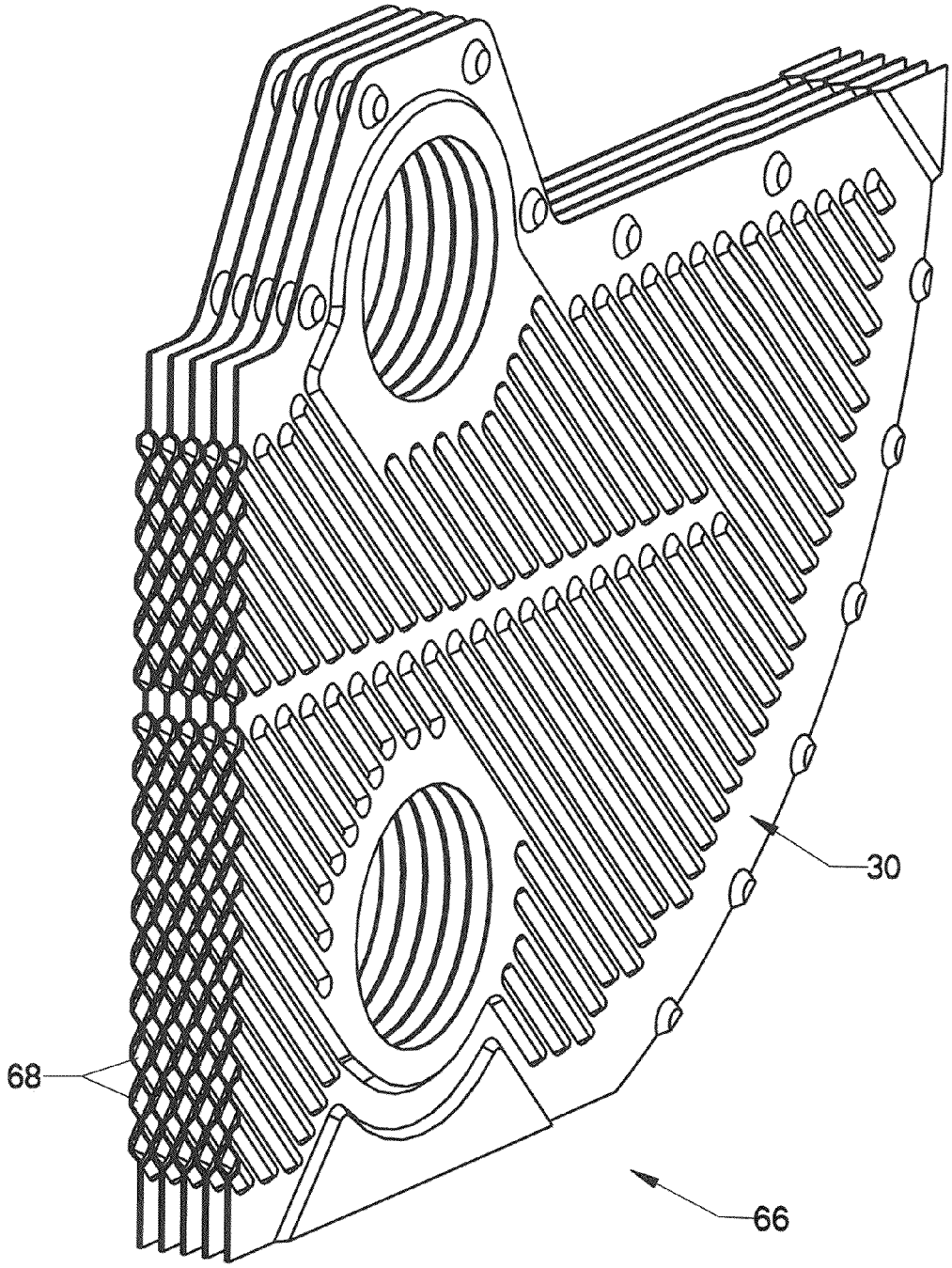
FIG. 15 is a sectioned perspective view, showing a stack of 10 assembled plates.

FIG. 15 shows the same cassette with the sectioning cut moved to the left to avoid the area of the secondary fluid intake and outlet holes. Flow channels 68 are created by the presence of the embossed channels on a pair of mating plates. These may be more readily observed in the enlargement of the same section shown in FIG. 16. In the enlargement, the reader will perceive that the diamond like pattern is in fact a pattern of hexagonal sections. The two labeled flow channels 68 (on the left side of the cassette in the view) contain secondary fluid. The flow channels immediately to the right of the labeled flow channels contain primary fluid (note that these channels are offset upwards from the ones that are labeled). Thus, counting a single row of flow channels proceeding from left to right across the section demonstrates the presence of nine separate fluid cavity layers (five secondary fluid flow channels proceeding straight across with four primary fluid flow channels being in between and vertically offset therefrom).

Figure 16:
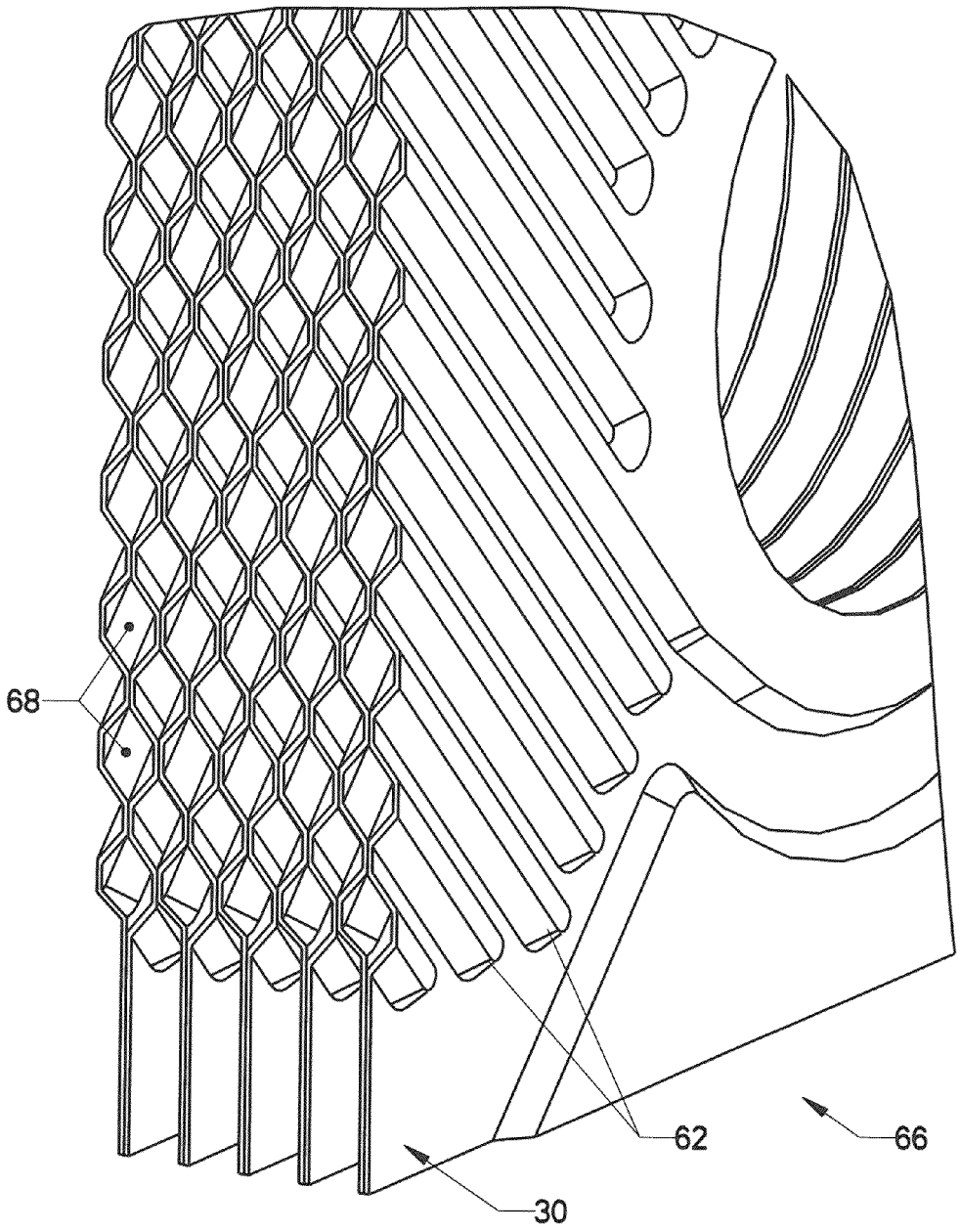
FIG. 16 is a detailed and sectioned perspective view, showing the flow channels created by an assembly of 10 plates.

The flow channels shown in the section view of FIG. 16 are not continuous hexagonal channels. Rather, one half of each channel flows upward at 45 degrees and one half of each flow channel flows downward at 45 degrees (owing to the overlapping and transversely oriented nature of the embossed channels, which may be readily observed in FIG. 10B). Thus, the reader should not be mislead by the sectioned view into thinking that one continuous channel having a hexagonal cross section exists.

Figure 17:
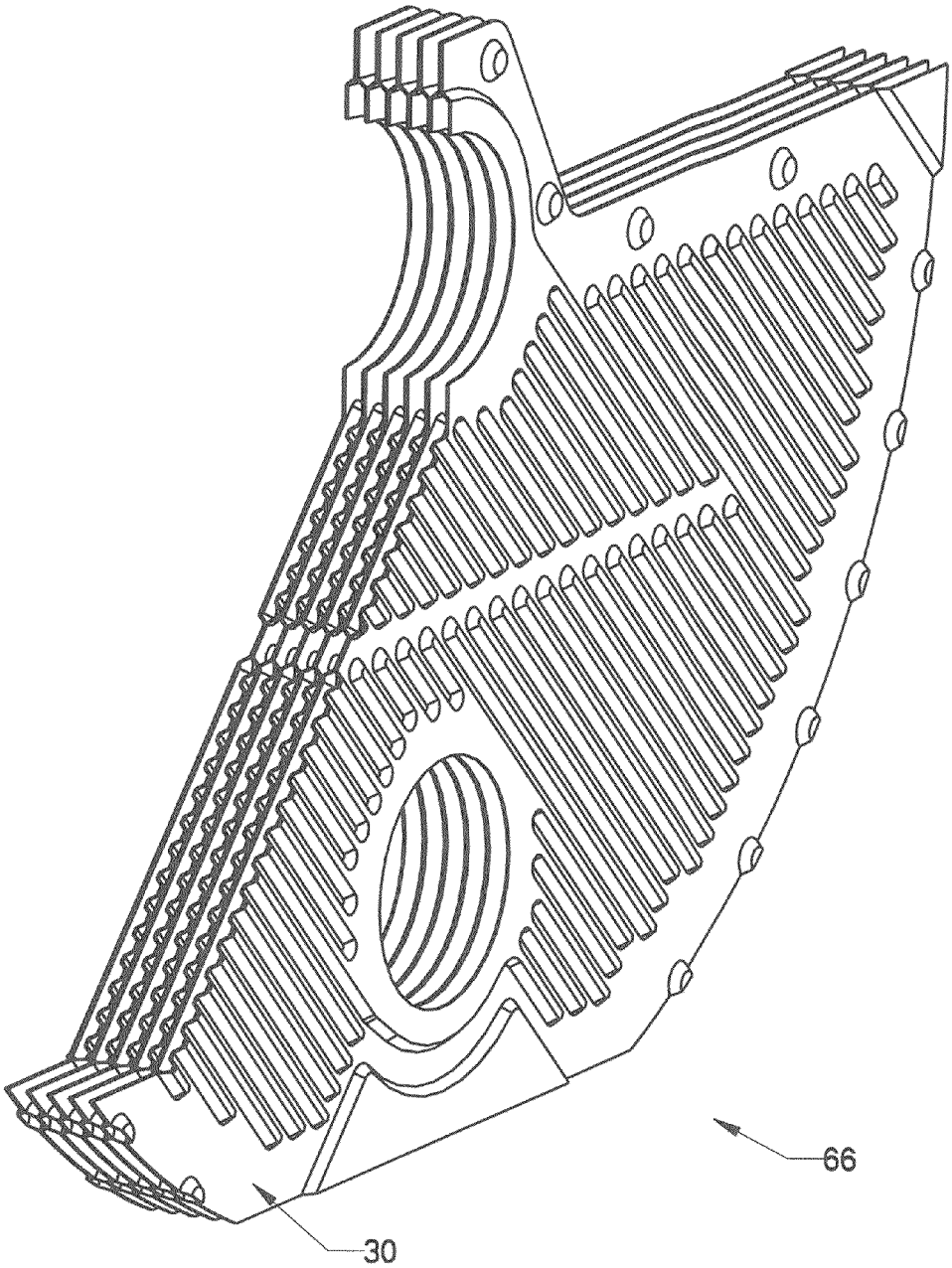
FIG. 17 is a sectioned perspective view, showing a stack of 10 assembled plates.
Figure 18:
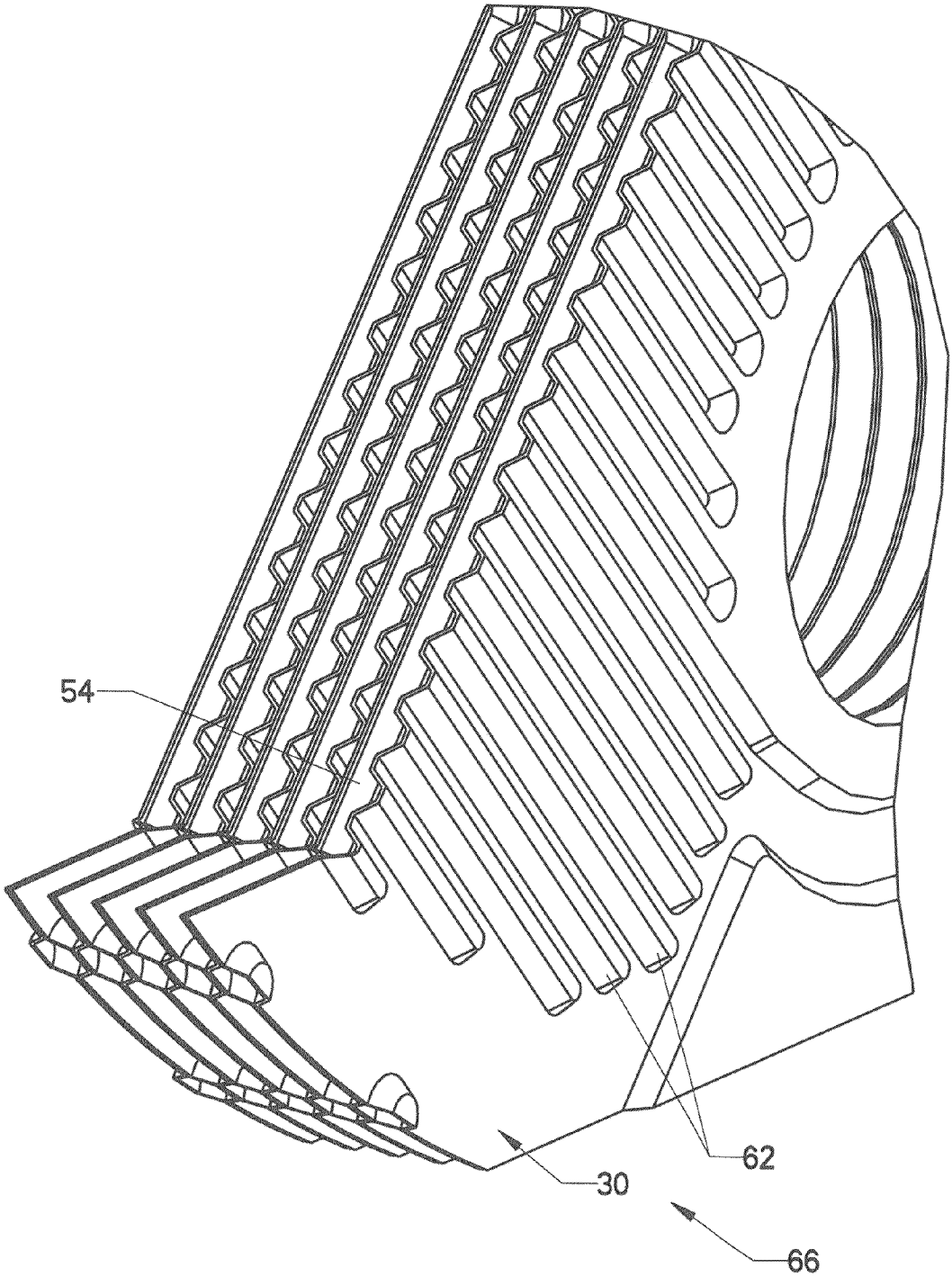
FIG. 18 is a detailed and sectioned perspective view, showing the flow channels created by an assembly of 10 plates.

FIG. 17 shows another sectional view of the same cassette, with the sectioning cut running down the center of one of the embossed channels. FIG. 18 shows a portion of this view in greater detail. The sectioning cut runs down the centerline of one of the embossed channels (female side) 54 of the second plate in the stack. This view allows the reader to easily perceive the nine separate fluid layers contained within the cassette.

Figure 19:
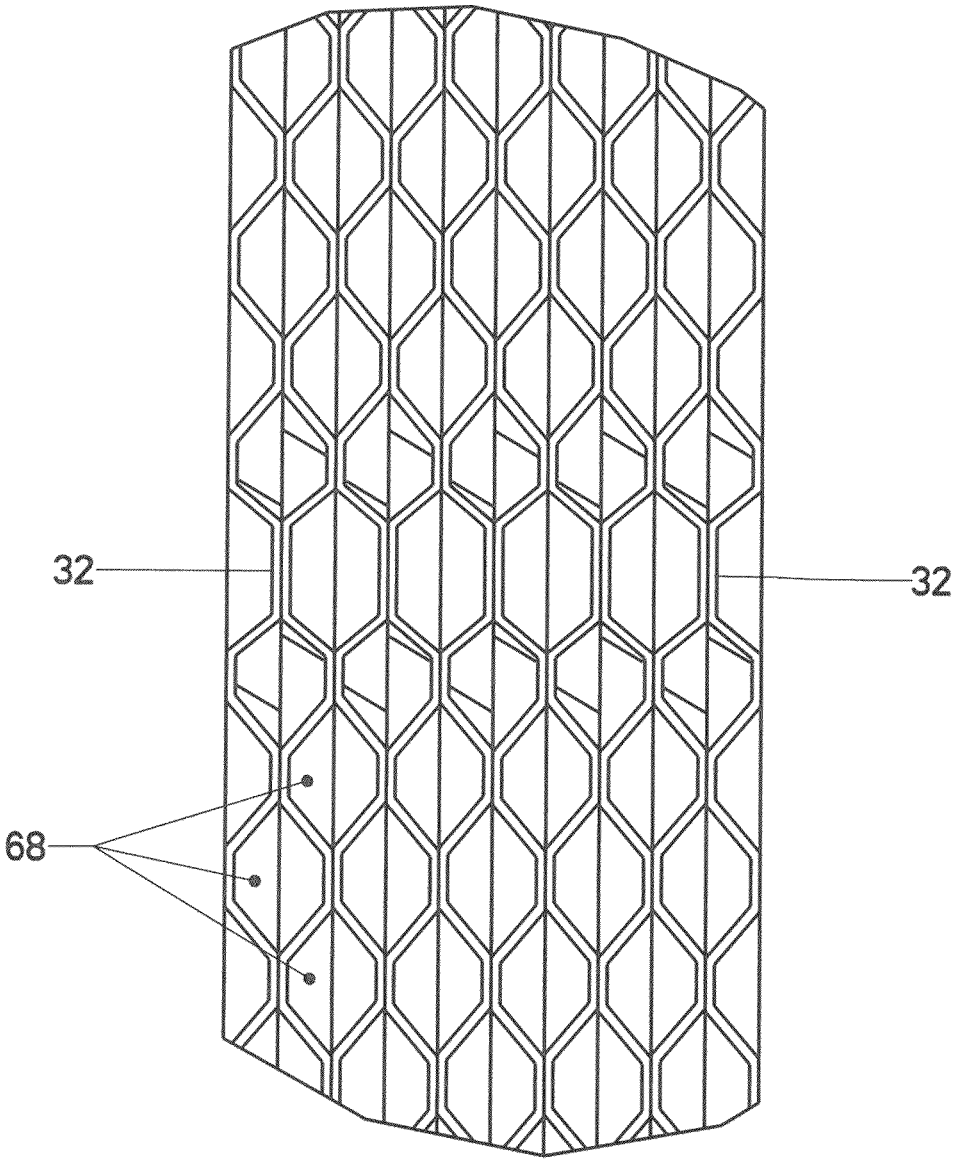
FIG. 19 is a detailed and sectioned elevation view, showing the flow channels created by an assembly of 10 plates.

FIG. 19 shows a detailed elevation view of the section originally depicted in FIG. 15. Three flow channels 68 are labeled in the view. The left labeled flow channel is a secondary fluid flow channel. The two flow channels immediately to the right of the first labeled flow channel are primary fluid flow channels. No secondary fluid flows across baffle 32, which is also labeled in the view. However, the primary fluid is able to freely flow across the baffle, as the baffle is merely a void on the primary fluid side.

Figure 20:
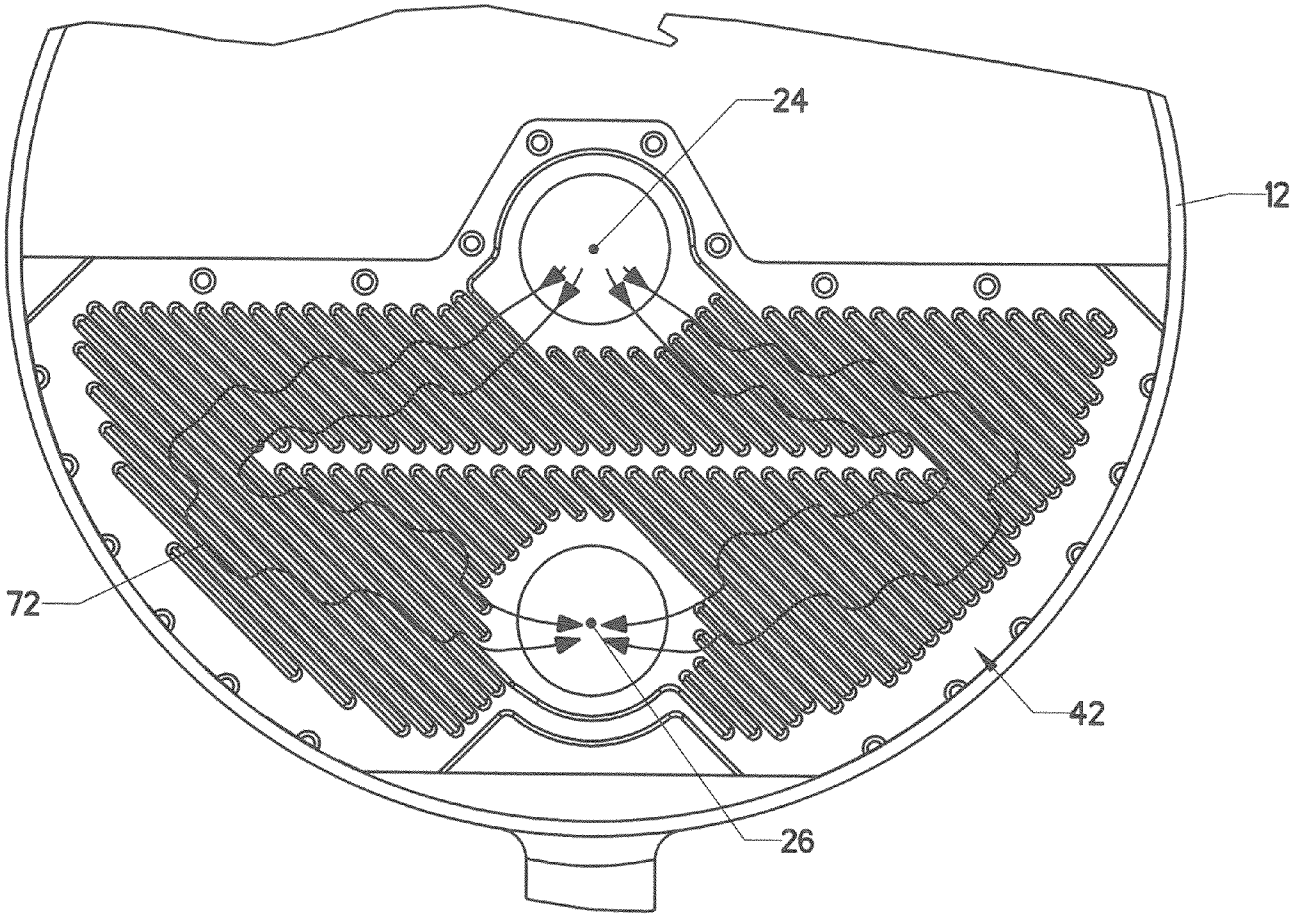
FIG. 20 is an elevation view, showing the flow of secondary fluid in the assembled heat exchanger.
Figure 21:
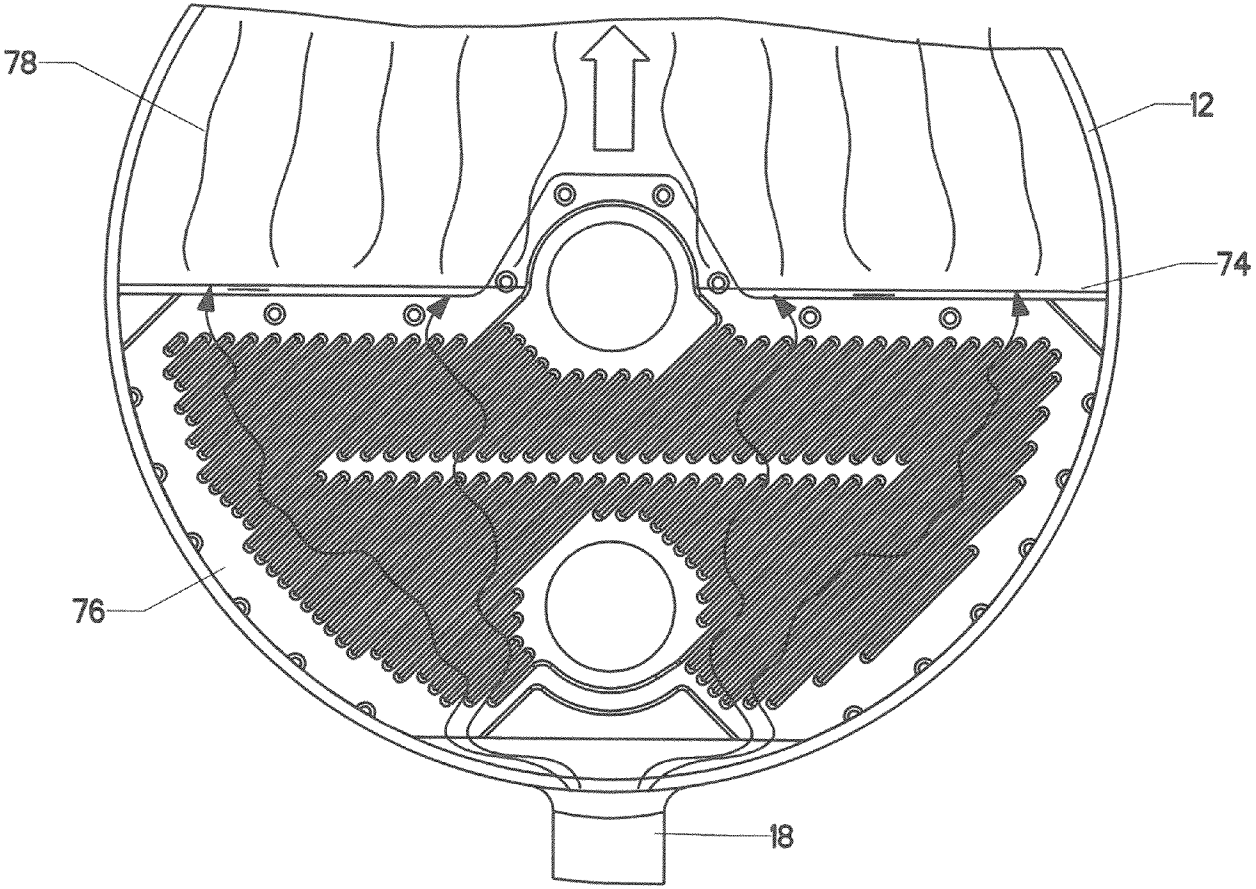
FIG. 21 is an elevation view, showing the flow of primary fluid in the assembled heat exchanger.

FIGS. 20 and 21 illustrate the flow in a secondary fluid cavity and a primary fluid cavity respectively. FIG. 20 is an elevation view taken through the heat exchanger in the middle of one of the secondary fluid cavities. Secondary fluid side 42 of the visible plate faces the user. The cassette is surrounded and contained by pressure vessel 12. The secondary fluid (typically water) enters through inlet hole 24 and proceeds around the baffle and toward outlet hole 26. The reader must bear in mind that another plate is facing the one shown, and that the embossed channels of this second plate are oriented transversely to the ones visible in the view. Thus, the water flows through a variety of secondary fluid paths 72. The water is forced to flow in a turbulent fashion across the entire face of the plate by a variety of flow paths. These flow paths will not be static, but will alter continuously due to the turbulent nature of the flow.

FIG. 21 is an elevation view taken through the heat exchanger in the middle of one of the primary fluid cavities. The primary fluid side of the plate is visible. Liquid primary fluid 76 is forced into the heat exchanger through primary fluid inlet 18. The flow is preferably regulated so that liquid surface level 74 lies over the top of the cassette(s). The primary fluid (which is typically a refrigerant such as R-134a) boils and transitions to vaporized primary fluid 78. The vaporized primary fluid then leaves the top of the heat exchanger through primary fluid outlet 20 (shown in FIG. 1). The boiling primary fluid will create its own agitation within the plates. The boiling action is much like a pot of boiling water. Gas bubbles are preferably created across the entire wetted surface.

The reader should bear in mind that another plate will be facing the one shown in the view, and that the primary fluid side of that plate will have its embossed channels oriented transversely to the ones shown in the view. Thus, the flow of the primary fluid across the plate will assume a variety of serpentine paths across the baffle and up toward liquid surface level 74.

As the refrigerant boils, it absorbs heat from the secondary fluid (water) that is being forced through the heat exchanger. As mentioned previously, the heat exchange rate is increased by the fact that the primary fluid flows upward while the secondary fluid flows downward (counterflow). It is desirable to further increase the heat transfer rate by other means. One approach is to ensure that the secondary fluid flows rapidly on its side of each plate while the primary fluid flows relatively slowly on the opposite side. This is the reason for applying the previously-mentioned enhanced surface treatment to the primary fluid side of each plate. Some of the objectives of the enhanced surface treatment are (1) slowing the flow of the primary fluid across the plate; (2) increasing the surface area of the primary fluid side of the plate; and (3) increasing the mixing and turbulence of the primary fluid.

Those skilled in the art will realize that slowing the flow rate is typically a minor objective. However, the increase in the effective surface area can have a dramatic effect. This is particularly true for a boiling liquid, where heat transfer rates can be increased by an order of magnitude. A detailed explanation of the surface treatments is presented near the end of this disclosure. The surface treatments can be applied to the flooded or falling film type of heat exchanger. Accordingly, a detailed explanation of the falling film type of heat exchanger is presented before the explanation of the surface treatment is given.

2. Falling Film Type Heat Exchanger.

As discussed initially, the "falling film" approach can be applied to plate-type heat exchangers. In this approach, the secondary fluid is still circulated as a liquid inside the shell, with the secondary fluid being forced between adjacent plates. However, the primary fluid is no longer a boiling "bath" in which the plates are immersed. Instead, the primary fluid is sprayed onto the primary side of the plates. This forms a film of primary fluid which falls downward under the influence of gravity and coats the primary side. This thin film allows rapid evaporation and excellent heat transfer across the plate. The use of a film also allows substantially reduced gas charges, since the mass of refrigerant is reduced.

Figure 33:
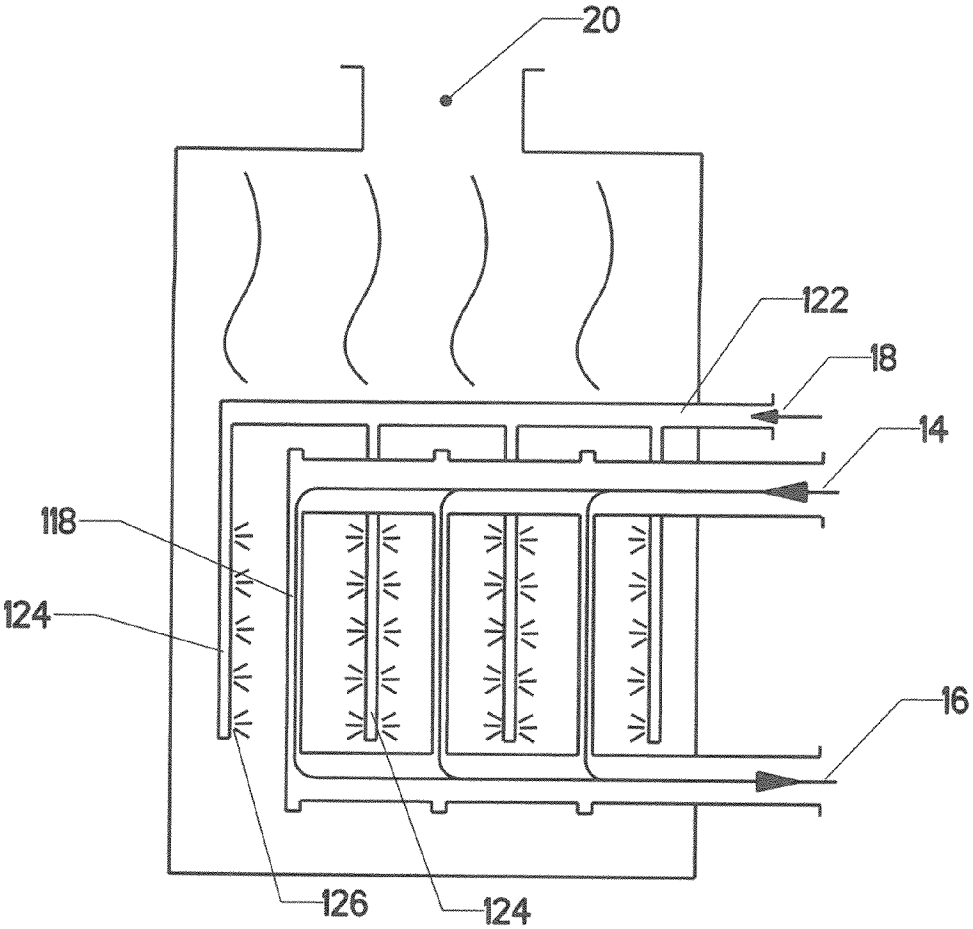
FIG. 33 is a schematic view, showing a falling film type of heat exchanger.

FIG. 33 conceptually illustrates a plate type heat exchanger using the falling film approach. The secondary fluid (typically water) is forced to flow through secondary fluid flow channels 118 (between the adjacent plates) and out secondary fluid outlet 16. The primary fluid flows in through primary fluid inlet 18 into primary fluid manifold 122. From there it flows down into a series of spray manifolds 124. Spray nozzles 126 in the spray manifolds spray the primary fluid onto the primary fluid side of each plate. The resulting film of primary fluid flowing down the plate surfaces evaporates and leaves primary fluid outlet 20 as a vapor.

As depicted, the spray nozzles cover most of the primary fluid side of the plates. This need not always be the case. In fact, in many instances it is preferable to spray only the upper portions of the plates. The thin film of refrigerant will then coat the middle and lower portions of the plate as it falls.

Of course, the actual device corresponding to the crudely depicted spray manifold in FIG. 33 is more complex. Such a device must direct the liquid primary fluid to the appropriate locations within the heat exchanger and deposit it on the primary side of the plates. One approach is to add another component to the stack of plates which is specifically designed to carry liquid primary fluid (refrigerant) and spray it appropriately. This additional component is preferably configured to be assembled in the same manner as the existing plates (stacking and joining).

Figure 34:
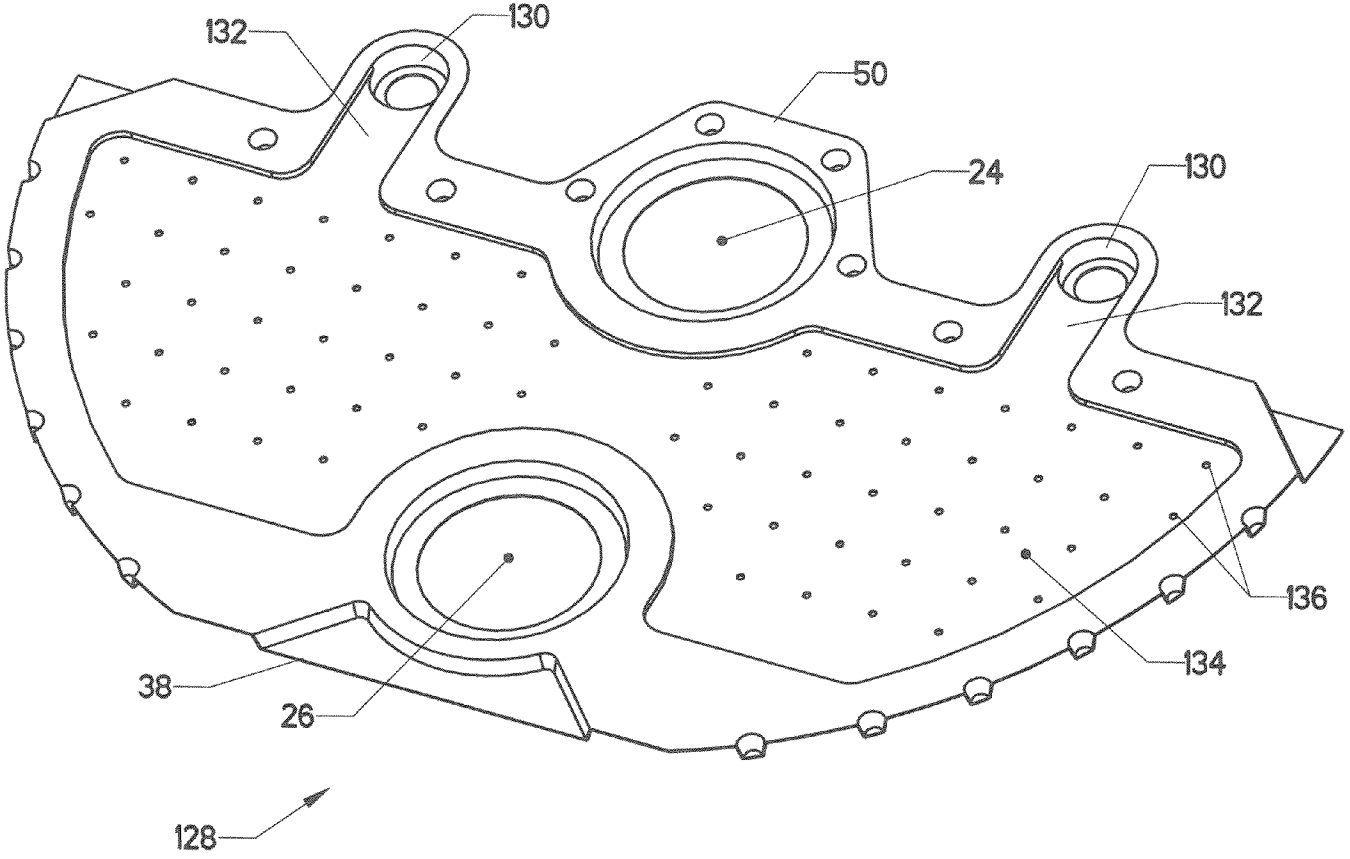
FIG. 34 is a perspective view, showing a spray plate.

FIG. 34 shows a plate configured to accomplish this task. Spray plate 128 is grossly similar to plate 22 of FIG. 3. It is designed to mate to an identical spray plate like a pair of bookends. It includes inlet hole 24 and outlet hole 26. These are positioned to align and attach to the corresponding inlet and outlet holes in plate 22. Likewise, spray plate 128 includes round standoffs and corner standoffs. These features are embossed to a greater depth, for reasons which will be explained subsequently.

Spray plate 128 includes a pair of primary fluid inlets 130. Inlet runners 132 connect the inlets to primary fluid manifold 134. Primary fluid manifold 134 includes an array of orifices 136. Liquid primary fluid flows into the manifold from the primary fluid inlet, after which it is sprayed out through the orifices. The pattern of orifices shown is merely one example among many possibilities. The pattern is preferably optimized for each individual application.

Figure 35:
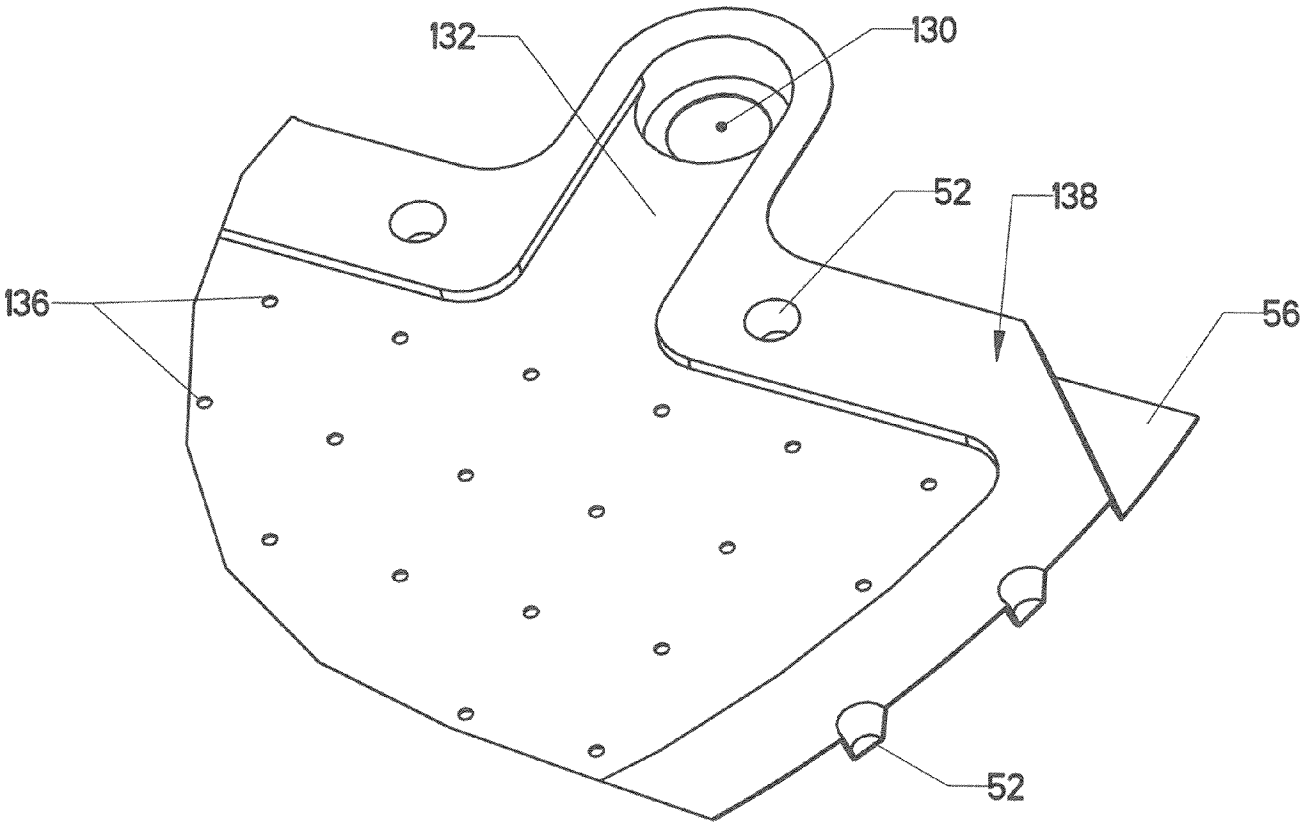
FIG. 35 is a detailed perspective view, showing additional details of the spray plate of FIG. 34.

FIG. 35 shows a detailed view of one corner of spray plate 128. The reader will observe the presence of corner standoffs and round standoffs which are positioned to mate with the similar features found on plate 22.

Figure 36:
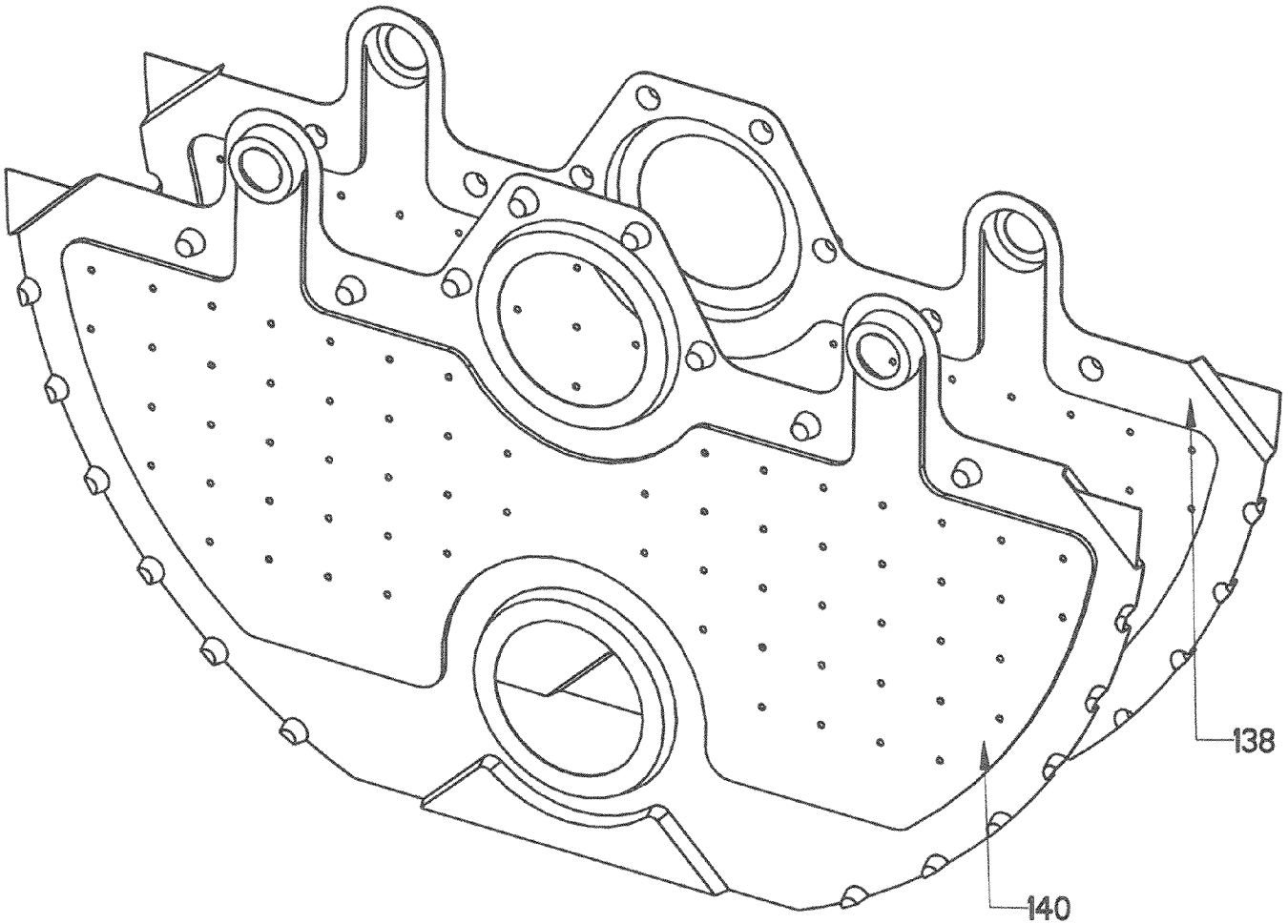
FIG. 36 is a perspective view showing a pair of spray plates positioned for joining.

FIG. 36 shows a pair of spray plates positioned to mate together. Each spray plate has a liquid primary fluid side 138 and an evaporating primary fluid side 140. The two liquid primary fluid sides are oriented to face each other. The two surfaces facing each other can then be joined by brazing, welding, an adhesive process, or other suitable process.

Figure 37:
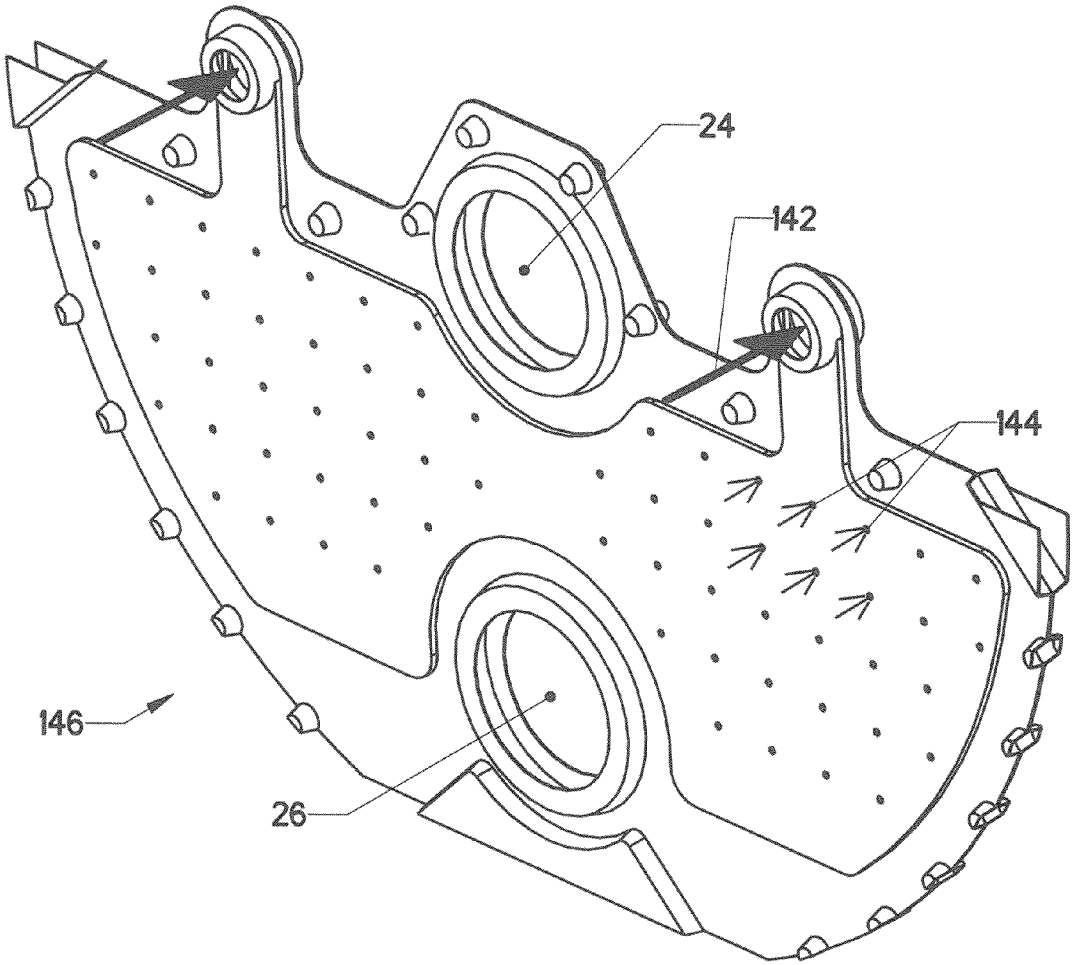
FIG. 37 is a perspective view, showing two spray plates joined to form a spray plate pair.

FIG. 37 shows the two plates joined together. The combination is known as a spray plate pair assembly 146. Liquid primary fluid 142 flows into the manifold as indicated by the arrows. It then flows down through the inlet runners into the primary fluid manifold formed as a hollow cavity between the two plates. From there the primary fluid is forced out as a plurality of spray jets 144. These are directed toward the primary fluid side of the heat exchanger plates. In studying the geometry, those skilled in the art will quickly realize that the secondary fluid will pass through the inlet and outlet holes without flowing into the pair of spray plates. In other words, the secondary fluid will simply pass by on its way to the adjoining heat exchanger plates.

Figure 38:
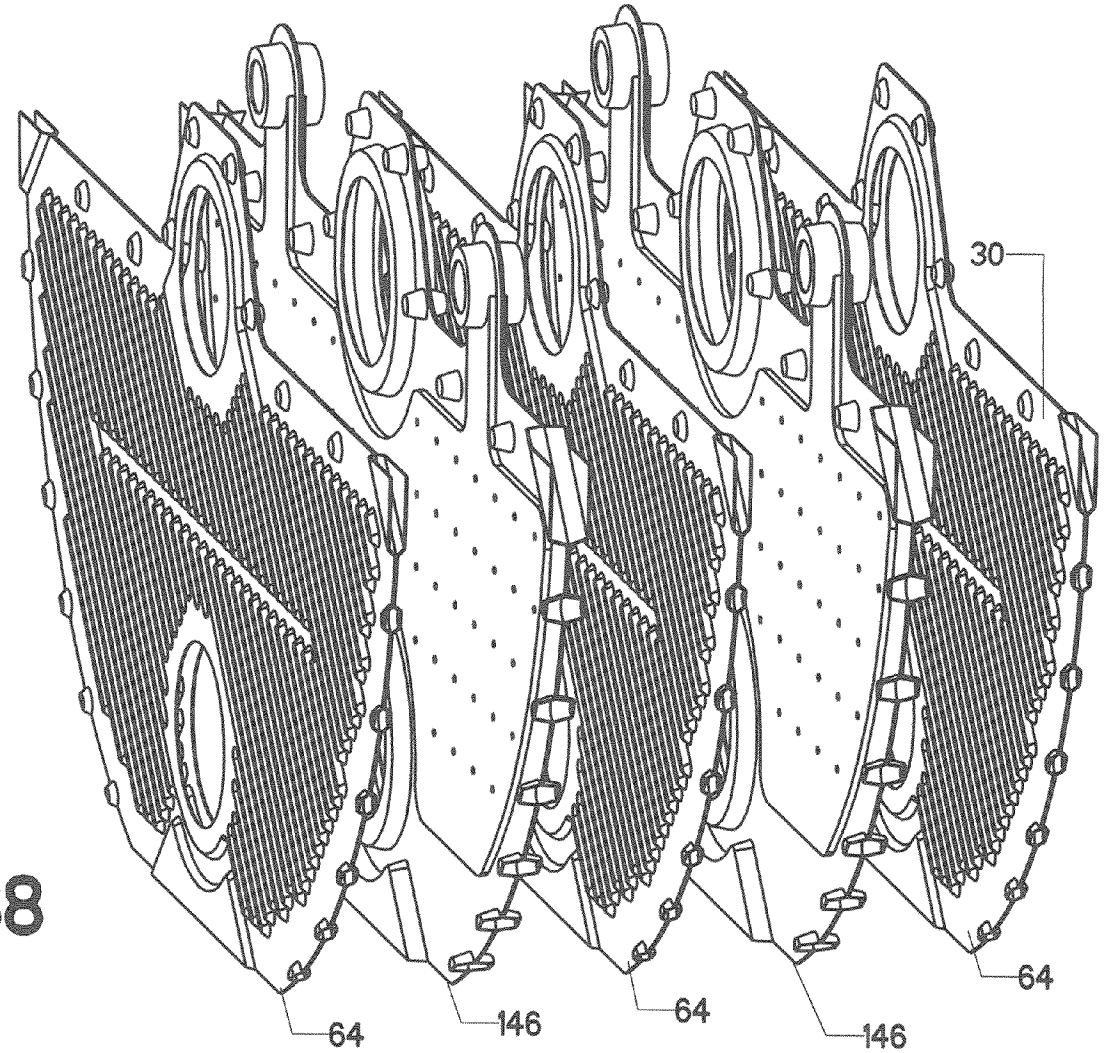
FIG. 38 is a perspective view showing a stack of plate pairs and spray plate pair assemblies positioned for joining together.

FIG. 38 shows a stack of spray plate pair assemblies 146 and plate pairs 64 in position for assembly. The reader will recall from the prior description that each plate pair 64 defines a volume of secondary fluid which is forced to flow from top to bottom (although for some falling film applications it is preferable to have the secondary fluid flow from bottom to top). The orifices of each spray plate pair assembly 146 are pointed toward the primary fluid side 30 of each plate pair 64.

Figure 39:
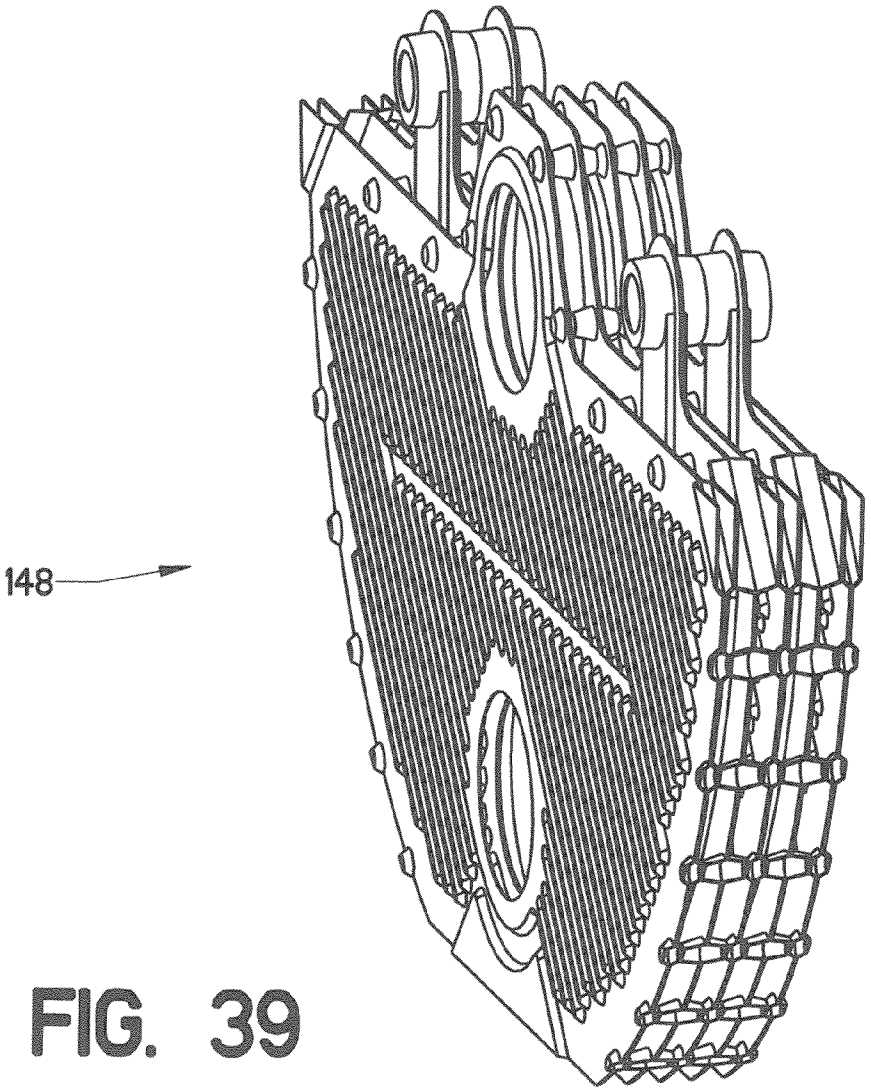
FIG. 39 is a perspective view, showing the stack of FIG. 38 after it is joined.

FIG. 39 shows the assembly of FIG. 38 pressed together and joined. The reader will observe how the secondary fluid inlet and outlet holes in the spray plates 128 align with the inlet and outlet holes in the conventional plates 22. The reader will also observe how the primary fluid inlets 130 in the spray plates bridge over the top of the plates 22 and are joined together to form a continuous conduit for the primary fluid.

The embossed features on each spray plate designed to join a spray plate pair assembly to the adjacent plate pair are preferably deeper than the embossed features on the conventional plates in order to allow a gap between the orifices and the primary fluid side of each plate pair. This gap allows the sprayed primary fluid room to disperse into an even pattern and thereby fully coat the primary fluid sides.

Figure 40:
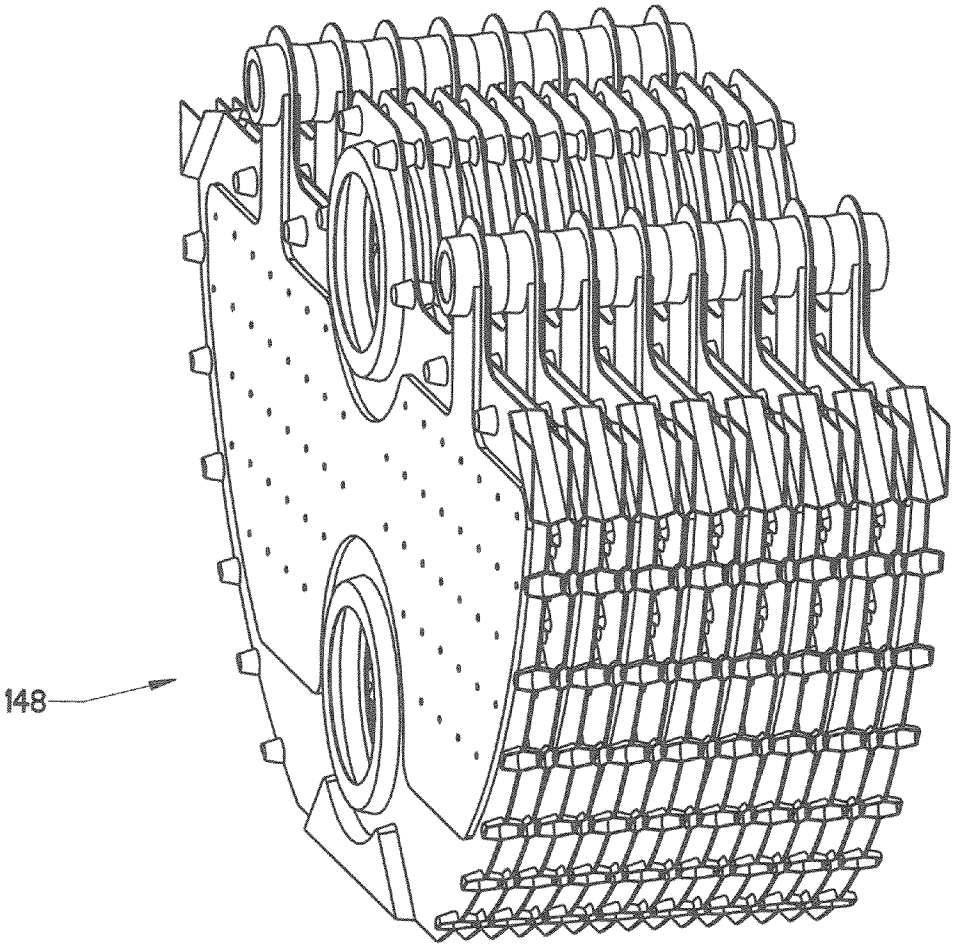
FIG. 40 is a perspective view, showing an enlarged stack of plate pairs and spray plate pairs.
Figure 41:
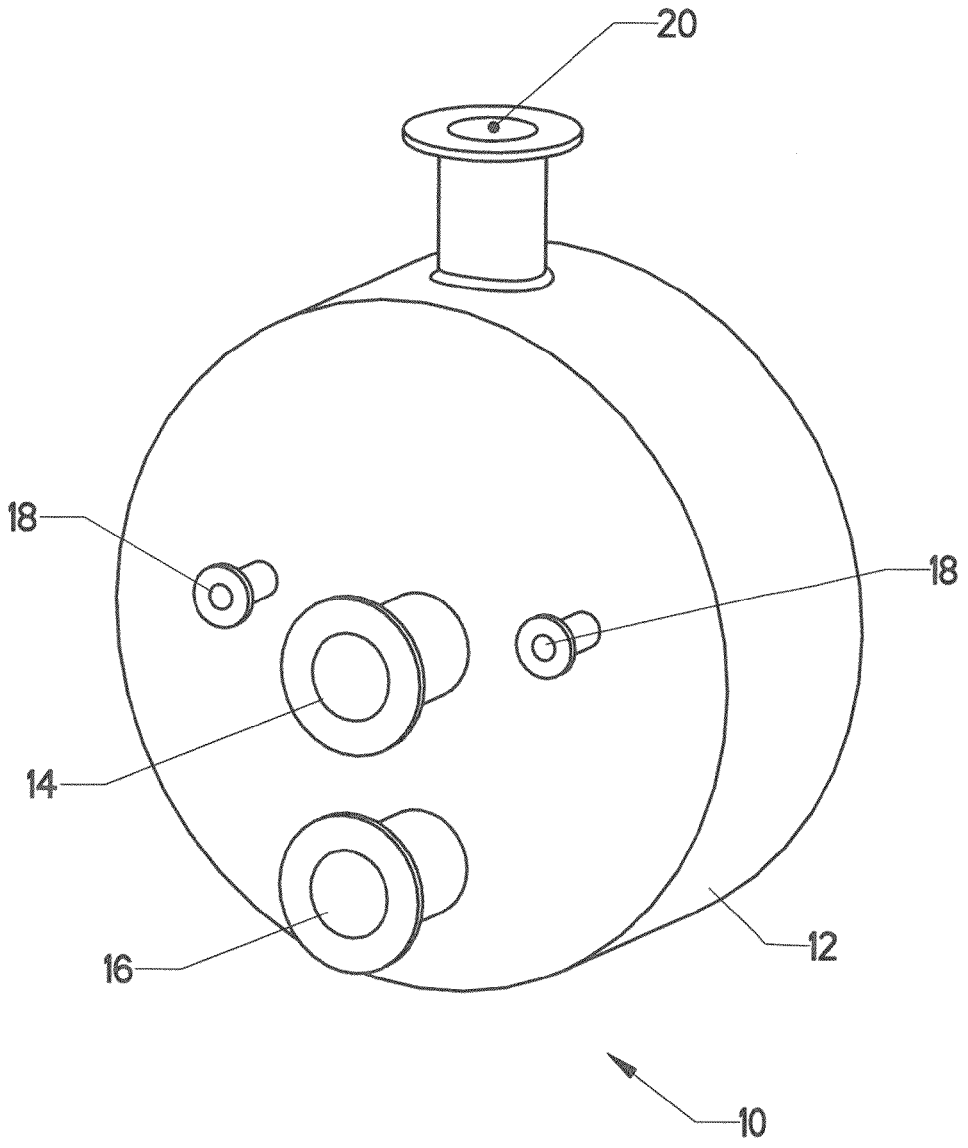
FIG. 41 is a perspective view, showing a simplified falling film heat exchanger.

The stack shown in FIG. 39 can be expanded by adding more plate pairs and spray plate pair assemblies. FIG. 40 shows an enlarged stack of corresponding components. An actual heat exchanger might have hundreds of such layers. As for the flooded type of exchanger, the stack of assembled plates must be placed within a pressure vessel. FIG. 41 shows pressure vessel 12. It includes secondary fluid inlet 14 and secondary fluid outlet 16. In this particular example, primary fluid inlet 18 is split into two separate inlets. Primary fluid outlet 20 remains in the top of the chamber.

Figure 42:
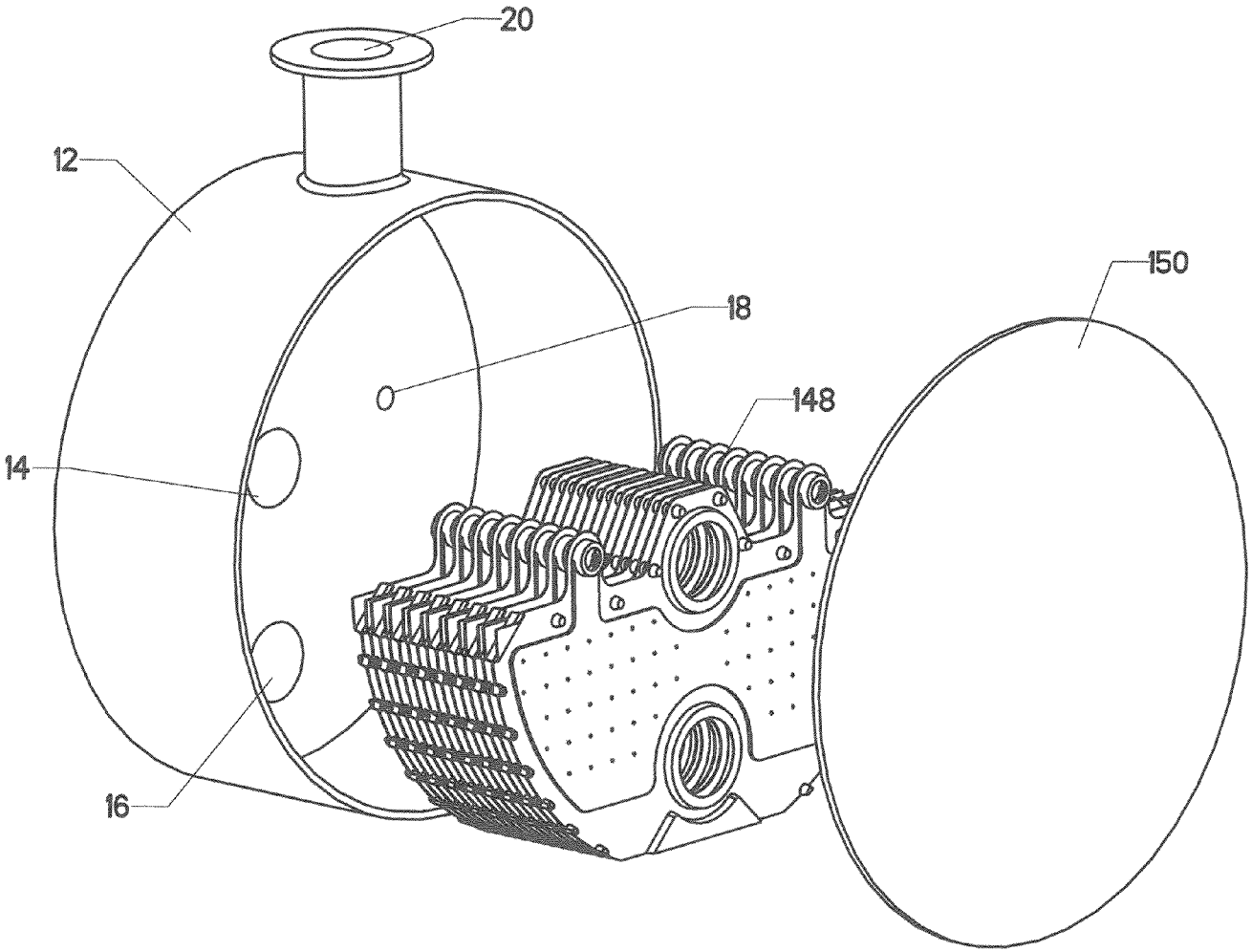
FIG. 42 is an exploded view, showing the contents of the heat exchanger.

FIG. 42 shows an exploded view of a falling film heat exchanger 10. Pressure vessel 12 has a hollow interior sized to receive the assembled stack of FIG. 40. The reader will observe that the two primary fluid inlets 18 align with the primary fluid inlet 130 on each spray plate 128. Likewise, the secondary fluid inlet 14 and outlet 16 align with their respective holes on the assembled stack. End plate 150 clamps the device together and seals the open end of the pressure vessel. The result is a very efficient heat exchanger which uses a significantly reduced gas charge.

The spray plate design is of course only one approach among many possibilities for creating a falling film plate-type heat exchanger. In some applications it may only be necessary to spray the top portion of the plates, allowing the film to flow downward and cover the balance of the plates under the influence of gravity. Such an application might actually place the spray plate pair or manifolds adjacent to or even above the upper surface of the plates 22.

Figure 43:
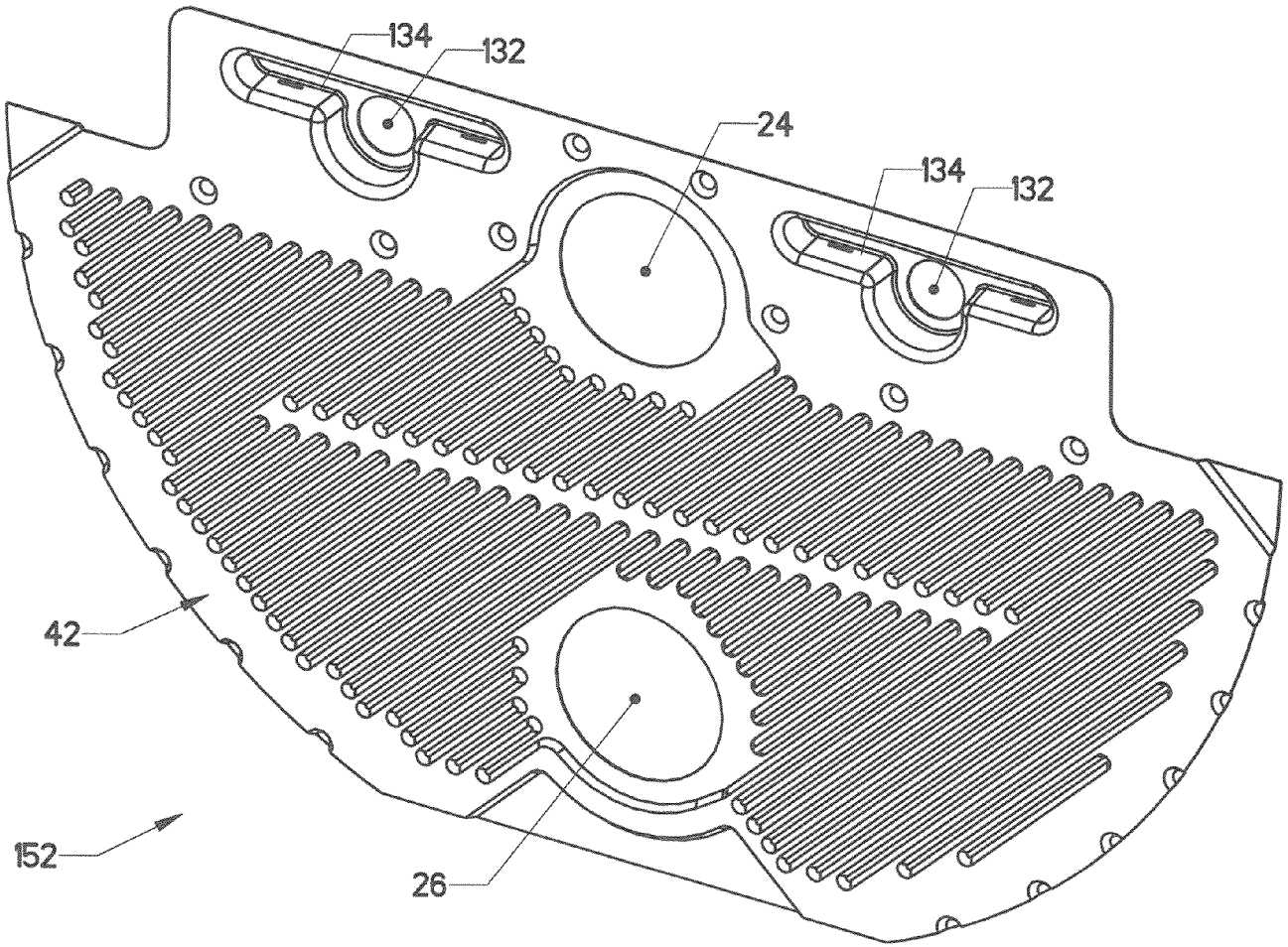
FIG. 43 is a perspective view, showing a combination plate.

Another approach is to combine the spray plate pair geometry and the secondary fluid geometry into the design of a single plate. FIGS. 43-51 illustrate one embodiment of this approach. FIG. 43 illustrates such a combination plate. The reader will observe that it includes the same features as plate 22 of FIG. 3, including having a primary fluid side and a secondary fluid side. The orientation shown in FIG. 43 shows secondary fluid side 42. Although most of the plate's features are the same as the embodiment shown in FIG. 3, the upper perimeter of the plate has been extended on either side of inlet hole 24. An embossed primary fluid manifold 134 is included on either side of inlet hole 24. Each primary fluid manifold 134 includes a primary fluid inlet 132 as well.

The term "embossed" is used because it is generally possible to form the primary fluid manifolds by drawing the thin metal of the plate into the desired shape. However, it is also possible to make the shape of the primary fluid manifold as a separate piece and join it to the plate by welding or brazing. Thus, the embodiment should not be viewed as limited to the use of a drawing process.

Figure 44:
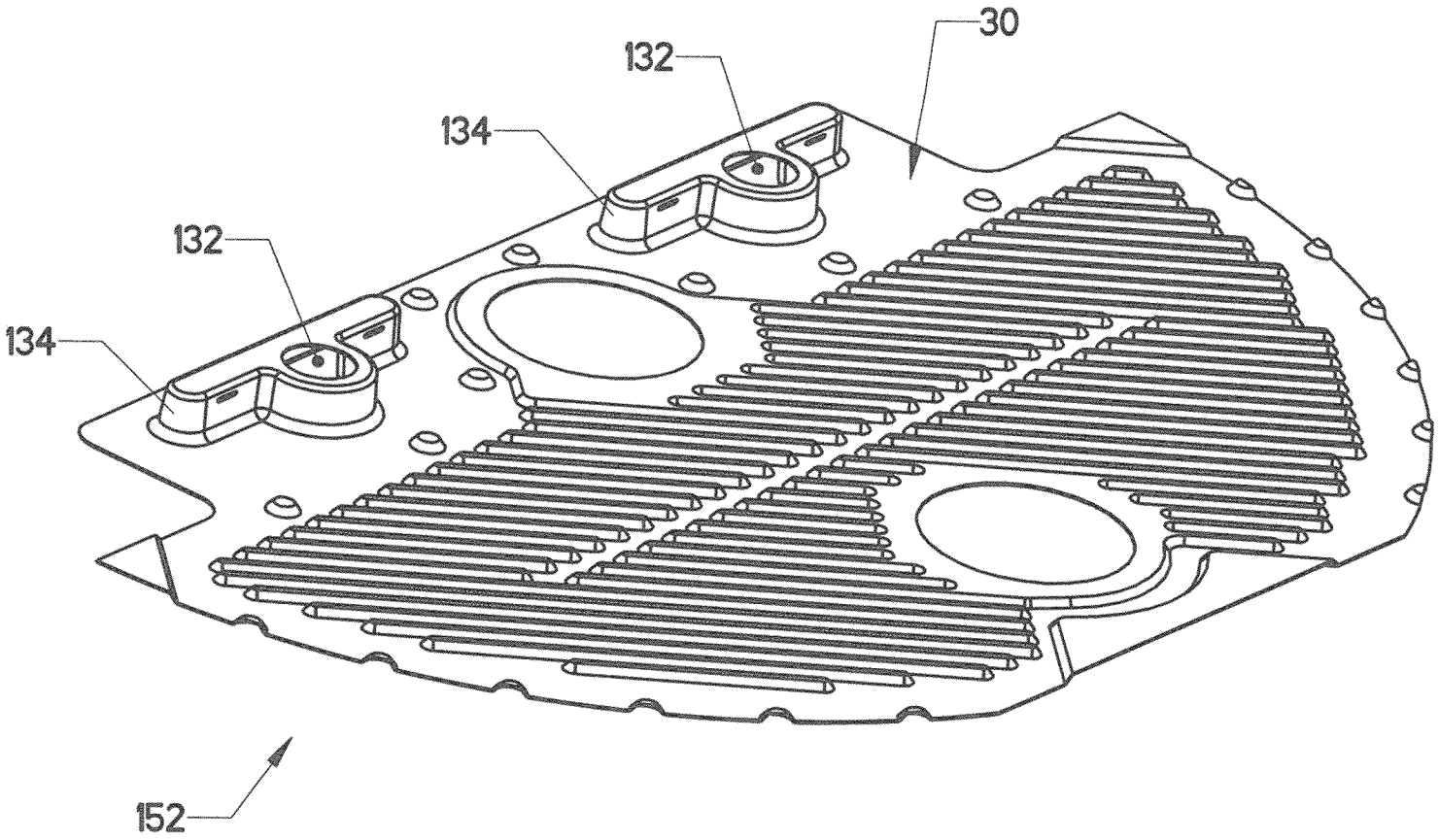
FIG. 44 is a perspective view, showing another view of a combination plate.
Figure 45:
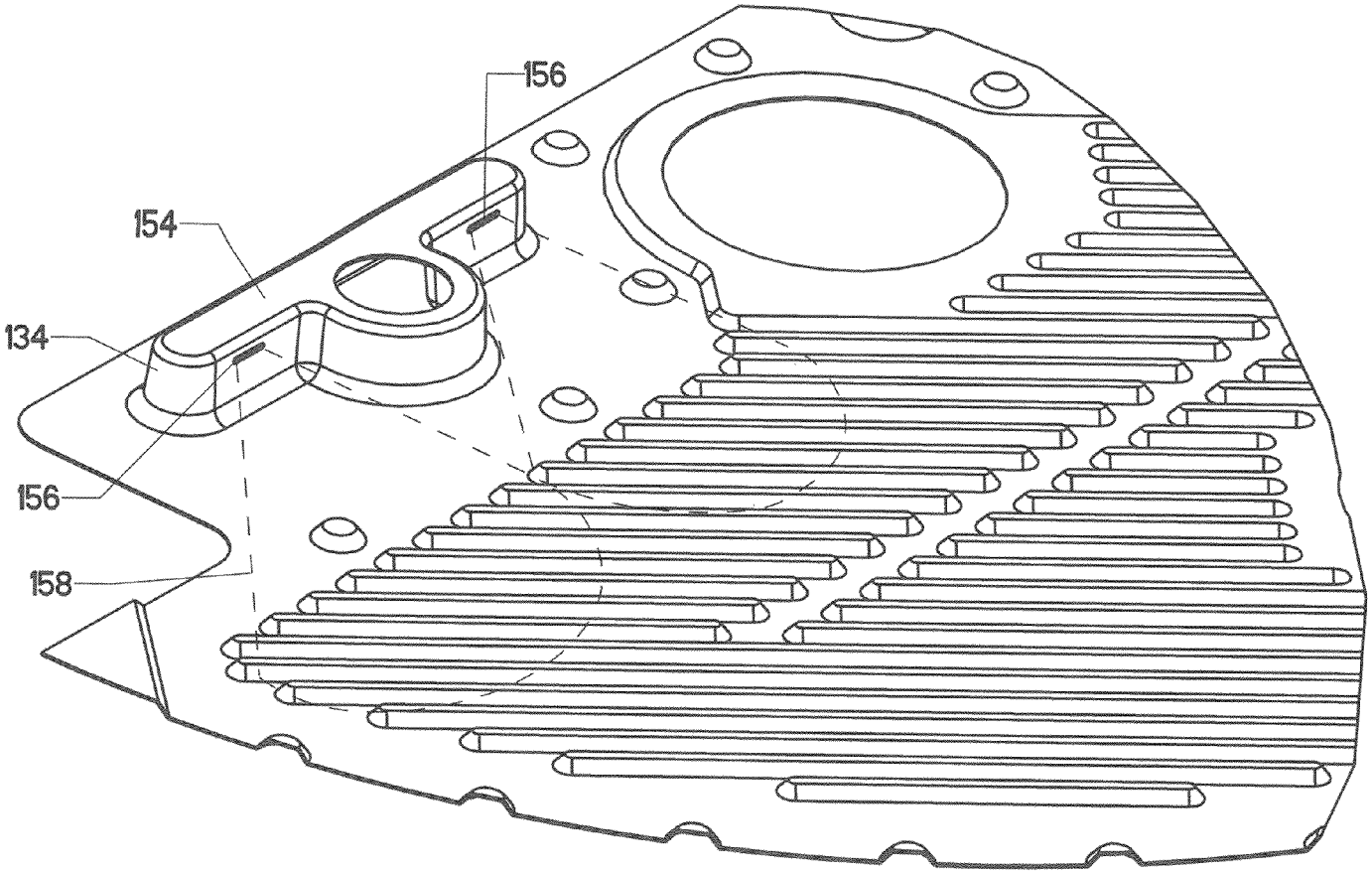
FIG. 45 is a detailed perspective view, showing details of the primary fluid manifold on the combination plate.

FIG. 44 shows combination plate 152 from the opposite side—primary fluid side 30. The reader will observe how the pair of primary fluid manifolds 134 protrude outward from the primary fluid side of the combination plate. FIG. 45 shows a more detailed view of one of the primary fluid manifolds. Each primary fluid manifold has one or more spray passages to allow the passage of the primary fluid. The embodiment shown uses a pair of spray slots 156 passing from the exterior to the interior of the primary fluid manifold. These slots are created by any suitable process such as punching, milling, etching, or arc erosion. They may be cut through the wall of the primary fluid manifold at an angle, in order to point the spray pattern back toward the primary fluid side of the plate (instead of simply spraying downward when the plate is in its assembled orientation). The spray slots shown include the angled feature and thereby produce the spray patterns 58 shown in the view.

The reader will note that the spray patterns 58 only cover the upper portions of the plate. However, once the plate is assembled into a vertical orientation, the spraying of the upper portions will create a falling film which descends predictably under the influence of gravity. The primary fluid manifold on the opposite side of the inlet hole covers the opposite side of the plate.

Each primary fluid manifold 134 includes a mating surface 154. This mating surface bears against an opposing mating surface on another primary fluid manifold when the plates are assembled. The mating surfaces can be joined together by any suitable process. The aligned primary fluid inlets 132 then allow primary fluid to flow continuously from one primary fluid manifold to the next, as will be illustrated subsequently. While it is necessary to seal the perimeter of the fluid inlets 132, the balance of the mating surfaces can simply be pressed together in some applications.

Figure 46:
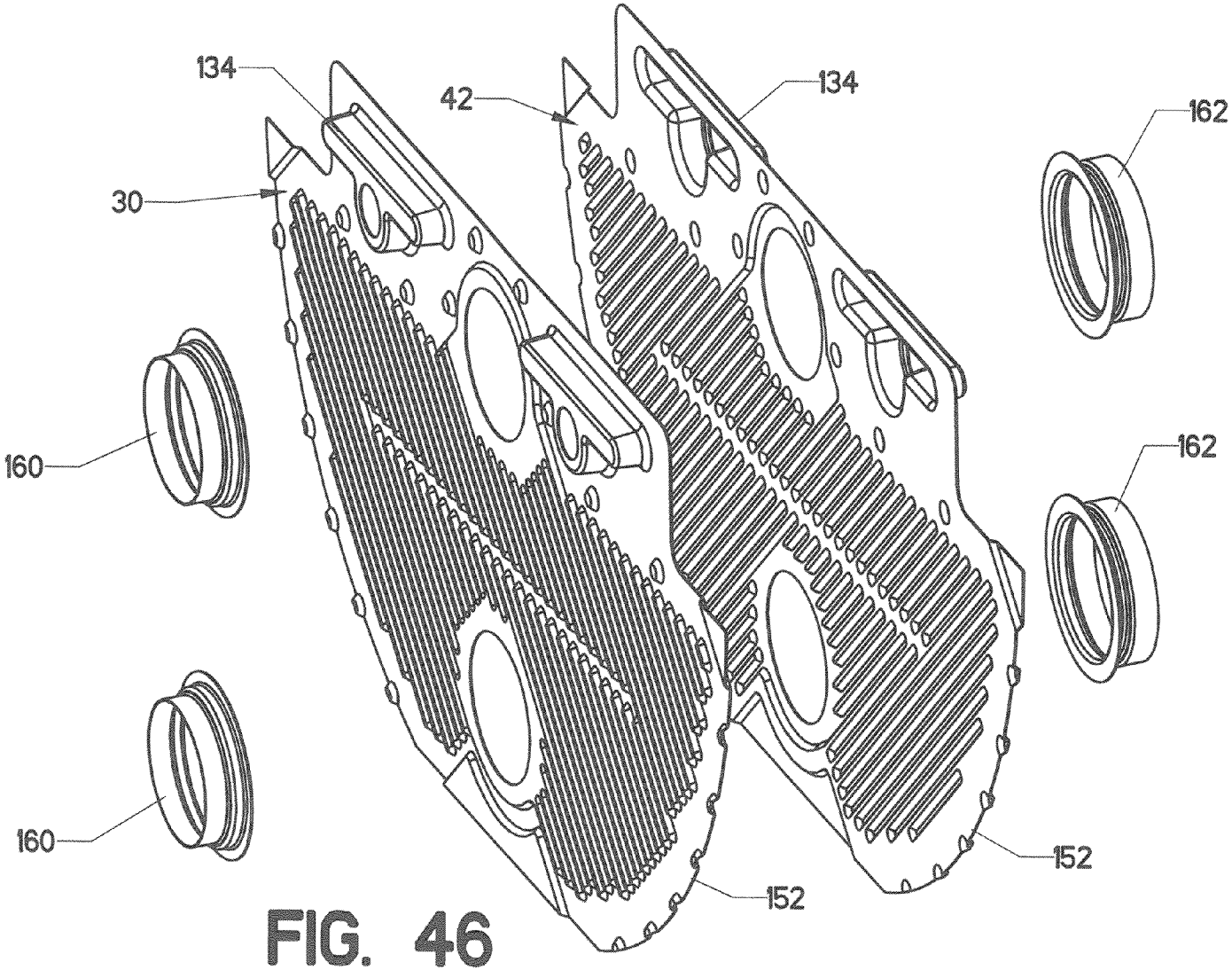
FIG. 46 is an exploded perspective view, showing two combination plates positioned for assembly, along with coupling components designed to couple the secondary fluid inlets and outlets.

FIG. 46 shows a pair of combination plates 152 positioned for assembly. The secondary fluid sides 42 of each plate face each other, with the primary fluid sides 30 facing outward. The two plates are then joined together as described previously. The reader will appreciate a problem, however. The primary fluid manifolds preferably extend outward sufficiently far from the plates to create a good spray pattern. They will often extend outward further than the mating surfaces for the inlet holes 24 and outlet holes 26. The mating surfaced for the inlet and outlet holes must therefore be extended (in order to lie coplanar with the mating surfaces on the primary fluid manifolds) or some type of coupling component must be added to bridge the gap.

FIG. 46 shows the use of the coupling component approach. A pair of male couplers 160 is added to the primary fluid side 30 of the plate closest to the viewer in FIG. 46. A pair of female couplers 162 is added to the primary fluid side 30 of the plate farthest from the viewer. The couplers are shown as separate components. However, it is possible in some applications to form the couplers as part of the plates themselves. Once the illustrated assembly is joined, it is known as a combination plate pair.

Figure 47:
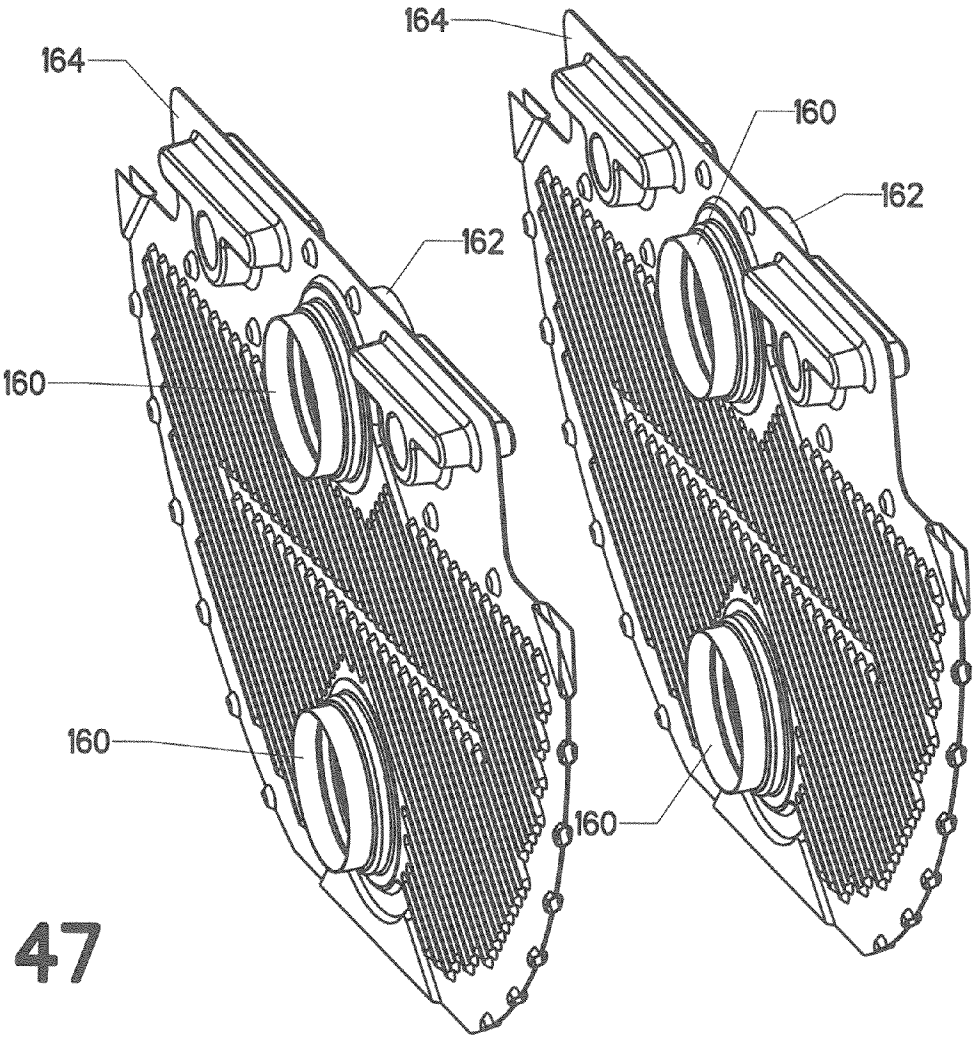
FIG. 47 is an exploded perspective view, showing two combination plate pairs in position for assembly.

FIG. 47 shows two combination plate pairs 164 positioned for assembly. The reader will observe how male couplers 160 and female couplers 162 bridge the gap between the plate pairs created by the addition of the primary fluid manifolds. Other bridging features may be added to stiffen the assembly. As an example, the corner standoffs and round standoffs could be deepened to bridge the gap. Secondary brackets could also be used if necessary.

Figure 48:
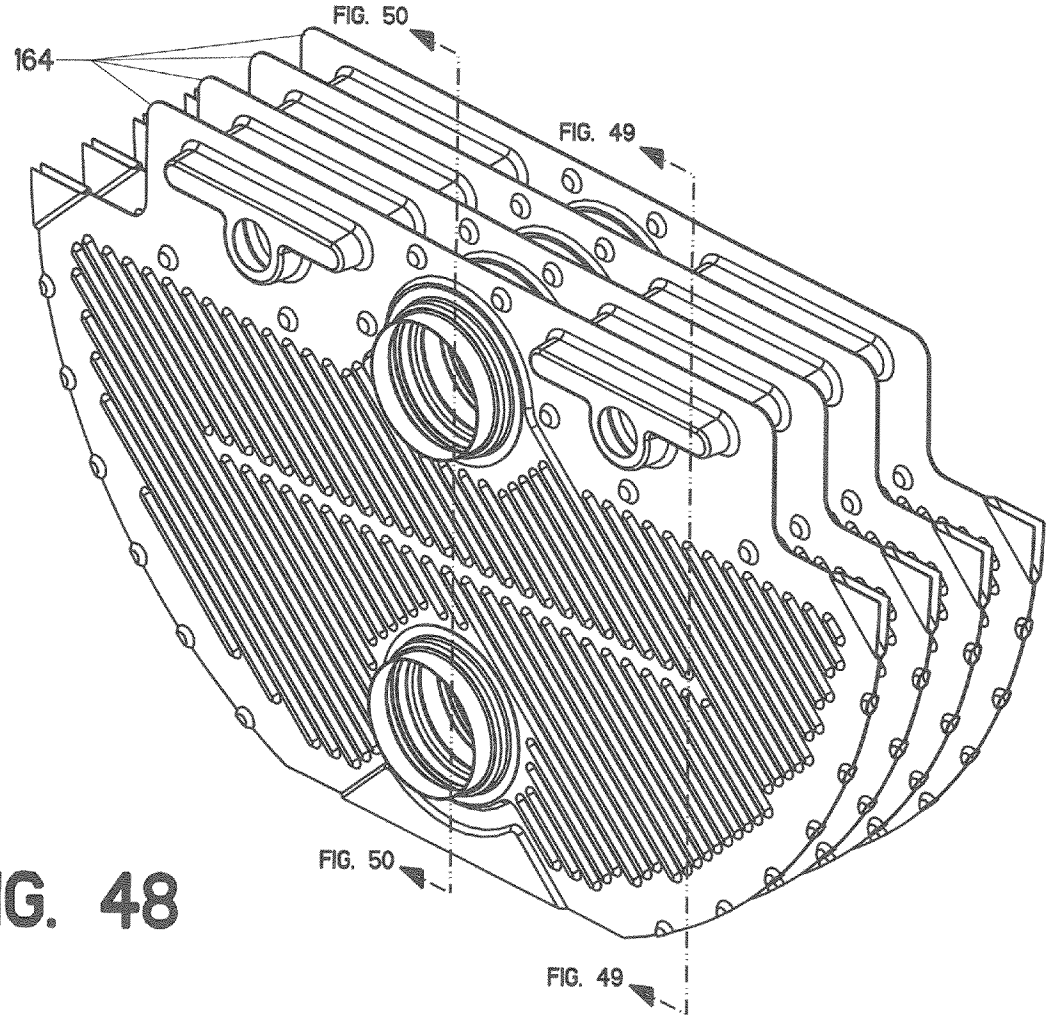
FIG. 48 is a perspective view, showing an assembly of four combination plate pairs, including a total of eight combination plates.

In FIG. 48, a stack of four combination plate pairs 164 has been assembled (including eight individual combination plates 152). The inlet holes 24 and outlet holes 26 all align so that the primary fluid can freely flow into and out of the assembly. Likewise, the primary fluid inlets 132 align in order to allow the primary fluid to flow into the assembly and then be sprayed onto the primary fluid sides of each plate pair.

Figure 49:
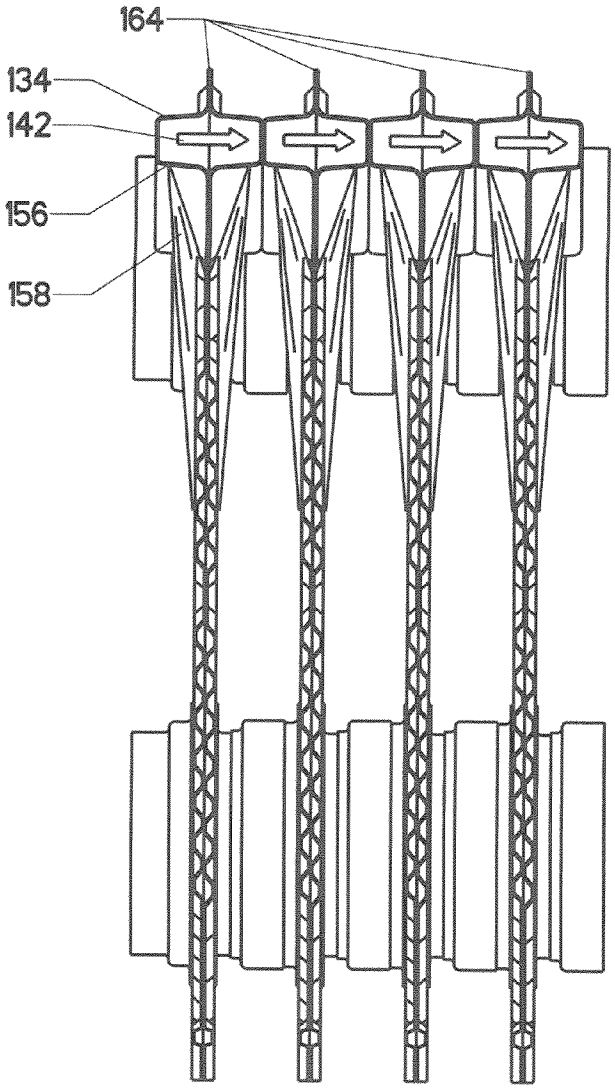
FIG. 49 is a sectioned elevation view, showing the flow of primary fluid and the spraying of primary fluid onto the primary side of each plate.

Some section views will better allow the reader to visualize the internal geometry. FIG. 49 shows a section view through the middle of primary fluid manifolds 134. Liquid primary fluid 142 is able to flow through all the manifolds and spray out to form the desired spray patterns 158 across the tops of the plates. The falling film of refrigerant is thereby created. It will flow downward to coat the balance of the primary fluid side of the plates.

Figure 50:
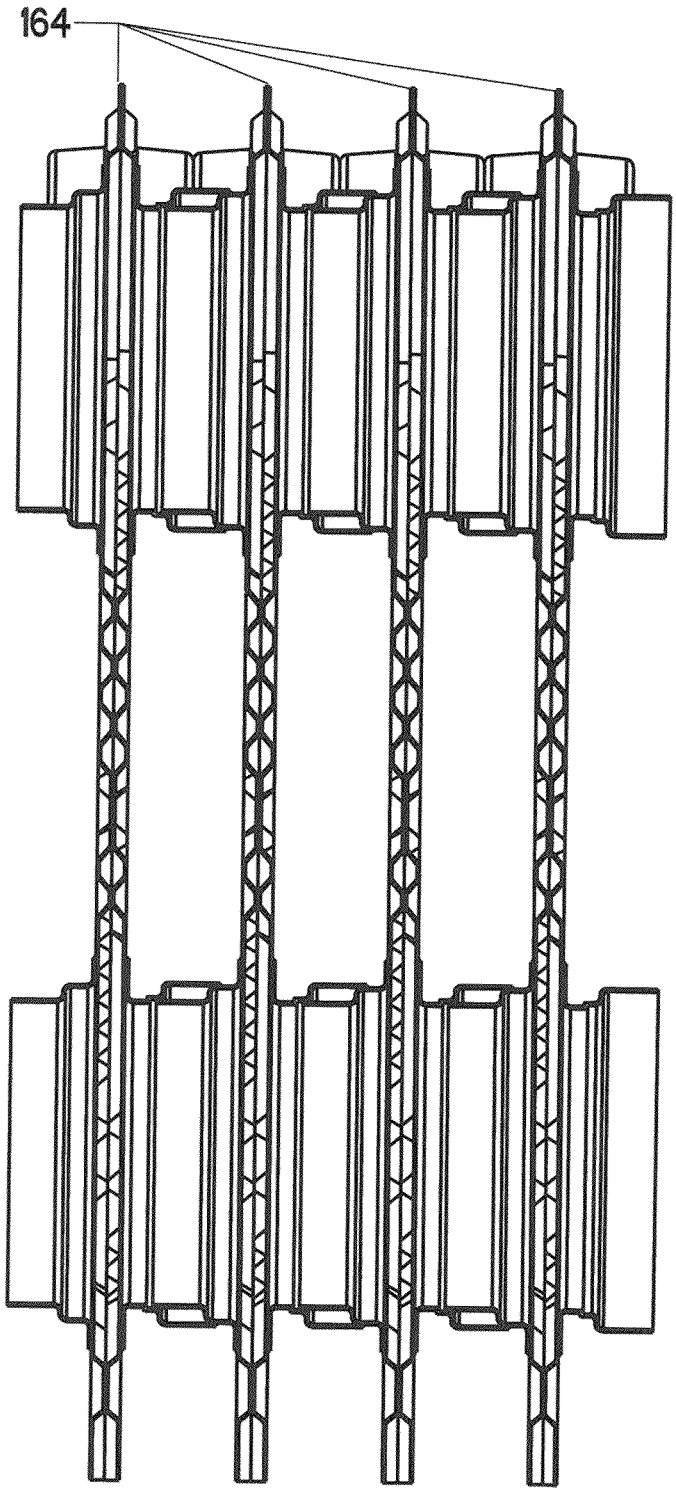
FIG. 50 is a sectioned elevation view, showing the flow of secondary fluid through the assembly of FIG. 49.
Figure 51:
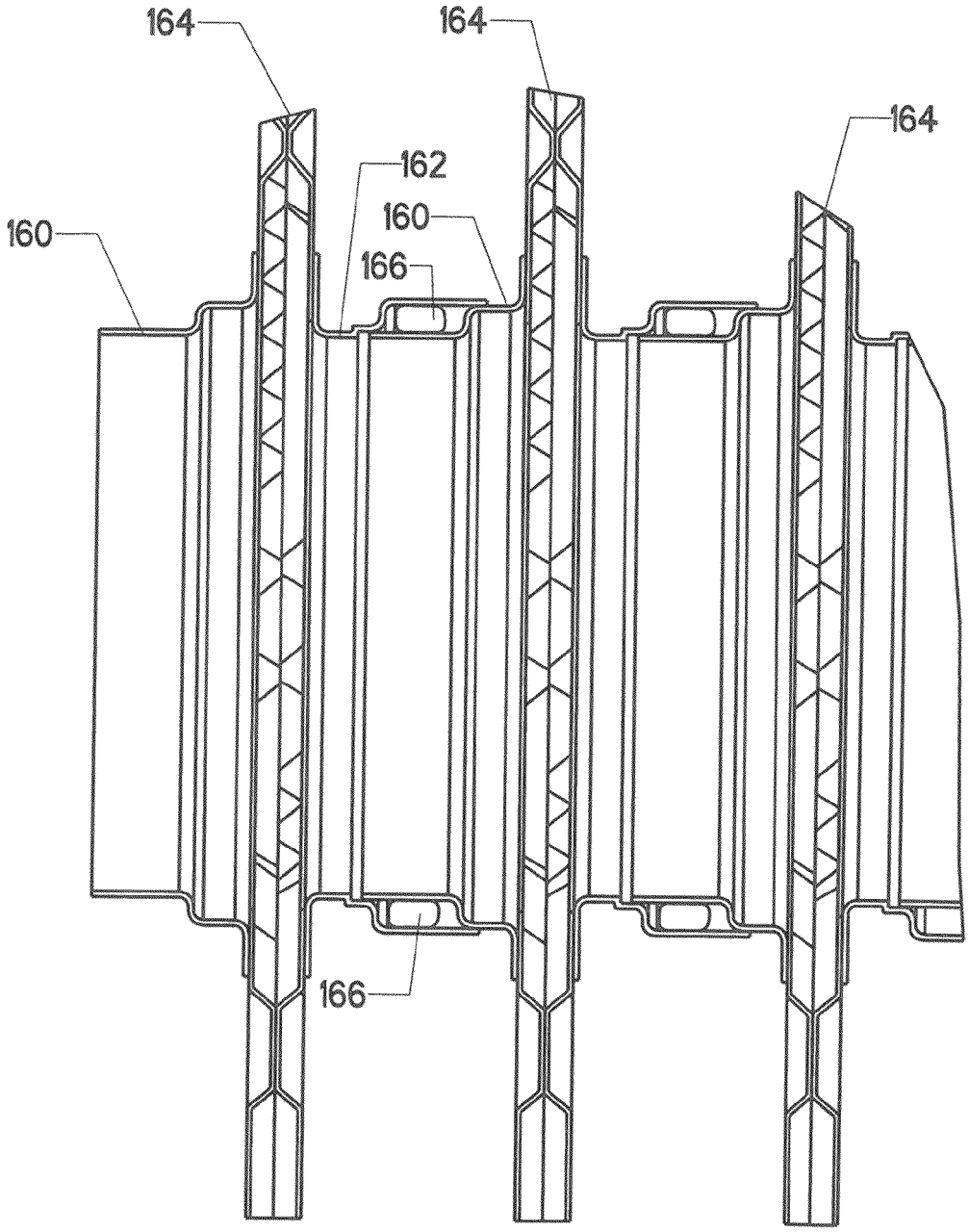
FIG. 51 is a detailed view of the section shown in FIG. 50.

FIG. 50 shows a section view taken through the central axis of the inlet holes 24 ad outlet holes 26. FIG. 51 shows additional detail of this section view. The reader will observe how a portion of each female coupler 162 overlaps a portion of each male coupler 160 in order to create a continuous passage for the flow of the secondary fluid. The seal at this overlap is preferably improved by the addition of a gasketing device such as O-ring 166. The O-ring in the embodiment shown is compressed and captured in position in order to provide a positive seal.

It is again preferable to place the plates bounding the secondary fluid flow channels in a substantially vertical orientation. This orientation promotes the downward flow of the primary fluid being sprayed onto the primary fluid side of the plates. In a preferred embodiment, the plates are within 20 degrees of the vertical. In an even more preferred embodiment, the plates are within 10 degrees of the vertical.

The reader will thereby appreciate how a primary fluid manifold for the falling-film type of heat exchanger can actually be incorporated as a feature in the plates used to contain the secondary fluid. The design illustrated segregates the flow of primary and secondary fluids and produces highly efficient heat transfer. The example shown is merely exemplary. Numerous other geometries could be employed to create a similar effect.

3. Enhanced Surface Treatments of the Primary Fluid Side

For both the flooded and falling film type of heat exchanger, it is desirable to enhance the surface of the primary fluid side (It may be desirable to enhance the surface of the secondary fluid side as well, so the following description is potentially applicable to either side). The surface treatment may be applied in any number of ways, including sand or shot blasting, etching, plating, painting, welding, or machining. The result is a primary fluid surface which experiences a greatly increased heat transfer rate.

Figure 28:
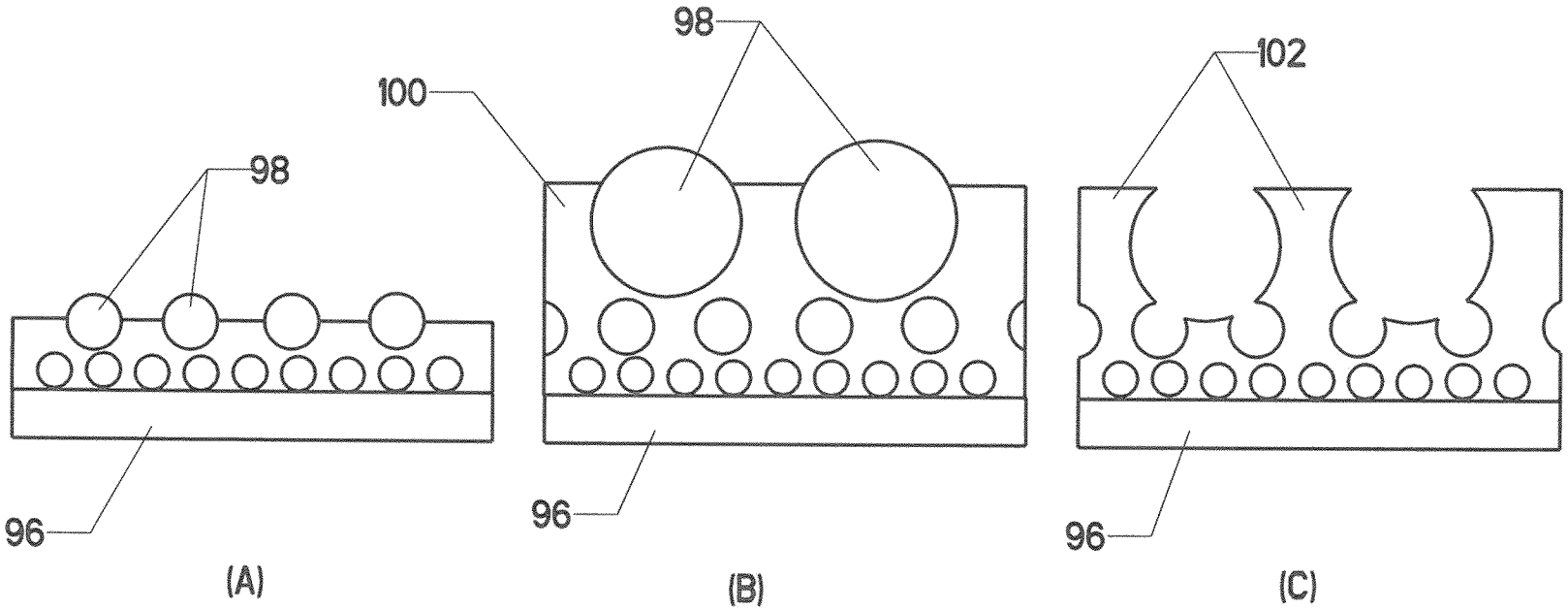
FIG. 28 is a schematic view, showing the progressive formation of an enhanced surface.

The surface treatment applied to the primary fluid side should preferably achieve at least an order of magnitude increase in the effective surface area. Such techniques for surface enhancement are not widely known, so an example may be beneficial to the reader (though the scope of the invention should certainly not be limited by this single example): FIG. 28 shows one suitable technique which has been developed by others. Heat exchanger surface 98 is enhanced by depositing a layer of copper in a controlled fashion. FIG. 28(A) shows the start of the process. Gas bubbles 98 are formed on heat exchanger surface 96. These cling to the surface as copper is electrodeposited on the surface. The result is that the deposited copper forms a lattice between the volumes occupied by the bubbles.

FIG. 28(B) shows the same surface as additional bubbles and additional deposited copper 100 accumulate. FIG. 28(C) shows the same surface after the bubbles have been removed. Copper lattice 102 remains. Of course, the depiction is rather simplified and the lattice formed is actually more complex. It is also possible to take advantage of the crystalline structure of the metal being deposited to create additional surface complexity.

Figure 29:
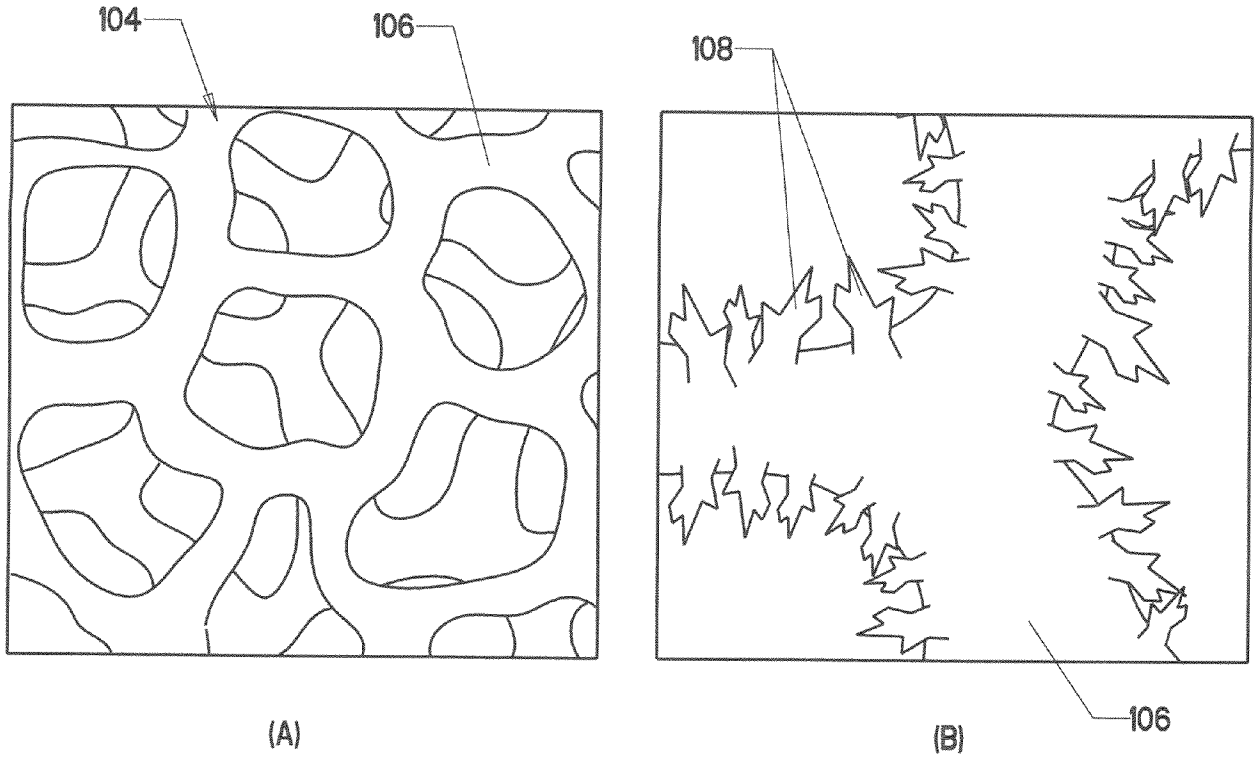
FIG. 29 is a detailed plan view of the enhanced surface formed by the process of FIG. 28.

FIG. 29(A) shows a magnified plan view of the enhanced surface. The copper is deposited in the interstices between the bubbles, resulting in a structure similar to that of open cell foam (referred to as open cell lattice in the view). FIG. 29(B) shows the same structure at still higher magnification. Ribs 106 are covered in dendrites 108 (The term "dendrites" is used to suggest a structure resembling the branches and foliage of a tree, rather than any neurological connotation). Dendrites 108 further increase the surface area of the deposited copper.

Figure 30:
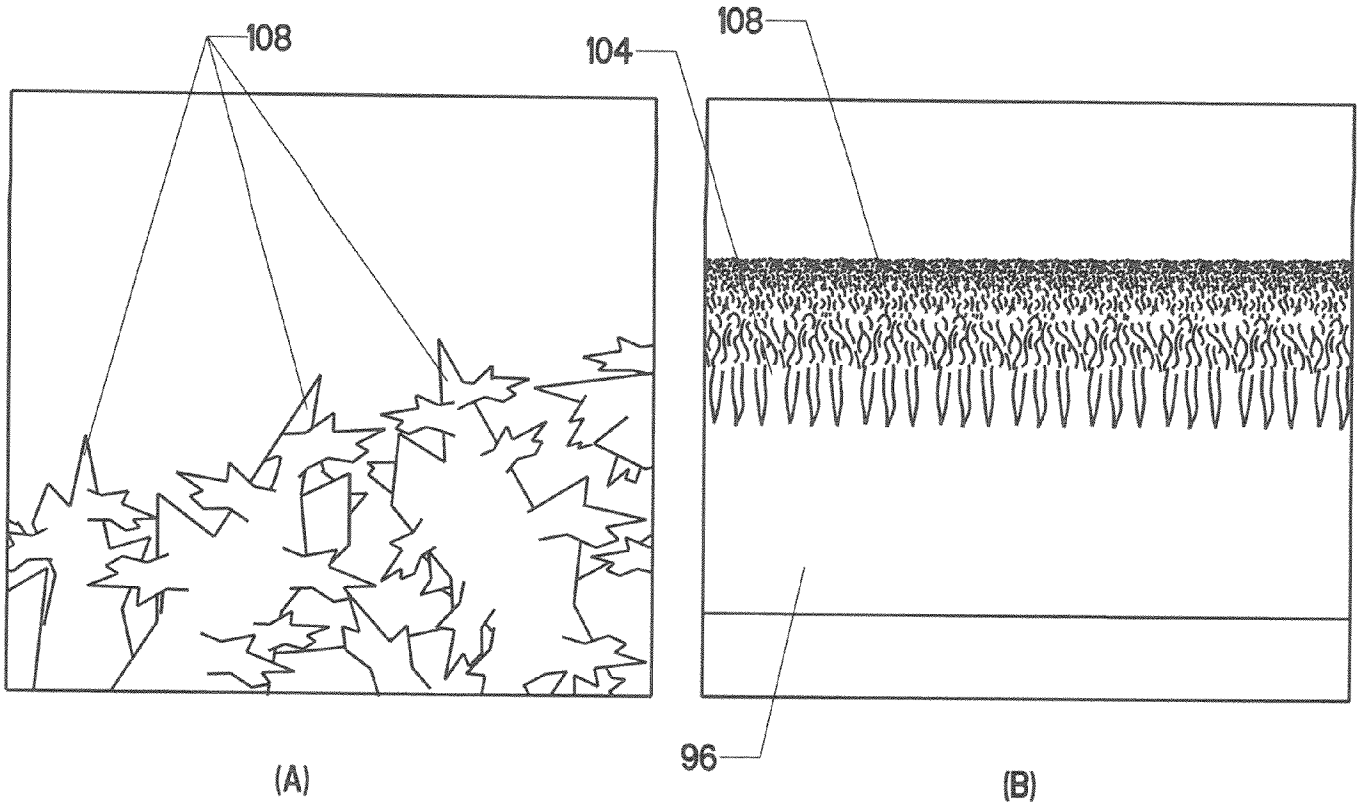
FIG. 30 is a further magnification of the enhanced surface.

FIG. 30(A) shows a rib 106 with associated dendrites 108 at a higher degree of magnification. FIG. 30(B) is an elevation view of heat exchanger surface 96 after the enhancement process is complete. Open celled lattice 104 extends significantly upward from the original uncoated surface. The effective surface area is thereby increased well beyond an order of magnitude.

Figure 31:
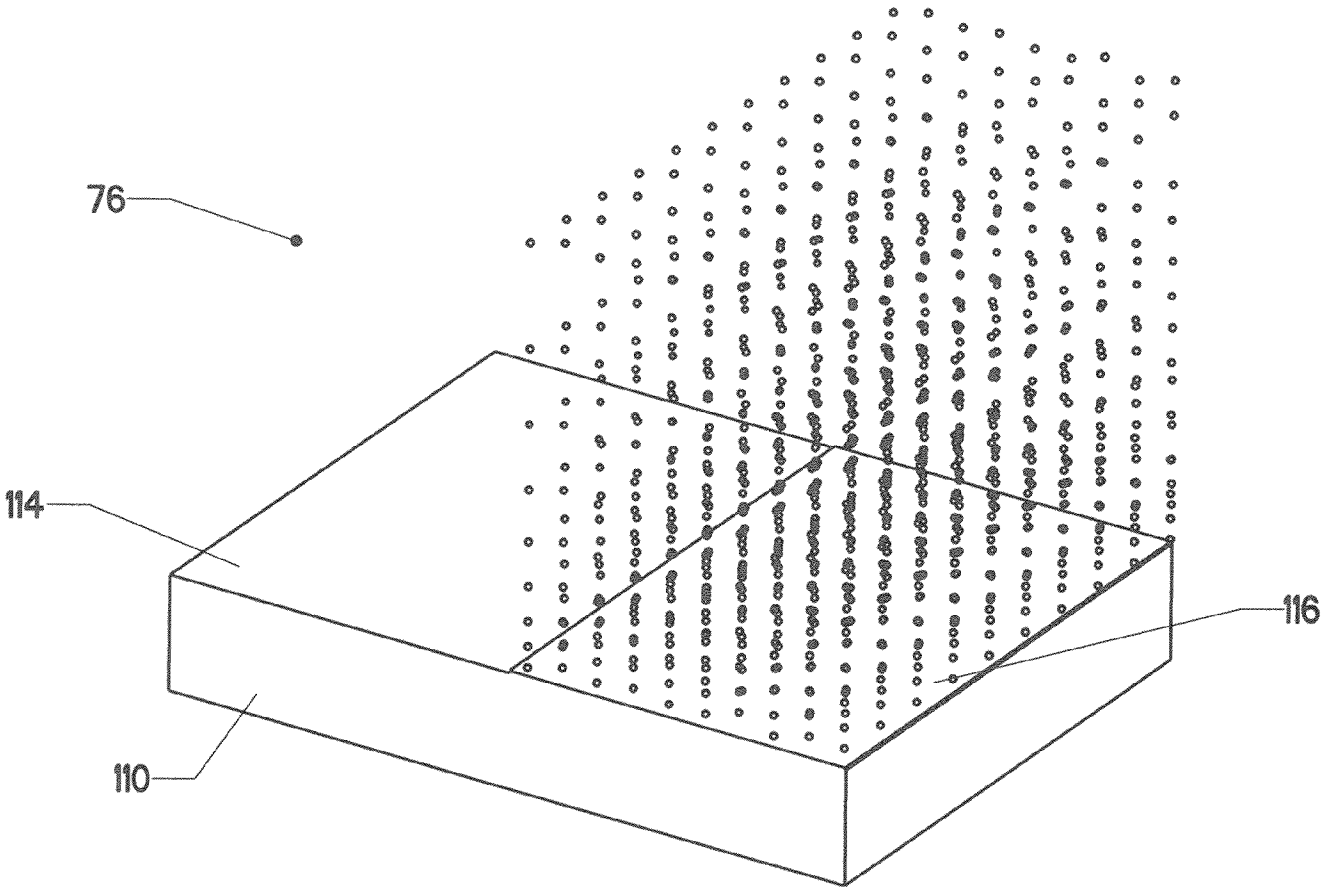
FIG. 31 is a perspective view, showing a comparison of heat transfer rates between an untreated surface and an enhanced surface.

FIG. 31 shows a simple example of the effect that such a surface enhancement has on the heat transfer rate. Heated plate 110 is immersed in liquid primary fluid 76 (a refrigerant). The upper surface of the heated plate is divided into untreated surface 114 and enhanced surface 116. Uniform heat input is applied across the plate. The refrigerant above enhanced surface 116 begins to violently bubble while the water above the untreated surface has not yet formed any gas bubbles.

Figure 32:
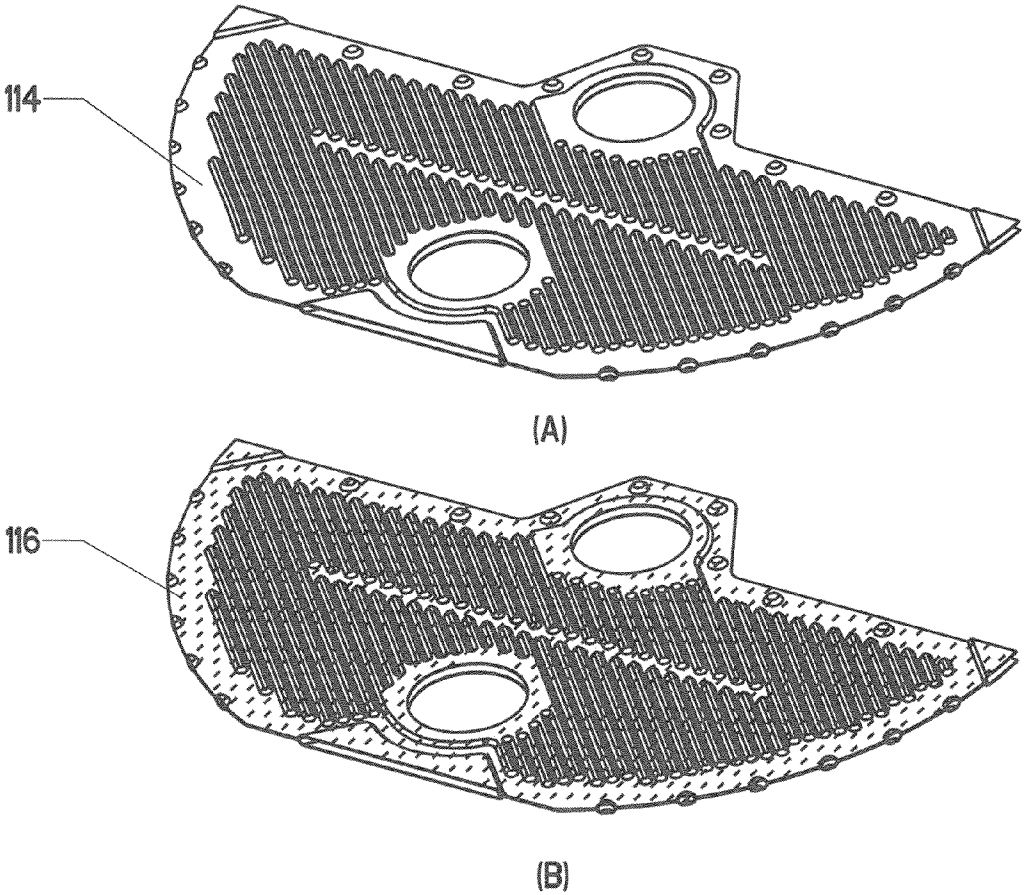
FIG. 32 is a perspective view, showing the application of the enhanced surface technique to a joined pair of plates.

The same deposition process thus described can be applied to the plates used in the heat exchanger. FIG. 32(A) shows a plate pair 64. The outer surfaces of the plate pair are untreated (untreated surface 114). If the openings into the pair are suitably masked, then an electrodeposition process such as shown in FIG. 28 can be applied. Thus, the exposed surfaces of the plate pair will be covered in an open cell lattice having associated dendrites. FIG. 32(B) shows the same plate pair with enhanced surface 116. The deposited copper lattice is in direct contact with the metal of the plates themselves. Thus, the plate surface area facing the primary fluid is dramatically increased.

When the enhanced plates are placed into a heat exchanger, much higher heat exchange rates are possible. The water flowing through the secondary fluid cavities can be propelled at high velocities. The refrigerant can move at relatively low velocities.

A counterflow heat exchanger such as this is unusual in that the secondary fluid flows so much faster than the primary fluid. Plate-type heat exchangers traditionally have uniform spacing between the plates. However, both the flooded and falling film type of exchangers can benefit from a non-uniform plate spacing. The flooded type may benefit from additional volume on the primary fluid side. Of course, the falling film type typically needs additional volume on the primary fluid side in order to provide room for the spray plate pairs.

4. The Addition of Other Components

As discussed previously, one good application for the heat exchanger is in HVAC systems, where it serves as an evaporator. Although the operation of HVAC systems will be well known to those familiar with the art, a brief explanation may prove helpful. In such systems, a refrigerant is circulated in a closed loop. Gaseous refrigerant is compressed in a compressor, where it emerges as a hot gas. This hot gas flows through a condenser, where it is condensed to a cooler liquid. The liquid then passes through an expansion valve where it enters the evaporator and transitions to a cold, low-pressure liquid. The evaporation process absorbs heat from some other source (such as water circulated in a "chiller" loop). This heat boils the liquid into a gaseous state. It is the removal of this heat from the secondary fluid that provides refrigeration.

When the proposed heat exchanger serves as an evaporator in an HVAC loop, other components may need to be considered. The vaporized primary fluid leaving the evaporator may be heavily laden with liquid (a "wet" gas). This condition may cause problems, especially if the liquid is able to be carried back to the compressor. The introduction of wet gas to the compressor can lead to premature compressor failure.

Figure 22:
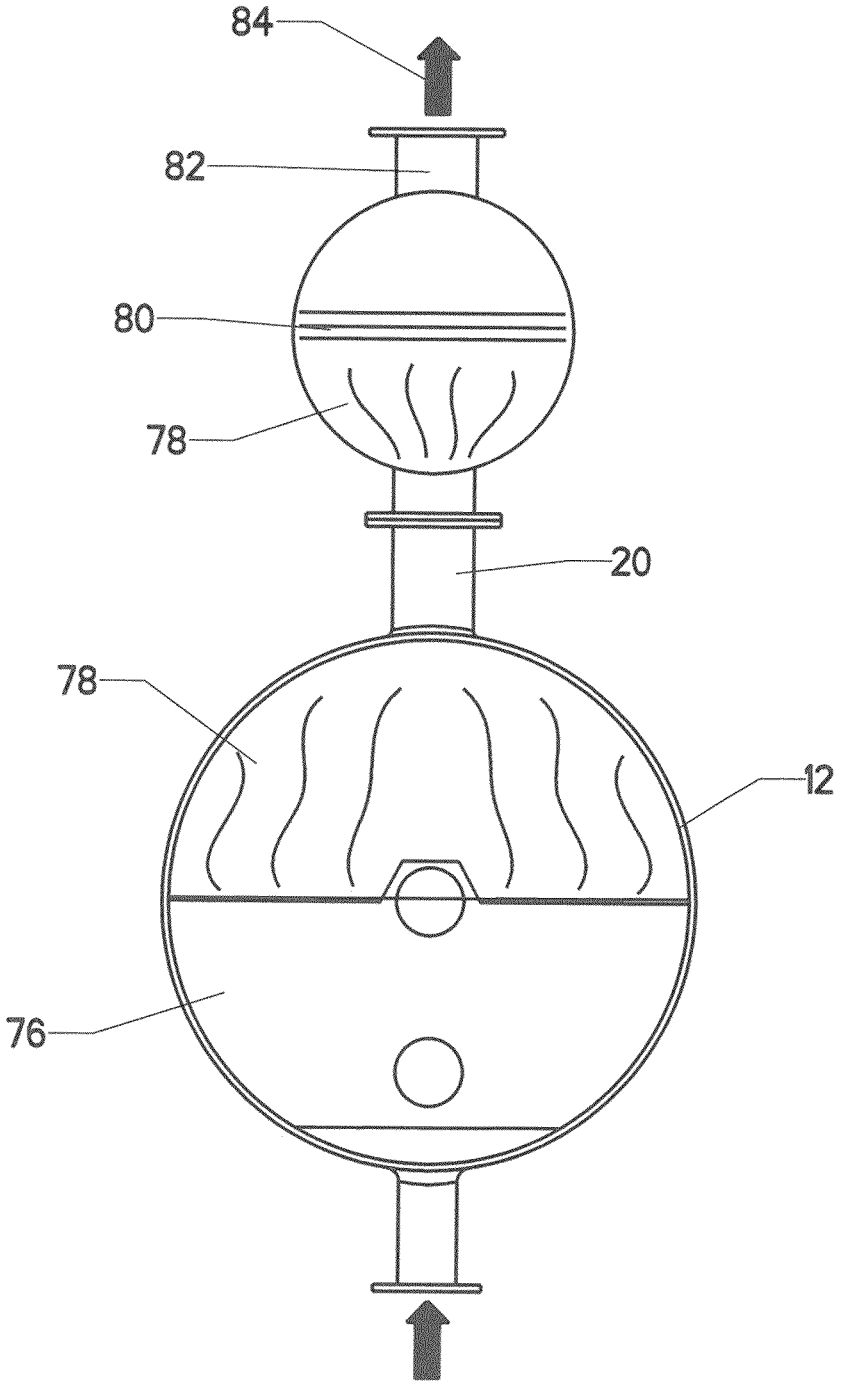
FIG. 22 is a schematic view, showing the addition of a liquid eliminator.

FIG. 22 shows one possible solution for this concern. Liquid eliminator 80 has been added downstream of pressure vessel 12. This device takes "wet" vaporized primary fluid 78 and separates liquid droplets from the wet vapor, then feeds dry vapor 82 out dry vapor outlet 84 and to the compressor.

Figure 23:
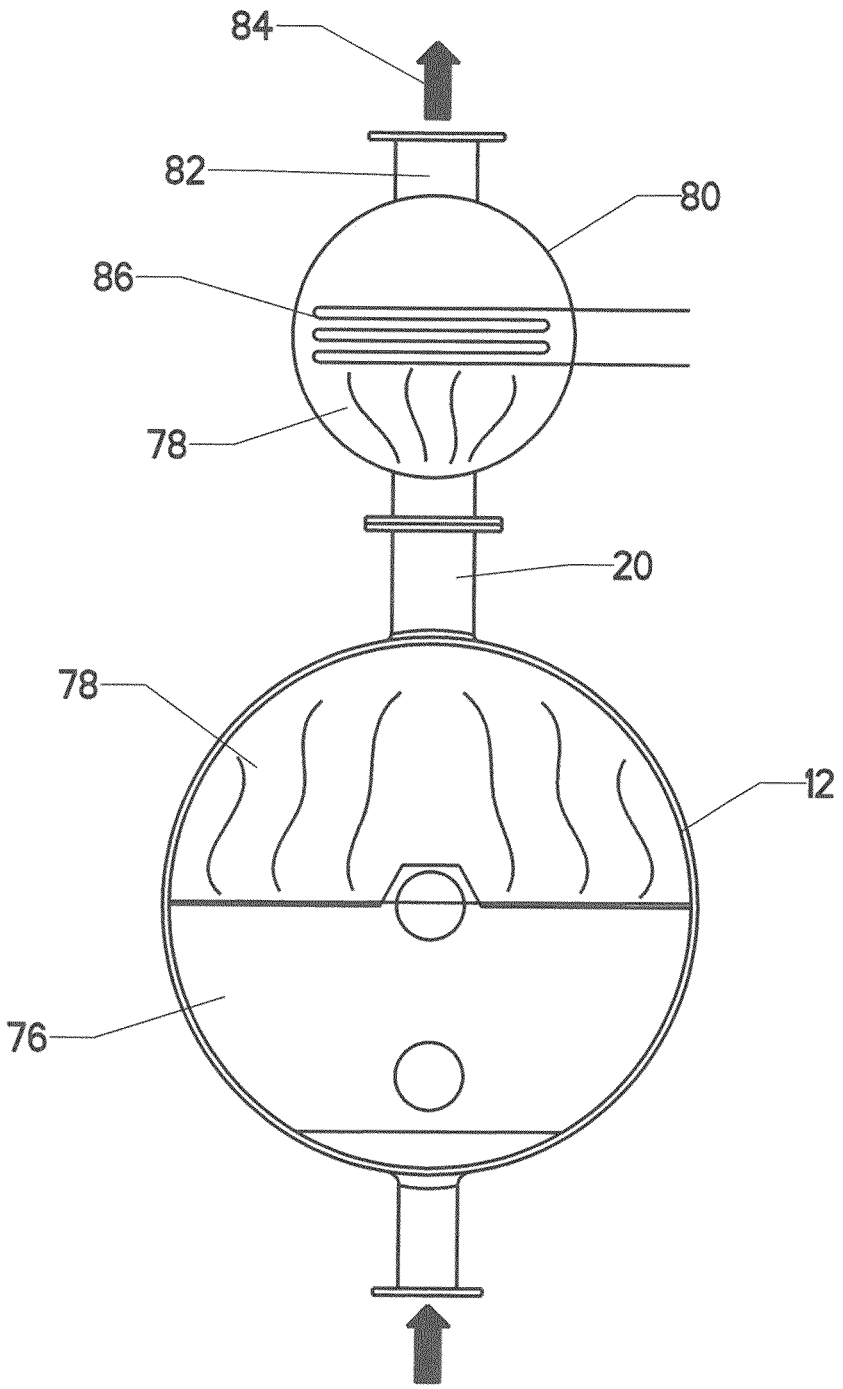
FIG. 23 is a schematic view, showing the addition of a secondary heat exchanger.

The liquid eliminator can assume many forms. FIG. 23 shows one possible embodiment. Secondary heat exchanger 86 is placed within the liquid eliminator. This component adds heat to the "wet" gas to convert it to dry vapor 82. The heat source for secondary heat exchanger 86 can be external to the HVAC circulating loop or internal to the HVAC circulating loop. As an example, the secondary heat exchanger can be connected between the compressor and the condenser. It then transfers some of the heat from the hot compressed gas leaving the compressor to the "wet" refrigerant vapor leaving the heat exchanger in order to raise the temperature of the "wet" refrigerant vapor (and thereby "dry" it).

Figure 24:
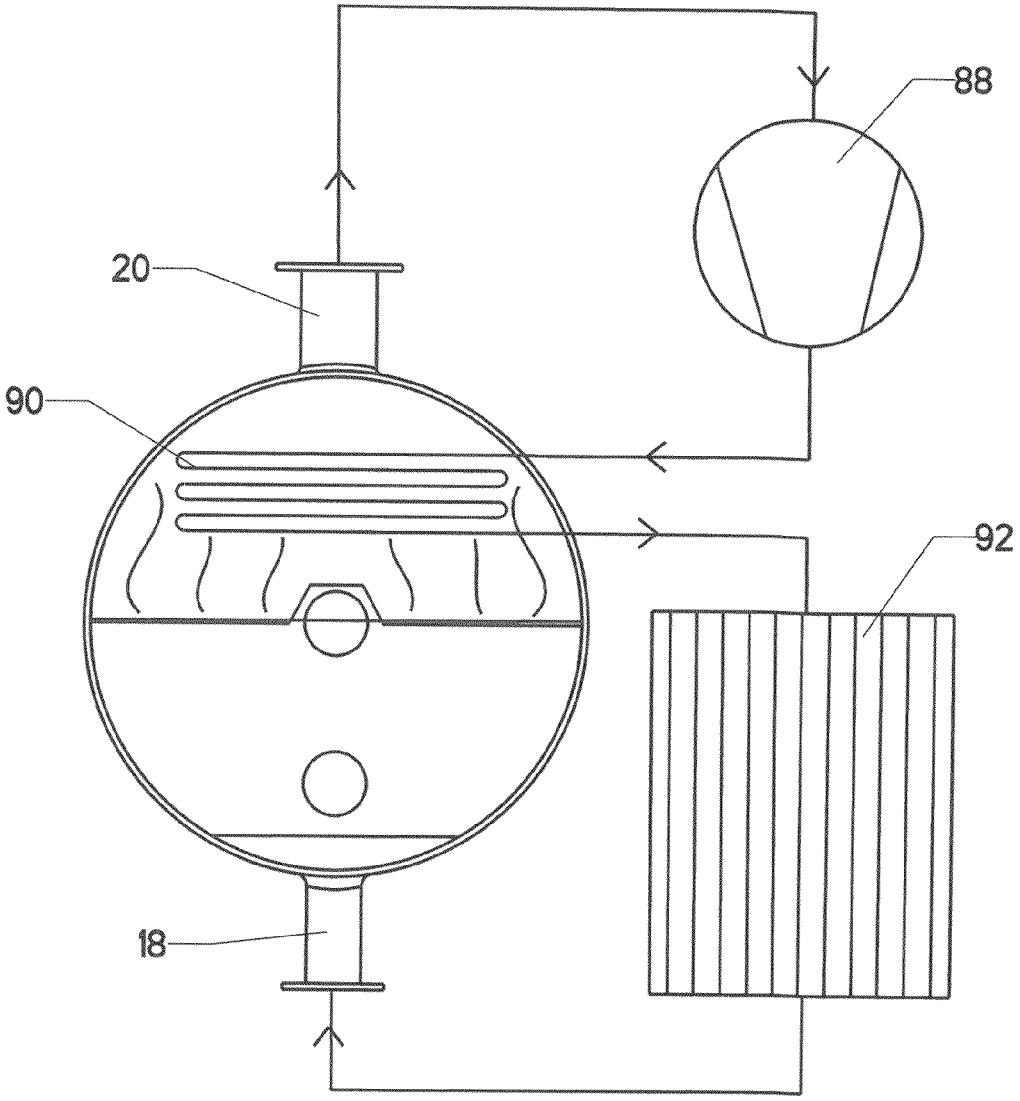
FIG. 24 is a schematic view, showing the addition of a de-superheater.

Of course, this technique is not just limited to use in a separate liquid eliminator. Such a secondary heat exchanger could be used in the top of the pressure vessel itself. FIG. 24 illustrates this embodiment. The secondary heat exchanger is still connected between compressor 88 and condenser 92. However, instead of being placed in a second pressure vessel it is placed in the same pressure vessel as the plate-type heat exchanger. In this context the secondary heat exchanger is referred to as de-super heater 90. It is given this name because it can reduce the superheated state of the hot compressed gas leaving the compressor before it enters the condenser.

Figure 25:
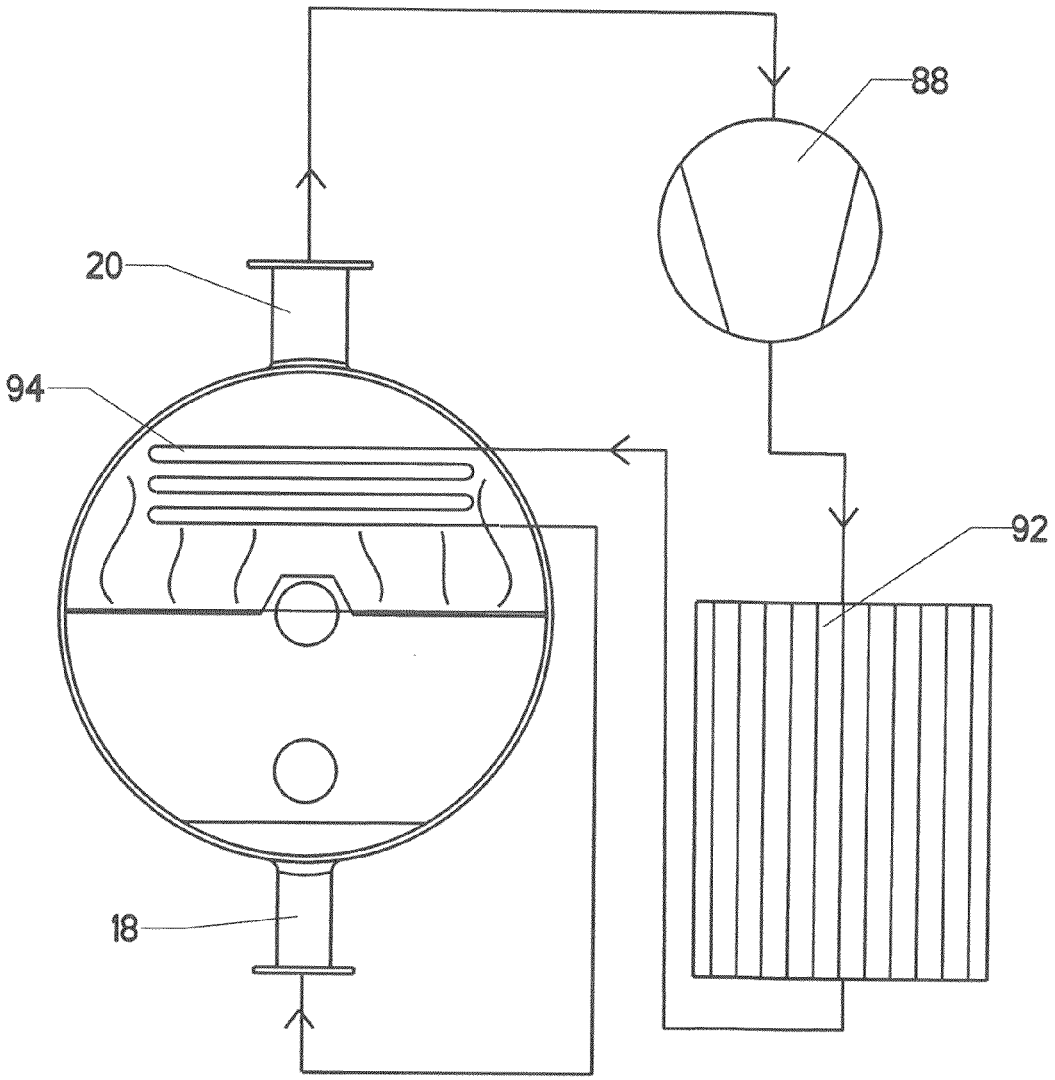
FIG. 25 is a schematic view, showing the use of a sub-cooler.

Of course, a more efficient way would be to connect the secondary heat exchanger between the condenser and primary fluid inlet 18. FIG. 25 shows this arrangement. In this context, the secondary heat exchanger is referred to as sub-cooler 94. It still performs the same function of transferring heat to the "wet" refrigerant vapor to dry it before it returns to the compressor.

Figure 26:
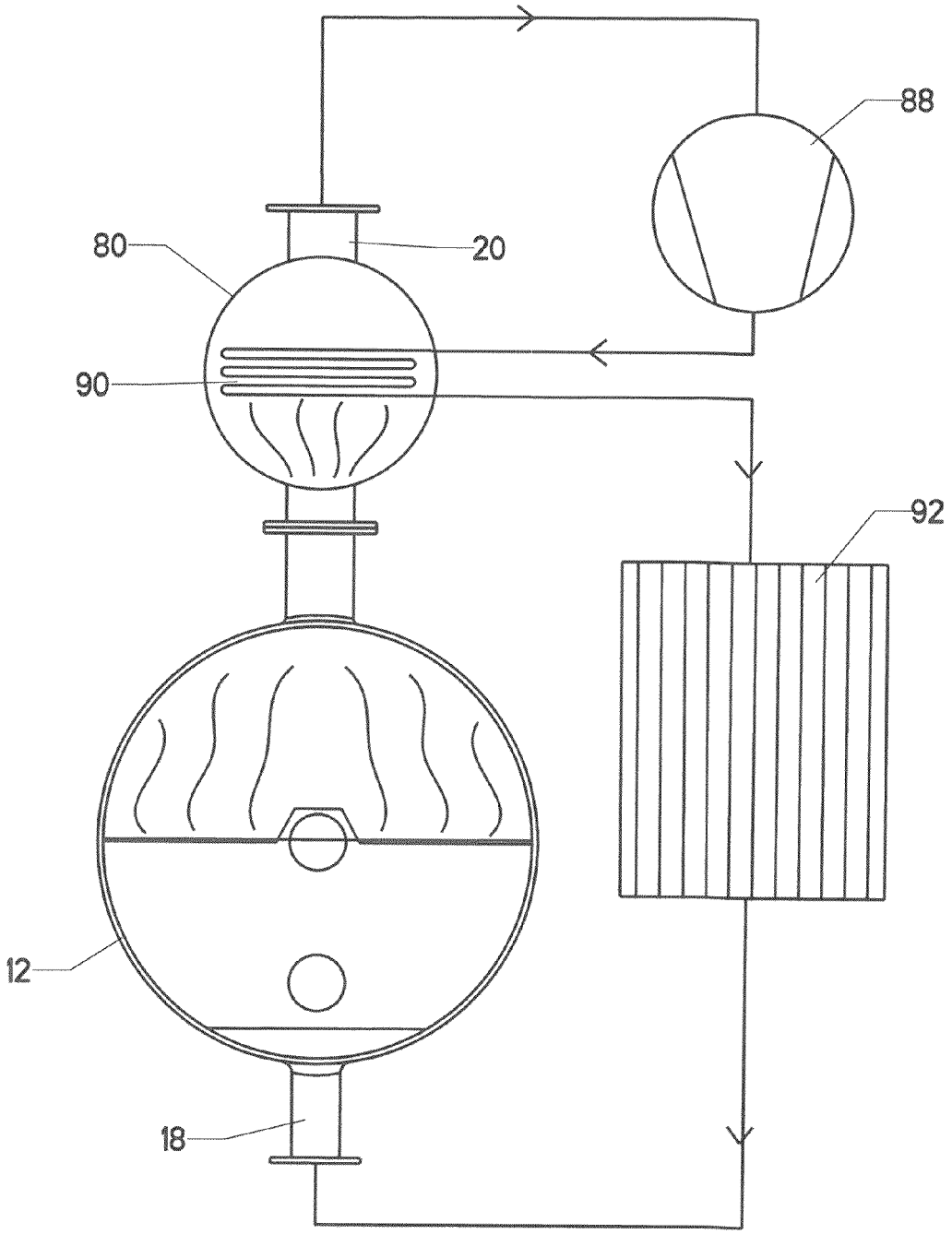
FIG. 26 is a schematic view, showing the addition of a de-superheater and a liquid eliminator.
Figure 27:
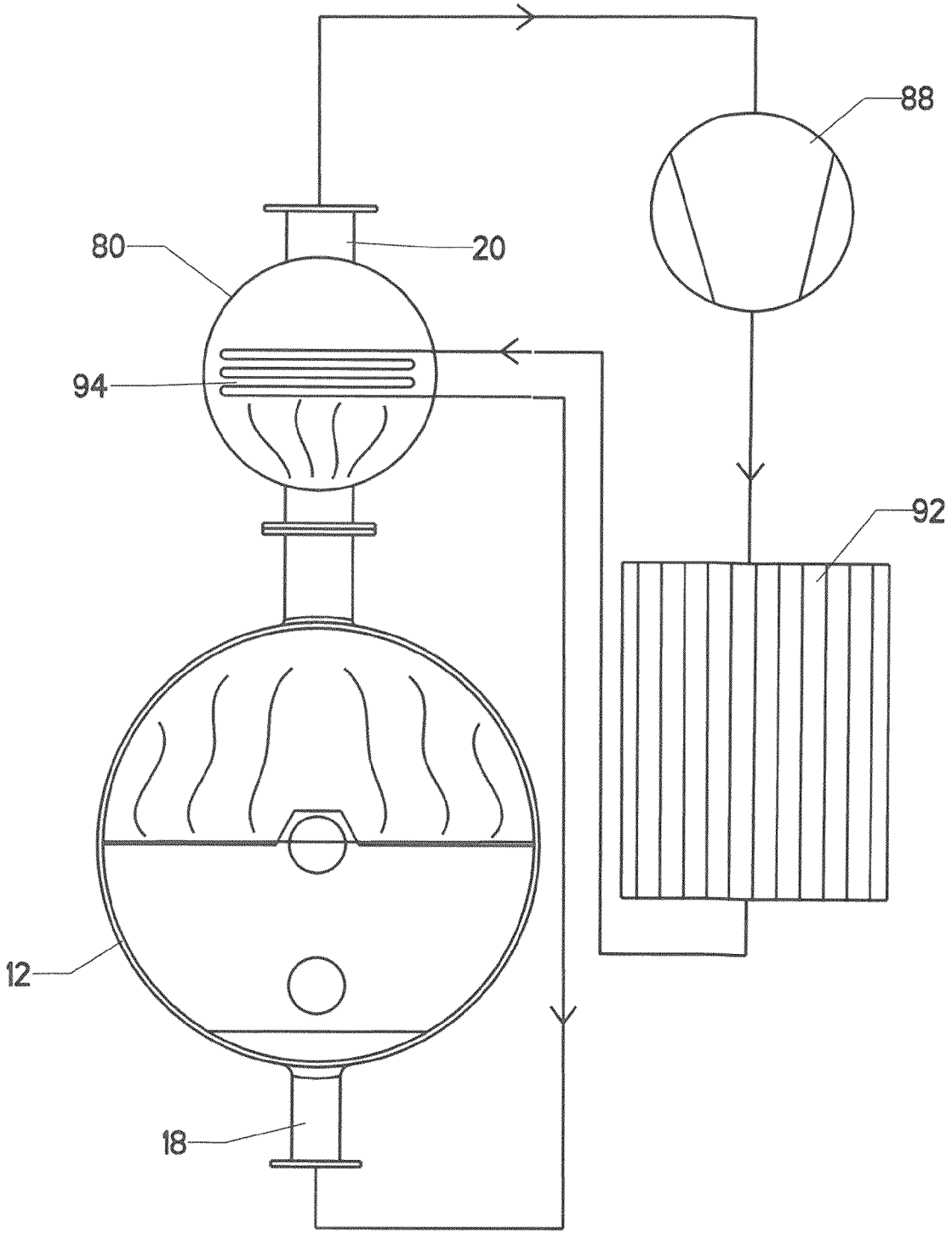
FIG. 27 is a schematic view, showing the addition of a sub-cooler and a liquid eliminator.

Of course, the embodiments of FIGS. 24 and 25 can also be carried out using a separate pressure vessel (liquid eliminator 80). In FIG. 26, a de-super heater 90 is installed in liquid eliminator 80. This component is connected between compressor 88 and condenser 92. In FIG. 27, a sub-cooler 94 is installed in liquid eliminator 80. The sub-cooler is connected between condenser 92 and primary fluid inlet 18.

Although the preceding description contains significant detail, it should not be construed as limiting the scope of the invention but rather as providing illustrations of the preferred embodiments of the invention. The inventive device could be realized in many different ways. The examples of use in HVAC application are typical, but should not be viewed as limiting. Likewise, the examples of surface enhancement techniques given should not be viewed as limiting. Thus, the scope of the invention should be fixed by the following claims rather than the examples given.

The invention claimed is:

1. A heat exchanger for exchanging heat between a primary fluid and a secondary fluid, comprising: a. a vessel, including a primary fluid inlet, a primary fluid outlet, a secondary fluid inlet, and a secondary fluid outlet; b. a plurality of secondary flow channels, with each of said secondary flow channels being formed by a pair of plates having an inlet fluidly connected to said secondary fluid inlet and an outlet fluidly connected to said secondary fluid outlet; c. said plurality of secondary flow channels being fluidly connected in parallel; d. each of said plates having an outward facing primary fluid side; and e. a spray manifold fluidly connected to said primary fluid inlet, said spray manifold having a plurality of spray nozzles directed toward said outward facing primary fluid sides of said secondary flow channels, said spray nozzles directing a spray of said primary fluid against said outward facing primary fluid side of one of said secondary flow channels; a plurality of spray manifolds located in between said pairs of plates forming said secondary flow channels; wherein each of said spray manifolds is bound by a pair of mated spray plates, with each of said spray plates having an inward facing liquid primary fluid side and an outward facing evaporating primary fluid side; and wherein said spray plates and said plates are bonded together.

2. The heat exchanger as recited in claim 1, wherein said plurality of secondary flow channels are in a vertical orientation.

3. The heat exchanger as recited in claim 2, wherein said secondary fluid is forced through said secondary flow channels from bottom to top.

4. The heat exchanger as recited in claim 1, wherein said primary fluid side of each of said plates is provided with an enhanced surface having a surface area at least an order of magnitude greater than an untreated surface.

5. A heat exchanger the exchanging heat between a primary fluid and a secondary fluid, comprising: a. a vessel, including a primary fluid inlet, a primary fluid outlet, a secondary fluid inlet, and a secondary fluid outlet; b. a plurality of secondary flow channels, with each of said secondary flow channels having an inlet fluidly connected to said secondary fluid inlet and an outlet fluidly connected to said secondary fluid outlet; c. said plurality of secondary flow channels being fluidly connected in parallel; d. each of said plurality of secondary flow channels being bounded by a pair of mated plates, with each of said plates having an inward facing secondary fluid side and an outward facing primary fluid side; e. said plurality of secondary flow channels being spaced apart to create a plurality of gaps between adjoining pairs of mated plates; f. a plurality of spray manifolds located in at least some of said plurality of gaps between said adjoining pairs of mated plates; and g. wherein each of said spray manifolds has a plurality of spray nozzles directed toward said outward facing primary fluid sides of said secondary flow channels, said spray nozzle directing a spray of said primary fluid against said outward facing primary fluid side of at least one of said secondary flow channels; wherein each of said spray manifolds is bounded by a pair of mated spray plates, with each of said spray plates having an inward facing liquid primary fluid side and an outward facing evaporating primary fluid side; and wherein said spray plates and said plates are bonded together.

6. The heat exchanger as recited in claim 5, wherein said plurality of secondary flow channels are in a vertical orientation.

7. The heat exchanger as recited in claim 6, wherein said secondary fluid is forced through said secondary flow channels from bottom to top.

8. The heat exchanger as recited in claim 5, wherein said primary fluid side of each of said plates is provided with an enhanced surface having a surface area at least an order of magnitude greater than an untreated surface.

9. A heat exchanger for exchanging heat between a primary fluid and a secondary fluid, comprising:

a. a vessel, including a primary fluid inlet, a primary fluid outlet, a secondary fluid inlet, and a secondary fluid outlet;

b. a plurality of secondary flow channels, with each of said secondary flow channels having an inlet fluidly connected to said secondary fluid inlet and an outlet fluidly connected to said secondary fluid outlet;

c. said plurality of secondary flow channels being fluidly connected in parallel;

d. each of said plurality of secondary flow channels being bounded by a pair of mated plates, with each of said plates having an inward facing secondary fluid side and an outward facing primary fluid side;

e. said plurality of secondary flow channels being spaced apart to create a plurality of gaps between adjoining pairs of mated plates;

f. a plurality of spray manifolds located in at least some of said plurality of gaps between said adjoining pairs of mated plates;

g. wherein at least some of said spray manifolds have a plurality of spray nozzles directed toward said outward facing primary fluid sides of adjacent secondary flow channels, said spray nozzles directing a spray of said primary fluid against said outward facing primary fluid sides of said adjacent secondary flow channels; and h. each of said spray manifolds being bounded by a pair of mated spray plates, with each of said spray plates having an inward facing liquid primary fluid side and an outward facing evaporating primary fluid side.

10. The heat exchanger as recited in claim 9, wherein said plurality of secondary flow channels are in a vertical orientation.

11. The heat exchanger as recited in claim 10, wherein said secondary fluid is forced through said secondary flow channels from bottom to top.

12. The heat exchanger as recited in claim 9, wherein said spray plates and said plates are bonded together.

13. The heat exchanger as recited in claim 12, wherein said spray plates and said plates are bonded together by brazing.

14. The heat exchanger as recited in claim 9, wherein said primary fluid side of each of said plates is provided with an enhanced surface having a surface area at least an order of magnitude greater than an untreated surface.

15. The heat exchanger as recited in claim 9, wherein:

a. each of said plates has an upper perimeter;

b. each of said pair of mated spray plates includes a primary fluid inlet fluidly connected to said primary fluid inlet in said vessel; and c. each of said primary fluid inlets on said pair of mated spray plates lies above said upper perimeters of said plates.

* * * * *